US007364841B2

(12) United States Patent
Suzuki et al.

(10) Patent No.: US 7,364,841 B2
(45) Date of Patent: Apr. 29, 2008

(54) SILVER SALT PHOTOTHERMOGRAPHIC DRY IMAGING MATERIAL

(75) Inventors: Tetsuya Suzuki, Tokyo (JP); Hideki Takiguchi, Tokyo (JP); Toshiyuki Marui, Tokyo (JP); Kazuhiko Fujikura, Tokyo (JP); Kazuhito Ihara, Tokyo (JP); Yasuo Taima, Tokyo (JP); Kenji Ohnuma, Tokyo (JP); Hiroto Ito, Tokyo (JP)

(73) Assignee: Konica Minolta & Medical Graphic, Inc., Tokyo (JP)

( * ) Notice: Subject to any disclaimer, the term of this patent is extended or adjusted under 35 U.S.C. 154(b) by 42 days.

(21) Appl. No.: 11/468,438

(22) Filed: Aug. 30, 2006

(65) Prior Publication Data

US 2007/0003886 A1 Jan. 4, 2007

Related U.S. Application Data

(62) Division of application No. 10/932,992, filed on Sep. 2, 2004, now Pat. No. 7,138,225.

(30) Foreign Application Priority Data

Sep. 12, 2003 (JP) ..... 2003-320555
Sep. 29, 2003 (JP) ..... 2003-337269

(51) Int. Cl.

| | |
|---|---|
| ***G03C 5/16*** | (2006.01) |
| ***G03C 1/00*** | (2006.01) |
| ***G03C 1/06*** | (2006.01) |
| ***G03C 1/005*** | (2006.01) |
| ***G03C 1/08*** | (2006.01) |

(52) U.S. Cl. ..... 430/348; 430/350; 430/559; 430/570; 430/603; 430/617; 430/618; 430/619; 430/620

(58) Field of Classification Search ..... 430/559, 430/570, 348, 350, 618, 619, 620, 617, 603
See application file for complete search history.

(56) References Cited

U.S. PATENT DOCUMENTS

| | | | | |
|---|---|---|---|---|
| 4,524,128 | A | 6/1985 | Edwards et al. | |
| 5,434,043 | A | 7/1995 | Zou et al. | |
| 5,858,632 | A | 1/1999 | Taguchi | |
| 7,138,225 | B2 * | 11/2006 | Suzuki et al. | 430/619 |
| 2003/0203323 | A1 | 10/2003 | Takiguchi et al. | |

FOREIGN PATENT DOCUMENTS

| | | |
|---|---|---|
| EP | 0739748 | 10/1996 |
| EP | 1422552 | 5/2004 |
| JP | 2001228576 | 8/2001 |

OTHER PUBLICATIONS

XP-002310378 Database WPI Derwent Publications Ltd, Feb. 2000.

* cited by examiner

*Primary Examiner*—Geraldina Visconti
(74) *Attorney, Agent, or Firm*—Lucas & Mercanti, LLP

(57) ABSTRACT

A silver salt photothermographic dry imaging material wherein said material has photographic speeds (1) and (2) determined based on the predetermined conditions and the photographic speed (2) is not more than 1/10 of the photographic speed (1), and the coefficient of determination value $R^2$ of the linear regression line is 0.998-1.000, which is obtained from the predetermined density points having a* and b* arranged in two-dimensional coordinates in which a* is used as the abscicca and b* is used as the coordinate of the CIE 1976 (L*a*b*) color space, b* of the intersection point of the linear regression line with the ordinate is −5-5, and gradient (a*/b*) is 0.7-2.5.

12 Claims, No Drawings

SILVER SALT PHOTOTHERMOGRAPHIC DRY IMAGING MATERIAL

CROSS REFERENCE TO RELATED APPLICATIONS

This is a Divisional of U.S. patent application Ser. No. 10/932,992, filed Sep. 2, 2004, now U.S. Pat. No. 7,138,225, which claimed the priority of Japanese Patent Application Nos. JP2003-320555, filed Sep. 12, 2003 and JP2003-337209, filed Sep. 29, 2003, all three applications are incorporated herein by reference and the priority of all three applications is claimed.

FIELD OF THE INVENTION

The present invention relates to a silver salt photothermographic dry imaging material.

BACKGROUND OF THE INVENTION

In recent years, in the medical and graphic arts fields, a decrease in the processing effluent has been increasingly demanded from the viewpoint of environmental protection as well as space saving.

As a result, techniques have been sought which relate to photothermographic materials which can be effectively exposed, employing laser imagers and laser image setters, and can form clear black-and-white images exhibiting high resolution.

Such techniques are described in, for example, U.S. Pat. Nos. 3,152,904 and 3,487,075, both by D. Morgan and B. Shely, or D. H. Klosterboer et al., "Dry Silver Photographic Materials", (Handbook of Imaging Materials, Marcel Dekker, Inc. page 48, 1991). Also known are silver salt photothermographic dry imaging materials (hereinafter occasionally referred to simmply as photothermographic materials) which comprise a support having thereon organic silver salts, photosensitive silver halide and reducing agents. Since any solution-based processing chemicals are not employed for the aforesaid silver salt photothermographic dry imaging materials, they exhibit advantages in that it is possible to provide a simpler environmentally friendly system to customers.

These silver salt photothermographic dry imaging materials are characterized in that photosensitive silver halide grains, which are incorporated in a photosensitive layer, are utilized as a photo-sensor and images are formed in such a manner that silver halide grains are thermally developed, commonly at 80 to 140° C., utilizing the incorporated reducing agents while using organic silver salts as a supply source of silver ions, and fixing need not be carried out.

However, the aforesaid silver salt photothermographic dry imaging materials tend to result in fogging during storage prior to thermal development, due to incorporation of organic silver salts, photosensitive silver halide grains and reducing agents. Further, after exposure, thermal development is commonly carried out at 80 to 250° C. followed by no fixing. Therefore, since all or some of the silver halide, organic silver salts, and reducing agents remain after thermal development, problems occur in which, during extended storage, image quality such as silver image tone tends to vary due to formation of metallic silver by heat as well as light.

Techniques which overcome these problems are disclosed in Patent Documents Nos. 1, 2, U.S. Pat. No. 5,714,311, European Patent No. 1096310, and references cited therein.

These techniques disclosed therein exhibit some effects, but are not sufficient to meet the market's requirements.

In addition, for the purpose of enhancing covering power (CP), when the number of photosensitive silver halide grains is increased while decreasing the diameter of the aforesaid grains, it has been found that problems occur in which variation and degradation of image quality such as tone of silver images are further accelerated due to effects of light incident to the aforesaid photosensitive slier halide grains during storage of the aforesaid photosensitive silver halide grains after development as well as while viewing them.

A technology employing a leuco dye capable of producing color is disclosed. This technology enables to adjust a hue of silver to a preferred color. The hue of silver is caused by a morphology of silver. Examples of such technology are disclosed in Japanese Patent Publication Open to Public Inspection (hereafter it is referred to as JP-A) Nos. 50-36110, 59-206831, 5-204087, 11-231460, 20002-169249 and 2002-236334. However, this technology is not fully effective to prevent change of color of silver after long-term storage.

It is disclosed another technology to prevent change and deterioration of silver caused by irradiation of light. That technology employs a halogenated compound capable of oxidizing a silver image by irradiation of light. Examples of compounds are shown in Patent Documents Nos. 3, 4 and JP-A 50-120328. However, these compounds generally tend to exhibit an oxidizing property by an effect of heat. As a result, they have an effect of preventing fog formation but at the same time they may prevent formation of a silver image resulting in a loss of photographic speed, a loss of Dmax and a loss of a silver covering power.

On the other hand, demanded as so-called "eternal object" is further improvement of image quality. Specifically, in the medical image field, demanded is development of techniques to achieve higher quality images to enable more accurate diagnosis.

It is demanded to develop a new and high technology to achieve a high image quality in order to solve the above-described problems in the imaging materials of the present technical field.

Patent Document No. 1: JP-A No. 6-208192

Patent Document No. 2: JP-A No. 8-267934

Patent Document No. 3: JP-A No. 7-2781

Patent Document No. 4: JP-A No. 6-208193

SUMMARY

From the viewpoint of the foregoing, the present invention was achieved. An object of the present invention is to provide a silver salt photothermographic dry imaging material which exhibits excellent storage stability, irrespective of high speed as well as low fogging, and further exhibits an excellent hue of silver images after thermal development, with employing a relatively low amount of silver.

These and other objects of the present invention are accomplished by a photothermographic imaging material containing a support having thereon light-insensitive organic silver salt grains, photosensitive silver halide grains, a reducing agent for silver ions and a binder, wherein the imaging material has specific speeds obtained by specific characteristic curves measured in predetermined conditions, and exhibiting specific parameters of regression analysis in a CIE 1976 L*a*b* color space.

DESCRIPTION OF THE PREFERRED EMBODIMENTS

1. An embodiment of the present invention includes a photothermographic imaging material comprising a support having thereon light-insensitive organic silver salt grains, photosensitive silver halide grains, a reducing agent for silver ions and a binder, wherein the imaging material has a first photographic speed and a second photographic speed and the second photographic speed is not more than 1/10 of the first photographic speed, the first photographic speed being derived from a first characteristic curve obtained from the imaging material subjected to a first measuring method comprising the following steps in the order named:

(1a) exposing the imaging material to light (white light or infrared light) using an optical wedge; and (1b) applying heat to the exposed imaging material under a predetermined condition so as to develop the exposed imaging material, and the second photographic speed being derived from a second characteristic curve obtained from the imaging material subjected to a second measuring method comprising the following steps in the order named:

(2a) applying heat to the imaging material under the same condition as (1b);

(2d) exposing the heated imaging material to light using the optical wedge, and when the imaging material is subjected to exposure to light and then is subjected to photothermographic development so as to obtain 4 images each having an optical density of: minimum density, 0.5, 1.0 and 1.5, obtaining coordinates (a*, b*) defined by a CIE 1976 L*a*b* color space from each of said 4 images, then obtaining a linear regression line from said coordinates, wherein, the obtained linear regression line satisfies the following conditions:

(i) a coefficient of determination value ($R^2$) of the linear regression line is from 0.998 to 1.000, (ii) a b* axis intercept of the linear regression line is from −5 to 5;

(iii) a gradient of the linear regression line is from 0.7 to 2.5.

2. Another embodiment of the invention includes a photothermographic imaging material of Item 1, comprising a support having thereon light-insensitive organic silver salt grains, photosensitive silver halide grains, a reducing agent for silver ions and a binder, wherein the imaging material further comprises a yellow leuco dye or a cyan leuco dye;

the silver halide grains are capable of producing a larger number of inner latent images than surface latent images after the imaging material is subjected to heating development; and a surface photographic speed of the imaging material decreases after the imaging material is subjected to heating development.

3. Another embodiment of the invention includes a photothermographic imaging material of Items 1 or 2, wherein the reducing agent is represented by General Formula (RED):

General Formula (RED)

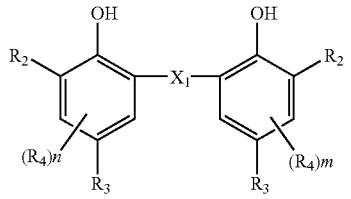

wherein $X_1$ represents a chalcogen atom or $CHR_1$, $R_1$ being a hydrogen atom, a halogen atom, an alkyl group, an alkenyl group, an alkynyl group, an aryl group or a heterocyclic group; $R_2$ represents an alkyl group; $R_3$ represents a hydrogen atom or a substituent capable of substituting a hydrogen atom on a benzene ring; $R_4$ represents a substituent; and, m and n each represents an integer of 0 to 2.

4. Another embodiment of the invention includes a photothermographic imaging material of any one of Items 1 to 3, further comprising a development accelerator, or comprises at least two reducing agents each having a different chemical structure.

5. Another embodiment of the invention includes a photothermographic imaging material of any one of Items 1 to 4, wherein the light-insensitive organic silver salt grains contains silver behenate in an amount of not less than 50 weight % based on the total weight of the light-insensitive organic silver salt grains.

6. Another embodiment of the invention includes a photothermographic imaging material of any one of Items 1 to 5, comprising a support having thereon light-insensitive organic silver salt grains, photosensitive silver halide grains, a reducing agent for silver ions and a binder, wherein the light-insensitive organic silver salt grains are produced by an alkaline metal salt containing a potassium salt in an amount of not less than 50 mol % based on the total mol of the alkaline metal; and the silver halide grains are capable of producing a larger number of inner latent images than surface latent images after the imaging material is subjected to heating development; and a surface photographic speed of the imaging material decreases when the imaging material is subjected to heating development.

7. Another embodiment of the invention includes a photothermographic imaging material of any one of Items 1 to 6, comprising a support having thereon light-insensitive organic silver salt grains, photosensitive silver halide grains, a reducing agent for silver ions and a binder, wherein the light-insensitive organic silver salt grains are produced by:

(i) an alkaline metal salt containing a potassium salt in an amount of riot less than 50 mol % based on the total mol of the alkaline metal; and (ii) silver halide grains having an average particle diameter of 0.02 to 0.07 μm, and the silver halide grains are capable of producing a larger number of inner latent images than surface latent images after the imaging material is subjected to heating development; and a surface photographic speed of the imaging material decreases when the imaging material is subjected to heating development.

8. Another embodiment of the invention includes a photothermographic imaging material of any one of Items 1 to 7, further comprising a compound represented by General Formula (ST):

$$Z\text{-}SO_2.S\text{-}M \qquad \text{General Formula (ST)}$$

wherein Z represents an unsubstituted or substituted alkyl group, an aryl group or a heterocyclic group; and M represents a metal atom or an organic cation.

9. Another embodiment of the invention includes a photothermographic imaging material of any one of Items 1 to 8, further comprising a compound represented by General Formula (CV):

General Formula (CV)

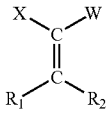

wherein, X represents an electron withdrawing group; W represents a hydrogen atom, an alkyl group, an alkenyl group, an alkynyl group, an aryl group, a heterocyclic group, a halogen atom, a cyano group, an acyl group, a thioacyl group, an oxalyl group, an oxyoxalyl group, a —S-oxalyl group, an oxamoyl group, an oxycarbonyl group, a —S-carbonyl group, a carbamoyl group, a thiocarbamoyl group, a sulfonyl group, a sulfinyl group, an oxysulfonyl group, a —S-sulfonyl group, a sulfamoyl group, an oxysulfinyl group, a —S-sulfinyl group, a sulfinamoyl group, a phosphoryl group, a nitro group, an imino group, a N-carbonylimino group, a N-sulfonylimino group, an ammonium group, a sulfonium group, a phosphonium group, a pyrylium group or an immonium group; $R_1$ represents a hydroxyl group or a salt thereof; and $R_2$ represents an alkyl group, an alkenyl group, an alkynyl group, an aryl group or a heterocyclic group, provided that X and W may form a ring structure by bonding to each other, X and $R_1$ may be a cis-form or a trans-form.

10. Another embodiment of the invention includes a photothermographic imaging material of any one of Items 1 to 9, further comprising a polymer containing a recurring monomer (or a repeating monomer) capable of releasing a halogen radical in the molecule.

11. Another embodiment of the invention includes a photothermographic imaging material of any one of Items 1 to 10, wherein the silver halide grains comprises a dopant capable of trapping an electron inside of the grains after heating development.

12. Another embodiment of the invention includes a photothermographic imaging material of any one of Items 1 to 11, wherein the silver halide grains are covered with a spectral sensitizing dye on surfaces of the grains so as to exhibit a spectral sensitivity which substantially disappears after thermal development of the imaging material.

13. Another embodiment of the invention includes a photothermographic imaging material of any one of Items 1 to 12, wherein the silver halide grains are chemically sensitized on surfaces of the grains so as to exhibit a spectral sensitivity which substantially disappear after thermal development of the imaging material.

14. Another embodiment of the invention includes a photothermographic imaging material of any one of Items 1 to 13, wherein the silver halide grains are chemically sensitized and spectrally sensitized on surfaces of the grains so as to exhibit a spectral sensitivity and an effect of chemical sensitization both of which substantially disappear after thermal development of the imaging material.

The present invention enables to provide a photothermographic material which exhibits excellent storage stability, irrespective of high speed as well as low fogging, and further exhibits an excellent hue of silver images after thermal development, with employing a relatively low amount of silver.

DESCRIPTION OH THE PREFERRED EMBODIMENTS

The present invention will now be detailed.

Photosensitive silver halide grains (hereinafter simply referred to as silver halide grains) will be described which are employed in the silver salt photothermographic dry imaging material of the present invention (hereinafter simply referred to as the photosensitive material of the present invention).

The photosensitive silver halide grains, as described in the present invention, refer to silver halide crystalline grains which can originally absorb light as an inherent quality of silver halide crystals, can absorb visible light or infrared radiation through artificial physicochemical methods and are treatment-produced so that physicochemical changes occur in the interior of the silver halide crystal and/or on the crystal surface, when the crystals absorb any radiation from ultraviolet to infrared.

Silver halide grains employed in the present invention can be prepared in the form of silver halide grain emulsions, employing methods described in P. Glafkides, "Chimie et Physique Photographiques" (published by Paul Montel Co., 1967), G. F. Duffin, "Photographic Emulsion Chemistry" (published by The Focal Press, 1955), and V. L. Zelikman et al., "Making and Coating Photographic Emulsion", published by The Focal Press, 1964). Namely, any of an acidic method, a neutral method, or an ammonia method may be employed. Further, employed as methods to allow water-soluble silver salts to react with water-soluble halides may be any of a single-jet precipitation method, a double-jet precipitation method, or combinations thereof. However, of these methods, the so-called controlled double-jet precipitation method is preferably employed in which silver halide grains are prepared while controlling formation conditions.

Halogen compositions are not particularly limited. Any of silver chloride, silver chlorobromide, silver chloroiodobromide, silver bromide, silver iodobromide, or silver iodide may be employed. Of these, silver bromide or silver iodobromide is particularly preferred.

The content ratio of iodine in silver iodobromide is preferably in the range of 0.02 to 16 mol percent per Ag mol. Iodine may be incorporated so that it is distributed into the entire silver halide grain. Alternatively, a core/shell structure may be formed in which, for example, the concentration of iodine in the central portion of the grain is increased, while the concentration near the grain surface is simply decreased or substantially decreased to zero.

Grain formation is commonly divided into two stages, that is, the formation of silver halide seed grains (being nuclei) and the growth of the grains. Either method may be employed in which two stages are continually carried out, or in which the formation of nuclei (seed grains) and the growth of grains are carried out separately. A controlled double-jet precipitation method, in which grains are formed while controlling the pAg and pH which are grain forming conditions, is preferred, since thereby it is possible to control grain shape as well as grain size. For example, when the method, in which nucleus formation and grain growth are separately carried out, is employed, initially, nuclei (being seed grains) are formed by uniformly and quickly mixing water-soluble silver salts with water-soluble halides in an aqueous gelatin solution. Subsequently, under the controlled pAg and pH, silver halide grains are prepared through a grain growing process which grows the grains while supplying water-soluble silver salts as well as water-soluble halides.

In order to minimize milkiness (or white turbidity) as well as coloration (yellowing) after image formation and to obtain excellent image quality, the average grain diameter of the silver halide grains, employed in the present invention, is preferably rather small. The average grain diameter, when grains having a grain diameter of less than 0.02 μm is beyond practical measurement, is preferably 0.035 to 0.055 μm.

Incidentally, grain diameter, as described herein, refers to the edge length of silver halide grains which are so-called regular crystals such as a cube or an octahedron. Further, when silver halide gains are planar, the grain diameter refers to the diameter of the circle which has the same area as the projection area of the main surface.

In the present invention, silver halide grains are preferably in a state of monodispersion. Monodispersion, as described herein, means that the variation coefficient, obtained by the formula described below, is less than or equal to 30 percent. The aforesaid variation coefficient is preferably less than or equal to 20 percent, and is more preferably less than or equal to 15 percent.

Variation coefficient (in percent) of grain diameter=standard deviation of grain diameter/average of grain diameter×100

Cited as shapes of silver halide grains may be cubic, octahedral and tetradecahedral grains, planar grains, spherical grains, rod-shaped grains, and roughly elliptical-shaped grains. Of these, cubic, octahedral, tetradecahedral, and planar silver halide grains are particularly preferred.

When the aforesaid planar silver halide grains are employed, their average aspect ratio is preferably 1.5 to 100, and is more preferably 2 to 50. These are described in U.S. Pat. Nos. 5,264,337, 5,314,798, and 5,320,958, and incidentally it is possible to easily prepare the aforesaid target planar grains. Further, it is possible to preferably employ silver halide grains having rounded corners.

The crystal habit of the external surface of silver halide grains is not particularly limited. However, when spectral sensitizing dyes, which exhibit crystal habit (surface) selectiveness are employed, it is preferable that silver halide grains are employed which have the crystal habit matching their selectiveness in a relatively high ratio. For example, when sensitizing dyes, which are selectively adsorbed onto a crystal plane having a Miller index of (100), it is preferable that the ratio of the (100) surface on the external surface of silver halide grains is high. The ratio is preferably at least 50 percent, is more preferably at least 70 percent, and is most preferably at least 80 percent. Incidentally, it is possible to obtain a ratio of the surface having a Miller index of (100), based on T. Tani, J. Imaging Sci., 29, 165 (1985), utilizing adsorption dependence of sensitizing dye in a (111) plane as well as a (100) surface.

The silver halide grains, employed in the present invention, are preferably prepared employing low molecular weight gelatin, having an average molecular weight of less than or equal to 50,000 during the formation of the grains, which are preferably employed during formation of nuclei. The low molecular weight gelatin refers to gelatin having an average molecular weight of less than or equal to 50,000. The molecular weight is preferably from 2,000 to 40,000, and is more preferably from 5,000 to 25,000. It is possible to measure the molecular weight of gelatin employing gel filtration chromatography.

The concentration of dispersion media during the formation of nuclei is preferably less than or equal to 5 percent by weight. It is more effective to carry out the formation at a low concentration of 0.05 to 3.00 percent by weight.

During formation of the silver halide grains employed in the present invention, it is possible to use polyethylene oxides represented by the general formula described below.

$$YO(CH_2CH_2O)_m(CH(CH_3)CH_2O)_p(CH_2CH_2O)_nY \quad \text{General Formula}$$

wherein Y represents a hydrogen atom, —$SO_3M$, or —CO—B—COOM; M represents a hydrogen atom, an alkali metal atom, an ammonium group, or an ammonium group substituted with an alkyl group having less than or equal to 5 carbon atoms; B represents a chained or cyclic group which forms an organic dibasic acid; m and n each represents 0 through 50; and p represents 1 through 100.

When silver halide photosensitive photographic materials are produced, polyethylene oxides, represented by the above general formula, have been preferably employed as anti-foaming agents to counter marked foaming which occurs while stirring and transporting emulsion raw materials in a process in which an aqueous gelatin solution is prepared, in the process in which water-soluble halides as well as water-soluble silver salts are added to the gelatin solution, and in a process in which the resultant emulsion is applied onto a support. Techniques to employ polyethylene oxides as an anti-foaming agent are disclosed in, for example, JP-A No. 44-9497. The polyethylene oxides represented by the above general formula function as an anti-foaming agent during nuclei formation.

The content ratio of polyethylene oxides, represented by the above general formula, is preferably less than or equal to 1 percent by weight with respect to silver, and is more preferably from 0.01 to 0.10 percent by weight.

It is desired that polyethylene oxides, represented by the above general formula, are present during nuclei formation. It is preferable that they are previously added to the dispersion media prior to nuclei formation. However, they may also be added during nuclei formation, or they may be employed by adding them to an aqueous silver salt solution or an aqueous halide solution which is employed during nuclei formation. However, they are preferably employed by adding them to an aqueous halide solution, or to both aqueous solutions in an amount of 0.01 to 2.00 percent by weight. Further, it is preferable that they are present during at least 50 percent of the time of the nuclei formation process, and it is more preferable that they are present during at least 70 percent of the time of the same. The polyethylene oxides, represented by the above general formula, may be added in the form of powder or they may be dissolved in a solvent such as methanol and then added.

Incidentally, temperature during nuclei formation is commonly from 5 to 60° C., and is preferably from 15 to 50° C. It is preferable that the temperature is controlled within the range, even when a constant temperature, a temperature increasing pattern (for example, a case in which temperature at the initiation of nuclei formation is 25° C., subsequently, temperature is gradually increased during nuclei formation and the temperature at the completion of nuclei formation is 40° C.), or a reverse sequence may be employed.

The concentration of an aqueous silver salt solution and an aqueous halide solution, employed for nuclei formation, is preferably less than or equal to 3.5 M, and is more preferably in the lower range of 0.01 to 2.50 M. The silver ion addition rate during nuclei formation is preferably from $1.5\times10^{-3}$ to $3.0\times10^{-1}$ mol/minute, and is more preferably from $3.0\times10^{-3}$ to $8.0\times10^{-2}$ mol/minute.

The pH during nuclei formation can be set in the range of 1.7 to 10.0. However, since the pH on the alkali side broadens the particle size distribution of the formed nuclei, the preferred pH is from 2 to 6. Further, the pBr during nuclei formation is usually from about 0.05 to about 3.00, is preferably from 1.0 to 2.5, and is more preferably from 1.5 to 2.0.

<Silver Halide Grains of Internal Latent Formation after Thermal Development>

The photosensitive silver halide grains according to the present invention are characterized in that they have a property to change from a surface latent image formation type to an internal latent image formation type after subjected to thermal development. This change is caused by decreasing the speed of the surface latent image formation by the effect of thermal development.

When the silver halide grains are exposed to light prior to thermal development, latent images capable of functioning as a catalyst of development reaction are formed on the surface of the aforesaid silver halide grains. "Thermal development" is a reduction reaction by a reducing agent for silver ions. On the other hand, when exposed to light after the thermal development process, latent images are more formed in the interior of the silver halide grains than the surface thereof. As a result, the silver halide grains result in retardation of latent image formation on the surface.

It was not known in the field of a photothermographic material to employ the above-mentioned silver halide grains which largely change their latent image formation function before and after thermal development.

Generally, when photosensitive silver halide grains are exposed to light, silver halide grains themselves or spectral sensitizing dyes, which are adsorbed on the surface of photosensitive silver halide grains, are subjected to photoexcitation to generate free electrons. Generated electrons are competitively trapped by electron traps (sensitivity centers) on the surface or interior of silver halide grains. Accordingly, when chemical sensitization centers (chemical sensitization specks) and dopants, which are useful as an electron trap, are much more located on the surface of the silver halide grains than the interior thereof and the number is appropriate, latent images are dominantly formed on the surface, whereby the resulting silver halide grains become developable. Contrary to this, when chemical sensitization centers (chemical sensitization specks) and dopants, which are useful as an electron trap, are much more located in the interior of the silver halide grains than the surface thereof and the number is appropriate, latent images are dominantly formed in the interior, whereby it becomes difficult to develop the resulting silver halide grains. In other words, in the former, the surface speed is higher than interior speed, while in the latter, the surface speed is lower than the interior speed. The former type of latent image is called "a surface latent image", and the latter is called "an internal latent image". Examples of the references are:

(1) T. H. James ed., "The Theory of the Photographic Process" $4^{th}$ edition, Macmillan Publishing Co., Ltd. 1977; and (2) Japan Photographic Society, "Shashin Kogaku no Kiso" (Basics of Photographic Engineering), Corona Publishing Co. Ltd., 1998.

The photosensitive silver halide grains of the present invention are preferably provided with dopants which act as electron trapping in the interior of silver halide grains at least in a stage of exposure to light after thermal development. This is required so as to achieve high photographic speed grains as well as high image keeping properties.

It is especially preferred that the dopants act as a hole trap during an exposure step prior to thermal development, and the dopants change after a thermal development step resulting in functioning as an electron trap.

Electron trapping dopants, as described herein, refer to silver, elements except for halogen or compounds constituting silver halide, and the aforesaid dopants themselves which exhibit properties capable of trapping free electron, or the aforesaid dopants are incorporated in the interior of silver halide grains to generate electron trapping portions such as lattice defects. For example, listed are metal ions other than silver ions or salts or complexes thereof, chalcogen (such as elements of oxygen family) sulfur, selenium, or tellurium, inorganic or organic compounds comprising nitrogen atoms, and rare earth element ions or complexes thereof.

Listed as metal ions, or salts or complexes thereof may be lead ions, bismuth ions, and gold ions, or lead bromide, lead carbonate, lead sulfate, bismuth nitrate, bismuth chloride, bismuth trichiloride, bismuth carbonate, sodium bismuthate, chloroauric acid, lead acetate, lead stearate, and bismuth acetate.

Employed as compounds comprising chalcogen such as sulfur, selenium, and tellurium may be various chalcogen releasing compounds which are generally known as chalcogen sensitizers in the photographic industry. Further, preferred as organic compounds comprising chalcogen or nitrogen are heterocyclic compounds which include, for example, imidazole, pyrazole, pyridine, pyrimidine, pyrazine, pyridazine, triazole, triazine, idole, indazole, purine, thiazole, oxadiazole, quinoline, phthalazine, naphthylizine, quinoxaline, quinazoline, cinnoline, pteridine, acrydine, phenanthroline, phenazine, tetrazole, thiazole, oxazole, benzimidazole, benzoxazole, benzthiazole, indolenine, and tetraazaindene. Of these, preferred are imidazole, pyrazine, pyrimidine, pyrazine, pyridazine, triazole, triazine, thiadiazole, oxadiazole, quinoline, phthalazine, naphthylizine, quinoxaline, quinazoline, cinnoline, tetrazole, thiazole, oxazole, benzimidazole, benzoxazole, benzthiazole, and tetraazaindene.

Incidentally, the aforesaid heterocyclic compounds may have substituent(s). Preferable substituents include an alkyl group, an alkenyl group, an aryl group, an alkoxy group, an aryloxy group, an acyloxy group, an acyl group, an alkoxycarbonyl group, an aryloxycarbonyl group, an acyloxy group, an acylamino group, an alkoxycarbonylamino group, an aryloxycarbonylamino group, a sulfonylamino group, a sulfamoyl group, a carbamoyl group, a sulfonyl group, a ureido group, a phosphoric acid amide group, a halogen atom, a cyano group, a sulfo group, a carboxyl group, a nitro group, a heterocyclic group. Of these, more preferred are an alkyl group, an aryl group, an alkoxy group, an aryloxy group, an acyl group, an acylamino group, an alkoxycarbonylamino group, an aryloxycarbonylamino group, a sulfonylamino group, a sulfamoyl group, a carbamoyl group, a ureido group, a phosphoric acid amido group, a halogen atom, a cyano group, a nitro group, and a heterocyclic group. More preferred are an alkyl group, an aryl group, an alkoxy group, an aryloxy group, an acyl group, an acylamino group, a sulfonylamino group, a sulfamoyl group, a carbamoyl group, a halogen atom, a cyano group, a nitro group, and a heterocyclic group.

Incidentally, ions of transition metals which belong to Groups 6 through 11 in the Periodic Table may be chemically modified to form a complex employing ligands of the oxidation state of the ions and incorporated in silver halide grains employed in the present invention so as to function as an electron trapping dopant, as described above, or as a hole trapping dopant. Preferred as aforesaid transition metals are W, Fe, Co, Ni, Cu, Ru, Rh, Pd, Re, Os, Ir, and Pt.

In the present invention, aforesaid various types of dopants may be employed individually or in combination of at least two of the same or different types. It is required that at least one of the dopants act as an electron trapping dopant during an exposure time after being thermal developed. They may be incorporated in the interior of the silver halide grains in any forms of chemical states.

It is not recommended to use a complex or a salt of Ir or Cu as a single dopant without combining with other dopant.

The content ratio of dopants is preferably in the range of $1\times10^{-9}$ to $1\times10$ mol per mol of silver, and is more preferably $1\times10^{-6}$ to $1\times10^{-2}$ mol.

However, the optimal amount varies depending the types of dopants, the diameter and shape of silver halide grains, and ambient conditions. Accordingly, it is preferable that addition conditions are optimized taking into account these conditions.

In the present invention, preferred as transition metal complexes or complex ions are those represented by the general formula described below.

$$[ML_6]^m \qquad \text{General Formula}$$

wherein M represents a transition metal selected from the elements of Groups 6 through 11 in the Periodic Table; L represents a ligand; and m represents 0, -, 2-, 3-, or 4-. Listed as specific examples of ligands represented by L are a halogen ion (a fluoride ion, a chloride ion, a bromide ion, or an iodide ion), a cyanide, a cyanate, a thiocyanate, a selenocyanate, a tellurocyanate, an azide, and an aqua ligand, and nitrosyl and thionitrosyl. Of these, aqua, nitrosyl, and thionitrosyl are preferred. When the aqua ligand is present, one or two ligands are preferably occupied by the aqua ligand. L may be the same or different.

It is preferable that compounds, which provide ions of these metals or complex ions, are added during formation of silver halide grains so as to be incorporated in the silver halide grains. The compounds may be added at any stage of, prior to or after, silver halide grain preparation, namely nuclei formation, grain growth, physical ripening or chemical ripening. However, they are preferably added at the stage of nuclei formation, grain growth, physical ripening, are more preferably added at the stage of nuclei formation and growth, and are most preferably added at the stage of nuclei formation. They may be added over several times upon dividing them into several portions. Further, they may be uniformly incorporated in the interior of silver halide grains. Still further, as described in JP-A Nos. 63-29603, 2-306236, 3-167545, 4-76534, 6-110146, and 5-273683, they may be incorporated so as to result in a desired distribution in the interior of the grains.

These metal compounds may be dissolved in water or suitable organic solvents (for example, alcohols, ethers, glycols, ketones, esters, and amides) and then added. Further, addition methods include, for example, a method in which either an aqueous solution of metal compound powder or an aqueous solution prepared by dissolving metal compounds together with NaCl and KCl is added to a water-soluble halide solution, a method in which silver halide grains are formed by a silver salt solution, and a halide solution together with a the compound solution as a third aqueous solution employing a triple-jet precipitation method, a method in which, during grain formation, an aqueous metal compound solution in a necessary amount is charged into a reaction vessel, or a method in which, during preparation of silver halide, other silver halide grains which have been doped with metal ions or complex ions are added and dissolved. Specifically, a method is preferred in which either an aqueous solution of metal compound powder or an aqueous solution prepared by dissolving metal compounds together with NaCl and KCl is added to a water-soluble halide solution. When added onto the grain surface, an aqueous metal compound solution in a necessary amount may be added to a reaction vessel immediately after grain formation, during or after physical ripening, or during chemical ripening.

Incidentally, it is possible to introduce non-metallic dopants into the interior of silver halide employing the same method as the metallic dopants.

In the imaging materials in accordance with the present invention, it is possible to evaluate whether the aforesaid dopants exhibit electron trapping properties or not, while employing a method which has commonly employed in the photographic industry. Namely a silver halide emulsion comprised of silver halide grains, which have been doped with the aforesaid dopant or decomposition product thereof so as to be introduced into the interior of grains, is subjected to photoconduction measurement, employing a microwave photoconduction measurement method. Subsequently, it is possible to evaluate the aforesaid electron trapping properties by comparing the resulting decrease in photoconduction to that of the silver halide emulsion comprising no dopant as a standard. It is also possible to evaluate the same by performing experiments in which the internal speed of the aforesaid silver halide grains is compared to the surface speed.

Further, a method follows which is applied to a finished photothermographic dry imaging material to evaluate the electron trapping dopant effect in accordance with the present invention. For example, prior to exposure, the aforesaid imaging material is heated under the same conditions as the commonly employed thermal development conditions. Subsequently, the resulting material is exposed to white light or infrared radiation through an optical wedge for a definite time (for example, 30 seconds), and thermally developed under the same thermal development conations as above, whereby a characteristic curve (or a densitometry curve) is obtained. Then, it is possible to evaluate the aforesaid electron trapping dopant effect by comparing the speed obtained based on the characteristic curve to that of the imaging material which is comprised of the silver halide emulsion which does not comprise the aforesaid electron trapping dopant. Namely, it is necessary to confirm that the speed of the former sample comprised of the silver halide grain emulsion comprising the dopant in accordance with the present invention is lower than the latter sample which does not comprise the aforesaid dopant.

Speed of the aforesaid material is obtained based on the characteristic curve which is obtained by exposing the aforesaid material to white light or infrared radiation through an optical wedge for a definite time (for example 30 seconds) followed by developing the resulting material under common thermal development conditions. Further, speed of the aforesaid material is obtained based on the characteristic curve which is obtained by heating the aforesaid material under common thermal development conditions prior to exposure and giving the same definite exposure as above to the resulting material for the same definite time as above followed by thermally developing the resulting material under common thermal development conditions. The ratio of the latter speed to the former speed is preferably at most 1/10, and is more preferably at most 1/20. When the silver halide emulsion is chemically sensitized, the preferred photographic speed ratio is as low as not more than 1/50.

The silver halide grains of the present invention may be incorporated in a photosensitive layer employing an optional method. In such a case, it is preferable that the aforesaid silver halide grains are arranged so as to be adjacent to reducible silver sources (being aliphatic carboxylic silver salts) in order to get an imaging material having a high covering power.

The silver halide of the present invention is previously prepared and the resulting silver halide is added to a solution which is employed to prepare aliphatic carboxylic acid silver salt particles. By so doing, since a silver halide preparation process and an aliphatic carboxylic acid silver salt particle preparation process are performed independently, production is preferably controlled. Further, as described in British Patent No. 1,447,454, when aliphatic carboxylic acid silver salt particles are formed, it is possible to almost simultaneously form aliphatic carboxylic acid silver salt particles by charging silver ions to a mixture consisting of halide components such as halide ions and aliphatic carboxylic acid silver salt particle forming components. Still further, it is possible to prepare silver halide grains utilizing conversion of aliphatic carboxylic acid silver salts by allowing halogen-containing components to act on aliphatic carboxylic acid silver salts. Namely, it is possible to convert some of aliphatic carboxylic acid silver salts to photosensitive silver halide by allowing silver halide forming components to act on the previously prepared aliphatic carboxylic acid silver salt solution or dispersion, or sheet materials comprising aliphatic carboxylic acid silver salts.

Silver halide grain forming components include inorganic halogen compounds, onium halides, halogenated hydrocarbons, N-halogen compounds, and other halogen containing compounds.

Specific examples are disclosed in; U.S. Pat. Nos. 4,009,039, 3,487,075, 4,003,749; G.B. Pat. No. 1,498,956; and JP-A Nos. 53-27027, 53-25420.

Further, silver halide grains may be employed in combination which are produced by converting some part of separately prepared aliphatic carboxylic acid silver salts.

The aforesaid silver halide grains, which include separately prepared silver halide grains and silver halide grains prepared by partial conversion of aliphatic carboxylic acid silver salts, are employed commonly in an amount of 0.001 to 0.7 mol per mol of aliphatic carboxylic acid silver salts and preferably in an amount of 0.03 to 0.5 mol.

The separately prepared photosensitive silver halide particles are subjected to desalting employing desalting methods known in the photographic art, such as a noodle method, a flocculation method, an ultrafiltration method, and an electrophoresis method, while they may be employed without desalting.

<Light-insensitive Aliphatic Carboxylic Acid Silver Salt>

The light-insensitive aliphatic carboxylic acid silver salts according to the present invention are reducible silver sources which are preferably silver salts of long chain aliphatic carboxylic acids, having from 10 to 30 carbon atoms and preferably from 15 to 25 carbon atoms. Listed as examples of appropriate silver salts are those described below.

For example, listed are silver salts of gallic acid, oxalic acid, behenic acid, stearic acid, arachidic acid, palmitic acid, and lauric acid. Of these, listed as preferable silver salts are silver behenate, silver arachidate, and silver stearate.

Further, in the present invention, it is preferable that at least two types of aliphatic carboxylic acid silver salts are mixed since the resulting developability is enhanced and high contrast silver images are formed. Preparation is preferably carried out, for example, by mixing a mixture consisting of at least two types of aliphatic carboxylic acid with a silver ion solution.

On the other hand, from the viewpoint of enhancing retaining properties of images, the melting point of aliphatic carboxylic acids, which are employed as a raw material of aliphatic carboxylic acid silver, is commonly at least 50° C., and is preferably at least 60° C. The content ratio of aliphatic carboxylic acid silver salts is commonly at least 60 percent, is preferably at least 70 percent, and still more preferably at least 80 percent. From this viewpoint, specifically, it is preferable that the content ratio of silver behenate is higher.

Aliphatic carboxylic acid silver salts are prepared by mixing water-soluble silver compounds with compounds which form complexes with silver. When mixed, a normal precipitation method, a reverse precipitating method, a double-jet precipitation method, or a controlled double-jet precipitation method, described in JP-A No. 9-127643, are preferably employed. For example, after preparing a metal salt soap (for example, sodium behenate and sodium arachidate) by adding alkali metal salts (for example, sodium hydroxide and potassium hydroxide) to organic acids, crystals of aliphatic carboxylic acid silver salts are prepared by mixing the soap with silver nitrate. In such a case, silver halide grains may be mixed together with them.

The kinds of alkaline metal salts employed in the present invention include sodium hydroxide, potassium hydroxide, and lithium hydroxide, and it is preferable to simultaneously use sodium hydroxide and potassium hydroxide. When simultaneously employed, the mol ratio of sodium hydroxide to potassium hydroxide is preferably in the range of 10:90-75:25. When the alkali metal salt of aliphatic carboxylic acid is formed via a reaction with an aliphatic carboxylic acid, it is possible to control the viscosity of the resulting liquid reaction composition within the desired range.

Further, in the case in which aliphatic carboxylic acid silver is prepared in the presence of silver halide grains at an average grain diameter of at most 0.050 μm, it is preferable that the ratio of potassium among alkaline metals in alkaline metal salts is higher than the others, since dissolution of silver halide grains as well as Ostwald ripening is retarded. Further, as the ratio of potassium salts increases, it is possible to decrease the size of fatty acid silver salt particles.

The ratio of potassium salts is preferably 50-100 percent with respect to the total alkaline metal salts, while the concentration of alkaline metal salts is preferably 0.1-0.3 mol/1,000 ml.

(Silver Salt Particles at a High Silver Ratio)

An emulsion containing aliphatic carboxylic acid silver salt particles according to the present invention is a mixture consisting of free aliphatic carboxylic acids which do not form silver salts, and aliphatic carboxylic acid silver salts. In view of storage stability of images, it is preferable that the ratio of the former is lower than the latter. Namely, the aforesaid emulsion according to the present intention preferably contains aliphatic carboxylic acids in an amount of 3-10 mol percent with respect to the aforesaid aliphatic carboxylic acid silver salt particles, and most preferably 4-8 mol percent.

Incidentally, in practice, each of the amount of total aliphatic carboxylic acids and the amount of free aliphatic carboxylic acids is determined employing the methods described below. Whereby, the amount of aliphatic carboxylic acid silver salts and free aliphatic carboxylic acids, and each ratio, or the ratio of free carboxylic acids to total aliphatic carboxylic acids, are calculated.

(Quantitative Analysis of the Amount of Total Aliphatic Carboxylic Acids (the Total Amount of these Being Due to Both of the Aforesaid Aliphatic Carboxylic Acid Silver Salts and Free Acids))

(1) A sample in an amount (the weight when peeled from a photosensitive material) of approximately 10 mg is accurately weighed and placed in a 200 ml ovid flask.
(2) Subsequently, 15 ml of methanol and 3 ml of 4 mol/L hydrochloric acid are added and the resulting mixture is subjected to ultrasonic dispersion for one minute.
(3) Boiling stones made of Teflon (registered trade name) are placed and refluxing is performed for 60 minutes.
(4) After cooling, 5 ml of methanol is added from the upper part of the cooling pipe and those adhered to the cooling pipe are washed into the ovoid flask (this is repeated twice).
(5) The resulting liquid reaction composition is subjected to extraction employing ethyl acetate (separation extraction is performed twice by adding 100 ml of ethyl acetate and 70 ml of water).
(6) Vacuum drying is then performed at normal temperature for 30 minutes.
(7) Placed in a 10 ml measuring flask is 1 ml of a benzanthorone solution as an internal standard (approximately 100 mg of benzanthrone is dissolved in toluene and the total volume is made to 100 ml by the addition of toluene).
(8) The sample is dissolved in toluene and placed in the measuring flask described in (7) and the total volume is adjusted by the addition of toluene.
(9) Gas chromatography (GC) measurements are performed under the measurement conditions below.

Apparatus: HP-5890+HP-Chemistation
Column: HP-1 30 m×0.32 mm×0.25 μm
(manufactured by Hewlett-Packard)
Injection inlet: 250° C.
Detector: 280° C.
Oven: maintained at 250° C.
Carrier gas: He
Head pressure: 80 kPa (Quantitative Analysis of Free Aliphatic Carboxylic Acids)

(1) A sample in an amount of approximately 20 mg is accurately weighed and placed in a 200 ml ovoid flask. Subsequently, 100 ml of methanol was added and the resulting mixture is subjected to ultrasonic dispersion (free organic carboxylic acids are extracted).
(2) The resulting dispersion is filtered. The filtrate is placed in a 200 ml ovoid flask and then dried up (free organic carboxylic acids are separated).
(3) Subsequently, 15 ml of methanol and 3 ml of 4 mol/L hydrochloric acid are added and the resulting mixture is subjected to ultrasonic dispersion for one minute.
(4) Boiling stones made of Teflon (registered trade mark) were added, and refluxing is performed for 60 minutes.
(5) Added to the resulting liquid reaction composition are 60 ml of water and 60 ml of ethyl acetate, and a methyl-esterificated product of organic carboxylic acids is then extracted to an ethyl acetate phase. Ethyl acetate extraction is performed twice.
(6) The ethyl acetate phase is dried, followed by vacuum drying for 30 minutes.
(7) Placed in a 10 ml measuring flask is 1 ml of a benzanthorone solution (being an internal standard and prepared in such a manner that approximately 100 mg of benzanthrone is dissolved in toluene and the total volume is made to 100 ml by the addition of toluene).
(8) The product obtained in (6) is dissolved in toluene and placed in the measuring flask described in (7) and the total volume is adjusted by the addition of more toluene.
(9) Carried out GC measurement using the conditions described below.

Apparatus: HP-5890+HP-Chemistation
Column: HP-1 30 m×0.32 mm×0.25 μm
(manufactured by Hewlett-Packard)
Injection inlet: 250° C.
Detector: 280° C.
Oven: maintained at 250° C.
Carrier gas: He
Head pressure: 80 kPa <Morphology of Aliphatic Carboxylic Acid Silver Salts>

Aliphatic carboxylic acid silver salts according to the present invention may be crystalline grains which have the core/shell structure disclosed in European Patent No. 1168069A1 and Japanese Patent Application Open to Public Inspection No. 2002-023303. Incidentally, when the core/shell structure is formed, organic silver salts, except for aliphatic carboxylic acid silver, such as silver salts of phthalic acid and benzimidazole may be employed wholly or partly in the core portion or the shell portion as a constitution component of the aforesaid crystalline grains.

In the aliphatic carboxylic acid silver salts according to the present invention, it is preferable that the average circle equivalent diameter is from 0.05 to 0.80 μm, and the average thickness is from 0.005 to 0.070 μm. It is still more preferable that the average circle equivalent diameter is from 0.2 to 0.5 mm, and it is more preferable that the average circle equivalent diameter is from 0.2 to 0.5 μm and the average thickness is from 0.01 to 0.05 μm.

When the average circle equivalent diameter is less than or equal to 0.05 μm, excellent transparency is obtained, while image retention properties are degraded. On the other hand, when the average grain diameter is less than or equal to 0.8 μm, transparency is markedly degraded. When the average thickness is less than or equal to 0.005 μm, during development, silver ions are abruptly supplied due to the large surface area and are present in a large amount in the layer, since specifically in the low density section, the silver ions are not used to form silver images. As a result, the image retention properties are markedly degraded. On the other hand, when the average thickness is more than or equal to 0.07 μm, the surface area decreases, whereby image stability is enhanced. However, during development, the silver supply rate decreases and in the high density section, silver formed by development results in non-uniform shape, whereby the maximum density tends to decrease.

The average circle equivalent diameter can be determined as follows. Aliphatic carboxylic acid silver salts, which have been subjected to dispersion, are diluted, are dispersed onto a grid covered with a carbon supporting layer, and imaged at a direct magnification of 5,000, employing a transmission type electron microscope (Type 2000FX, manufactured by JEOL, Ltd.). The resultant negative image is converted to a digital image employing a scanner. Subsequently, by employing appropriate software, the grain diameter (being a circle equivalent diameter) of at least 300 grains is determined and an average grain diameter is calculated.

It is possible to determine the average thickness, employing a method utilizing a transmission electron microscope (hereinafter referred to as a TEM) as described below.

First, a photosensitive layer, which has been applied onto a support, is adhered onto a suitable holder, employing an adhesive, and subsequently, cut in the perpendicular direction with respect to the support plane, employing a diamond knife, whereby ultra-thin slices having a thickness of 0.1 to 0.2 μm are prepared. The ultra-thin slice is supported by a copper mesh and transferred onto a hydrophilic carbon layer, employing a glow discharge. Subsequently, while cooling the resultant slice at less than or equal to −130° C. employing liquid nitrogen, a bright field image is observed at a magnification of 5,000 to 40,000, employing TEM, and images are quickly recorded employing either film, imaging plates, or a CCD camera. During the operation, it is preferable that the portion of the slice in the visual field is suitably selected so that neither tears nor distortions are imaged.

The carbon layer, which is supported by an organic layer such as extremely thin collodion or Formvar, is preferably employed. The more preferred carbon layer is prepared as follows. The carbon layer is formed on a rock salt substrate which is removed through dissolution. Alternately, the organic layer is removed employing organic solvents and ion etching whereby the carbon layer itself is obtained. The acceleration voltage applied to the TEM is preferably from 80 to 400 kV, and is more preferably from 80 to 200 kV.

Other items such as electron microscopic observation techniques, as well as sample preparation techniques, may be obtained while referring to either "Igaku-Seibutsugaku Denshikenbikyo Kansatsu Gihoh (Medical-Biological Electron Microscopic Observation Techniques", edited by Nippon Denshikembikyo Gakkai Kanto Shibu (Maruzen) or "Denshikembikyo Seibutsu Shiryo Sakuseihoh (Preparation Methods of Electron Microscopic Biological Samples", edited by Nippon Denshikenbikyo Gakkai Kanto Shibu (Maruzen).

It is preferable that a TEM image, recorded in a suitable medium, is decomposed into preferably at least 1,024×1,024 pixels and subsequently subjected to image processing, utilizing a computer. In order to carry out the image processing, it is preferable that an analogue image, recorded on a film strip, is converted into a digital image, employing any appropriate means such as scanner, and if desired, the resulting digital image is subjected to shading correction as well as contrast-edge enhancement. Thereafter, a histogram is prepared, and portions, which correspond to aliphatic carboxylic acid silver salts, are extracted through a binarization processing.

At least 300 of the thickness of aliphatic carboxylic acid silver salt particles, extracted as above, are manually determined employing appropriate software, and an average value is then obtained.

Methods to prepare aliphatic carboxylic acid silver salt particles, having the shape as above, are not particularly limited. It is preferable to maintain a mixing state during formation of an organic acid alkali metal salt soap and/or a mixing state during addition of silver nitrate to the soap as desired, and to optimize the proportion of organic acid to the soap, and of silver nitrate which reacts with the soap.

It is preferable that, if desired, the planar aliphatic carboxylic acid silver salt particles (referring to aliphatic carboxylic acid silver salt particles, having an average circle equivalent diameter of 0.05 to 0.80 μm as well as an average thickness of 0.005 to 0.070 μm) are preliminarily dispersed together with binders as well as surface active agents, and thereafter, the resultant mixture is dispersed employing a media homogenizer or a high pressure homogenizer. The preliminary dispersion may be carried out employing a common anchor type or propeller type stirrer, a high speed rotation centrifugal radial type stirrer (being a dissolver), and a high speed rotation shearing type stirrer (being a homomixer).

Further, employed as the aforesaid media homogenizers may be rotation mills such as a ball mill, a planet ball mill, and a vibration ball mill, media stirring mills such as a bead mill and an attritor, and still others such as a basket mill. Employed as high pressure homogenizers may be various types such as a type in which collision against walls and plugs occurs, a type in which a liquid is divided into a plurality of portions which are collided with each other at high speed, and a type in which a liquid is passed through narrow orifices.

Preferably employed as ceramics, which are used in ceramic beads employed during media dispersion are, for example, yttrium-stabilized zirconia, and zirconia-reinforced alumina (hereafter ceramics containing zirconia are abbreviated to as zirconia). The reason of the preference is that impurity formation due to friction with beads as well as the homogenizer during dispersion is minimized.

In apparatuses which are employed to disperse the planar aliphatic carboxylic acid silver salt particles of the present invention, preferably employed as materials of the members which come into contact with the aliphatic carboxylic acid silver salt particles are ceramics such as zirconia, alumina, silicon nitride, and boron nitride, or diamond. Of these, zirconia is preferably employed. During the dispersion, the concentration of added binders is preferably from 0.1 to 10.0 percent by weight with respect to the weight of aliphatic carboxylic acid silver salts. Further, temperature of the dispersion during the preliminary and main dispersion is preferably maintained at less than or equal to 45° C. The examples of the preferable operation conditions for the main dispersion are as follows. When a high pressure homogenizer is employed as a dispersion means, preferable operation conditions are from 29 to 100 MPa, and at least double operation frequency. Further, when the media homogenizer is employed as a dispersion means, the peripheral rate of 6 to 13 m/second is cited as the preferable condition.

In the present invention, light-insensitive aliphatic carboxylic acid silver salt particles are preferably formed in the presence of compounds which function as a crystal growth retarding agent or a dispersing agent. Further, the compounds which function as a crystal growth retarding agent or a dispersing agent are preferably organic compounds having a hydroxyl group or a carboxyl group.

In the present invention, compounds, which are described herein as crystal growth retarding agents or dispersing agents for aliphatic carboxylic acid silver salt particles, refer to compounds which, in the production process of aliphatic carboxylic acid silver salts, exhibit more functions and greater effects to decrease the grain diameter, and to enhance monodispersibility when the aliphatic carboxylic acid silver salts are prepared in the presence of the compounds, compared to the case in which the compounds are not employed. Listed as examples are monohydric alcohols having 10 or fewer carbon atoms, such as preferably secondary alcohol and tertiary alcohol; glycols such as ethylene glycol and propylene glycol; polyethers such as polyethylene glycol; and glycerin. The preferable addition amount is from 10 to 200 percent by weight with respect to aliphatic carboxylic acid silver salts.

On the other hands, preferred are branched aliphatic carboxylic acids, each containing an isomer, such as isoheptanic acid, isodecanoic acid, isotridecanoic acid, isomyristic acid, isopalmitic acid, isostearic acid, isoarachidinic acid, isobehenic acid, or isohexaconic acid. Listed as preferable side chains are an alkyl group or an alkenyl group having 4 or fewer carbon atoms. Further, listed are aliphatic unsaturated carboxylic acids such as palmitoleic acid, oleic acid, linoleic acid, linolenic acid, moroctic acid, eicosenoic acid, arachidonic acid, eicosapentaenoic acid, erucic acid, docosapentaenoic acid, and selacholeic acid. The preferable addition amount is from 0.5 to 10.0 mol percent of aliphatic carboxylic acid silver salts.

Preferable compounds include glycosides such as glucoside, galactoside, and fructoside; trehalose type disaccharides such as trehalose and sucrose; polysaccharides such as glycogen, dextrin, dextran, and alginic acid; cellosolves such as methyl cellosolve and ethyl cellosolve; water-soluble organic solvents such as sorbitan, sorbitol, ethyl acetate, methyl acetate, and dimethylformamide; and water-soluble polymers such as polyvinyl alcohol, polyacrylic acid, acrylic acid copolymers, maleic acid copolymers, carboxymethyl cellulose, hydroxypropyl cellulose, hydroxypropyl methyl cellulose, polyvinylpyrrolidone, and gelatin. The preferable addition amount is from 0.1 to 20.0 percent by weight with respect to aliphatic carboxylic acid silver salts.

Alcohols having 10 or fewer carbon atoms, being preferably secondary alcohols and tertiary alcohols, increase the solubility of sodium aliphatic carboxylates in the emulsion preparation process, whereby the viscosity is lowered so as to enhance the stirring efficiency and to enhance monodispersibility as well as to decrease particle size. Branched aliphatic carboxylic acids, as well as aliphatic unsaturated carboxylic acids, result in higher steric hindrance than straight chain aliphatic carboxylic acid silver salts as a main component during crystallization of aliphatic carboxylic acid silver salts to increase the distortion of crystal lattices whereby the particle size decreases due to non-formation of over-sized crystals.

<Antifoggant and Image Stabilizer>

As mentioned above, being compared to conventional silver halide photosensitive photographic materials, the greatest different point in terms of the structure of silver salt photothermographic dry imaging materials is that in the latter materials, a large amount of photosensitive silver halide, organic silver salts and reducing agents is contained which are capable of becoming causes of generation of fogging and printout silver, irrespective of prior and after photographic processing. Due to that, in order to maintain storage stability before development and even after development, it is imprtant to apply highly effective fog minimizing and image stabilizing techniques to silver salt photothermographic dry imaging materials. Other than aromatic heterocyclic compounds which retard the growth and development of fog specks, heretofore, mercury compounds, such as mercury acetate, which exhibit functions to oxidize and eliminate fog specks, have been employed as a markedly effective storage stabilizing agents. However, the use of such mercury compounds may cause problems regarding safety as well as environmental protection.

The important points for achieving technologies for antifogging and image stabilizing are:

to prevent formation of metallic silver or silver atoms caused by reduction of silver ion during preserving the material prior to or after development; and to prevent the formed silver from effecting as a catalyst for oxidation (to oxidize silver into silver ions) or reduction (to reduce silver ions to silver).

Antifoggants as well as image stabilizing agents which are employed in the silver salt photothermographic dry imaging material of the present invention will now be described.

In the silver salt photothermographic dry imaging material of the present invention, one of the features is that bisphenols are mainly employed as a reducing agent, as described below. It is preferable that compounds are incorporated which are capable of deactivating reducing agents upon generating active species capable of extracting hydrogen atoms from the aforesaid reducing agents.

Preferred compounds are those which are capable of: preventing the reducing agent from forming a phenoxy radial; or trapping the formed phenoxy radial so as to stabilize the phenoxy radial in a deactivated form to be effective as a reducing agent for silver ions.

Preferred compounds having the above-mentioned properties are non-reducible compounds having a functional group capable of forming a hydrogen bonding with a hydroxyl group in a bis-phenol compound. Examples are compounds having in the molecule such as, a phosphoryl group, a sulfoxide group, a sulfonyl group, a carbonyl group, an amido group, an ester group, a urethane group, a ureido group, a tertiary amino group, or a nitrogen containing aromatic group.

More preferred are compounds having a sulfonyl group, a sulfoxide group or a phosphoryl group in the molecule.

Specific examples are disclosed in, JP-A Nos. 6-208192, 20001-215648, 3-50235, 2002-6444, 2002-18264. Another examples having a vinyl group are disclosed in, Japanese translated PCT Publication No. 2000-515995, JP-A Nos. 2002-207273, and 2003-140298.

Further, it is possible to simultaneously use compounds capable of oxidizing silver (metallic silver) such as compounds which release a halogen radical having oxidizing capability, or compounds which interact with silver to form a charge transfer complex. Specific examples of compounds which exhibit the aforesaid function are disclosed in JP-A Nos. 50-120328, 59-57234, 4-232939, 6-208193, and 10-197989, as well as U.S. Pat. No. 5,460,938, and JP-A No. 7-2781. Specifically, in the imaging materials according to the present invention, specific examples of preferred compounds include halogen radical releasing compounds which are represented by General Formula (OFI) below.

$$Q_2\text{-Y—C}(X_1)(X_3)(X_2) \qquad \text{General Formula (OFI)}$$

In General Formula (OFI), $Q_2$ represents an aryl group or a heterocyclic group; $X_1$, $X_2$, and $X_3$ each represent a hydrogen atom, a halogen atom, an acyl group, an alkoxycarbonyl group, an aryloxycarbonyl group, a sulfonyl group, or an aryl group, at least one of which is a halogen atom; and Y represents —C(═O)—, —SO— or —$SO_2$—.

The aryl group represented by $Q_2$ may be in the form of a single ring or a condensed ring, and is preferably a single ring or double ring aryl group having 6-30 carbon atoms (for example, phenyl and naphthyl) and is more preferably a phenyl group and a naphthyl group, and is still more preferably a phenyl group.

The heterocyclic group represented by $Q_2$ is a 3- to 10-membered saturated or unsaturated heterocyclic group containing at least one of N, O, or S, which may be a single ring or may form a condensed ring with another ring.

The heterocyclic group is preferably a 5- to 6-membered unsaturated heterocyclic group which may have a condensed ring, is more preferably a 5- to 6-membered aromatic heterocyclic group which may have a condensed ring, and is most preferably a 5- to 6-membered aromatic heterocyclic group which may have a condensed ring containing 1 to 4 nitrogen atoms. Heterocycles in such heterocyclic groups are preferably imidazole, pyrazole, pyridine, pyrazine, pyridazine, triazole, triazine, indole, indazole, purine, thiadiazole, oxadiazole, quinoline, phthalazine, naphthyridine, quinoxaline, quinazoline, cinnoline, pteridine, acridine, phenanthroline, phenazine, tetrazole, thiazole, oxazole, benzimidazole, benzoxazole, benzthiazole, indolenine, and tetraazaindene; are more preferably imidazole, pyridine, pyrimidine, pyrazine, pyridazine, triazole, triazine, thiadiazole, oxadiazole, quinoline, phthalazine, naphthyridine, quinoxaline, quinazoline, cinnoline, tetrazole, thiazole, oxazole, benzimidazole, benzoxazole, benzthiazole, and tetraazaindene; are still more preferably imidazole, pyridine, pyrimidine, pyrazine, pyridazine, triazole, triazine, thiadiazole, quinoline, phthalazine, naphthyridine, quinoxaline, quinazoline, cinnoline, tetrazole, triazole, benzimidazole, and benzthiazole; and are most preferably pyridine, thiadiazole, quinoline, and benzthiazole.

The aryl group and heterocyclic group represented by $Q_2$ may have a substituent other than —YU—$C(X_1)(X_2)(X_3)$. Substituents are preferably an alkyl group, an alkenyl group, an aryl group, an alkoxy group, an aryloxy group, an acyloxy group, an acyl group, an alkoxycarbonyl group, an aryloxycarbonyl group, an acyloxy group, an acylamino group, an alkoxycarbonylamino group, an aryloxycarbonylamino group, a sulfonylimino group, a sulfamoyl group, a carbamoyl group, a sulfonyl group, a ureido group, a phosphoric acid amide group, a halogen atom, a cyano group, a sulfo group, a carboxyl group, a nitro group, and a heterocyclic group; are more preferably an alkyl group, an aryl group, an alkoxy group, an aryloxy group, an acyl group, an acylamino group, an alkoxycarbonylamino group, an aryloxycarbonylamino group, a sulfonylamino group, a sulfamoyl group, a carbamoyl group, a ureido group, a phosphoric acid amide group, a halogen atom, a cyano group, a nitro group, and a heterocyclic group; are more preferably an alkyl group, an aryl group, an alkoxy group, an aryloxy group, an acyl group, an acylamino group, a sulfonylimino group, a sulfamoyl group, a carbamoyl group, a halogen atom, a cyano group, a nitro group, and a heterocyclic group; and are most preferably an alkyl group, an aryl group, are a halogen atom.

Each of $X_1$, $X_2$, and $X_3$ is preferably a halogen atom, a haloalkyl group, an acyl group, an alkoxycarbonyl group, an aryloxycarbonyl group, a carbamoyl group, a sulfamoyl group, a sulfonyl group, or a heterocyclic group; is more preferably a halogen atom, a haloalkyl group, an acyl group, an alkoxycarbonyl group, an aryloxycarbonyl group, or a sulfonyl group; is still more preferably a halogen atom or a trihalomethyl group; and is most preferably a halogen atom. Of halogen atoms preferred are a chlorine atom, a bromine atom and an iodine atom. Of these, a chlorine atom and a bromine atom are more preferred and a bromine atom is particularly preferred.

Y represents —C(═O)— or —$SO_2$—, and is preferably —$SO_2$—.

The added amount of these compounds is commonly $1\times10^{-4}$–1 mol per mol of silver, and is preferably $1\times10^{-3}$–$5\times10^{-2}$ mol.

Incidentally, in the imaging materials according to the present invention, it is possible to use those disclosed in JP-A No. 2003-5041 in the manner as the compounds represented by aforesaid General Formula (OFI).

Specific examples of the compounds represented by General Formula (OFI) are listed below, however, the present invention is not limited thereto.

OFI-1

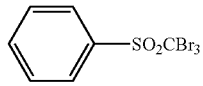

OFI-2

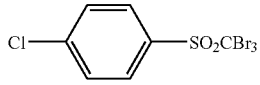

OFI-3

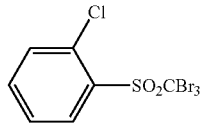

OFI-4

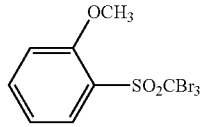

OFI-5

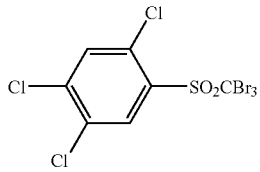

OFI-6

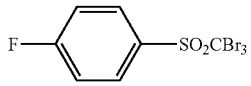

OFI-7

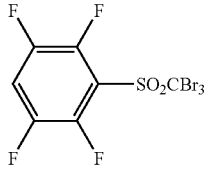

OFI-8

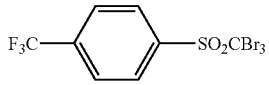

OFI-9

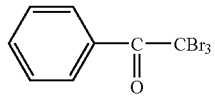

-continued
OFI-10
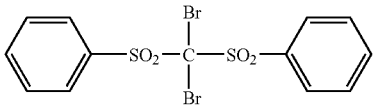
OFI-11
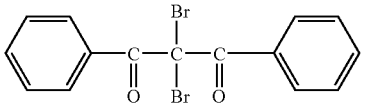
OFI-12
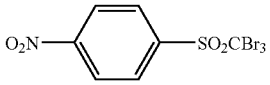
OFI-13
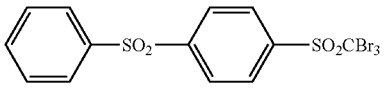
OFI-14
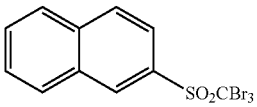
OFI-15
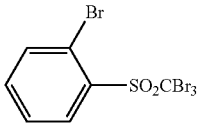
OFI-16
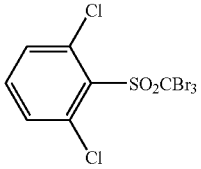
OFI-17
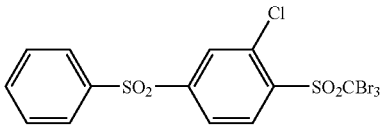
OFI-18
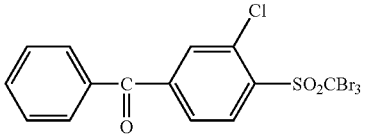
OFI-19
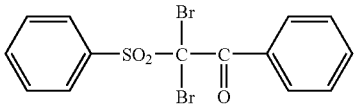
OFI-20
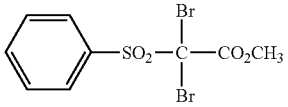
OFI-21
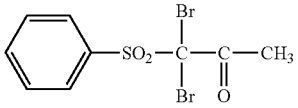
-continued
OFI-22
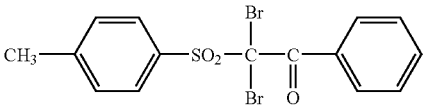
OFI-23
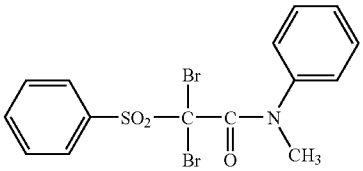
OFI-24
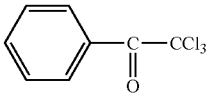
OFI-25
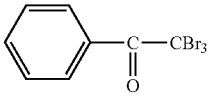
OFI-26
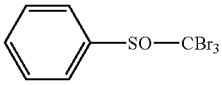
OFI-27
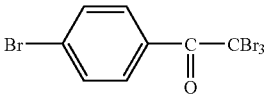
OFI-28
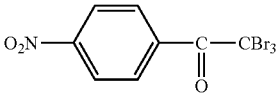
OFI-29
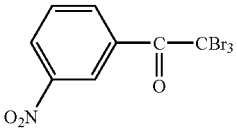
OFI-30
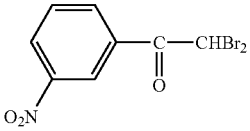
OFI-31
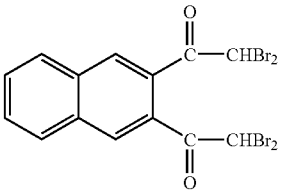
OFI-32
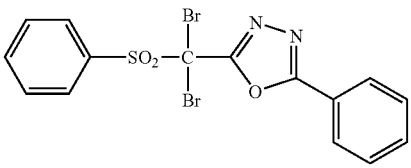

-continued
OFI-33
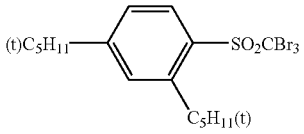
OFI-34
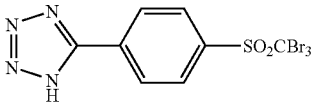
OFI-35
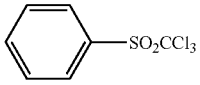
OFI-36
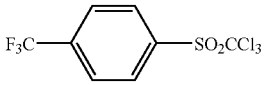
OFI-37
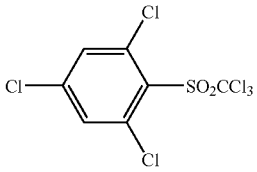
OFI-38
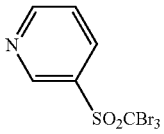
OFI-39
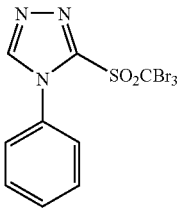
OFI-40
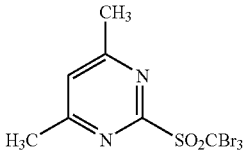
OFI-41
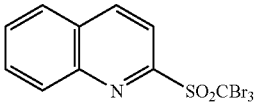
OFI-42
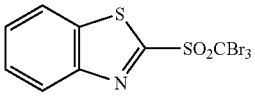
OFI-43
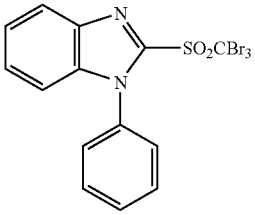
-continued
OFI-44
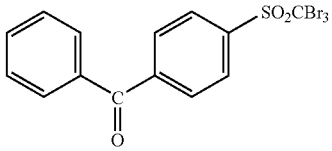
OFI-45
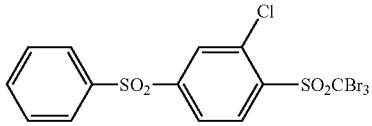
OFI-46
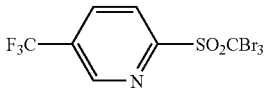
OFI-47
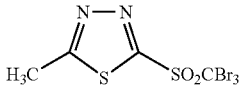
OFI-48
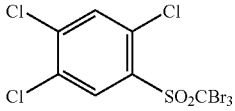
OFI-49
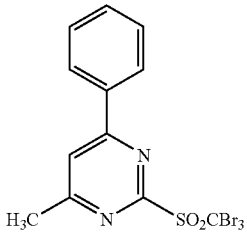
OFI-50
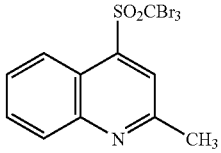
OFI-51
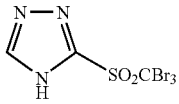
OFI-52
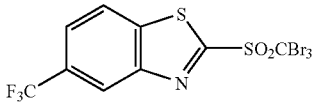
OFI-53
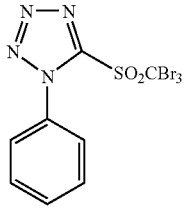

-continued

OFI-54

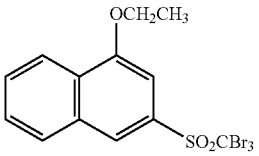

OFI-55

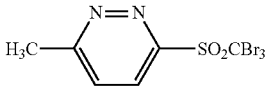

OFI-56

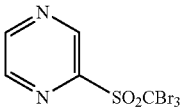

OFI-57

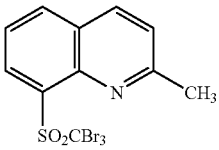

OFI-58

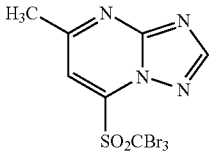

OFI-59

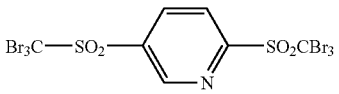

OFI-60

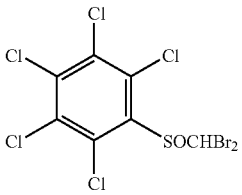

-continued

OFI-61

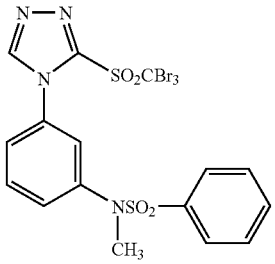

OFI-62

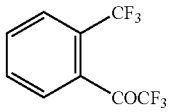

OFI-63

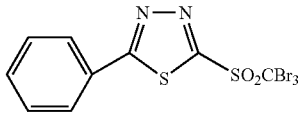

OFI-64

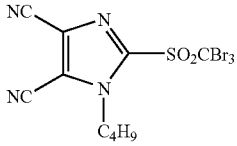

(Polymer PO Inhibitors)

Further, in view of the capability of more stabilizing of silver images, as well as an increase in photographic speed and CP, it is preferable to use, in the photothermographic imaging materials according to the present invention, as an image stabilizer, polymers which have at least one repeating unit of the monomer having a radical releasing group disclosed in JP-A No. 2003-91054. Specifically, in the photothermographic imaging materials according to the present invention, desired results are unexpectedly obtained.

Specific examples of polymers having a halogen radical releasing group are listed below. However, the present invention is not limited thereto.

XP1

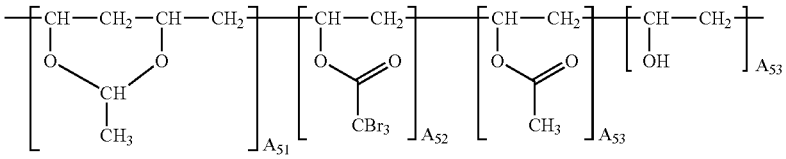

Number average molecular weight of 20,000
Composition (in weight percent) A51:A52:A53:A54 = 70:22:2:6 respectively

XP2

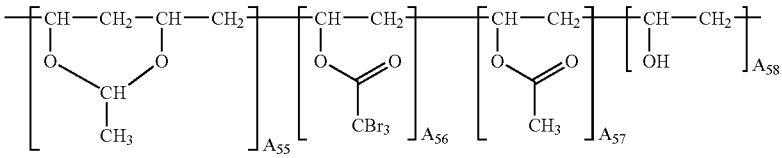

Number average molecular weight of 20,000
Composition (in weight percent) A55:A56:A57:A58 = 62:29:0.5:5.5 respectively

XP3

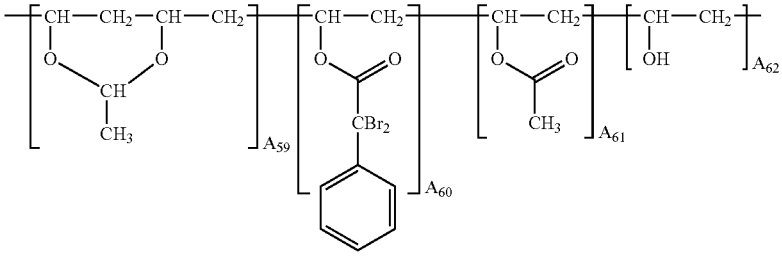

Number average molecular weight of 30,000
Composition (in weight percent) A59:A60:A61:A62 = 52:40:4:4 respectively

XP4

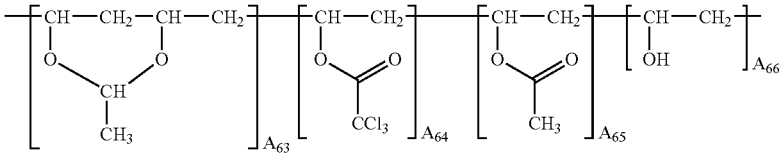

Number average molecular weight of 30,000
Composition (in weight percent) A63:A64:A65:A66 = 57:39:2:2 respectively

XP5

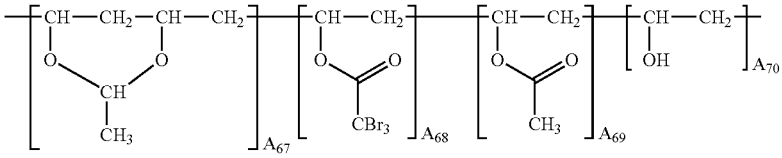

Number average molecular weight of 100,000
Composition (in weight percent) A67:A68:A69:A70 = 60:33:2:5 respectively

XP6

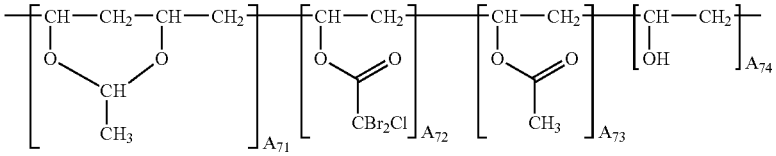

Number average molecular weight of 25,000
Composition (in weight percent) A71:A72:A73:A74 = 80:12:2:6 respectively -continued

XP7

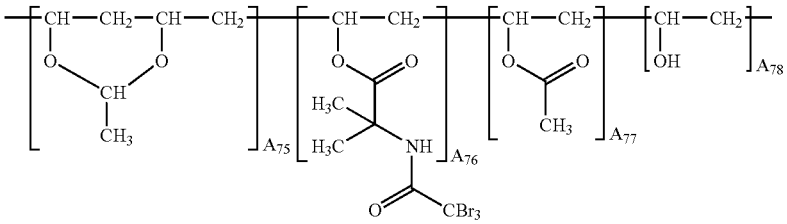

Number average molecular weight of 20,000
Composition (in weight percent) A75:A76:A77:A78 = 78:21:2:6 respectively

XP8

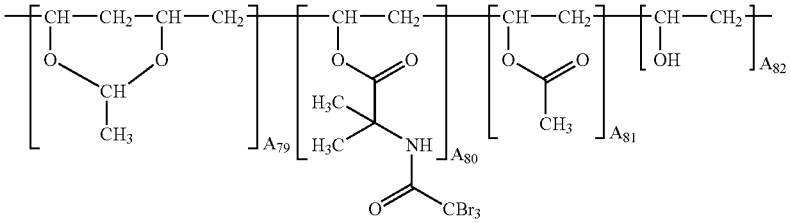

Number average molecular weight of 60,000
Composition (in weight percent) A79:A80:A81:A82 = 70:25:1:4 respectively

XP9

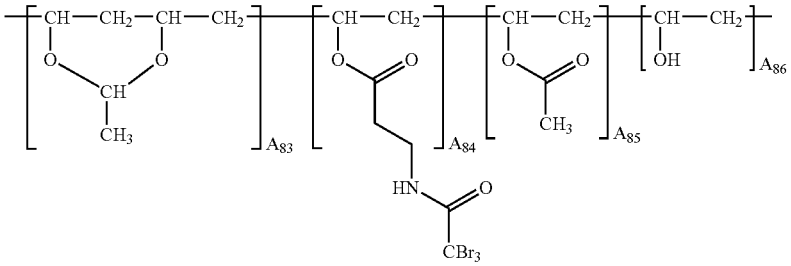

Number average molecular weight of 100,000
Composition (in weight percent) A83:A84:A85:A86 = 76:23:0.5:0.5 respectively

XP10

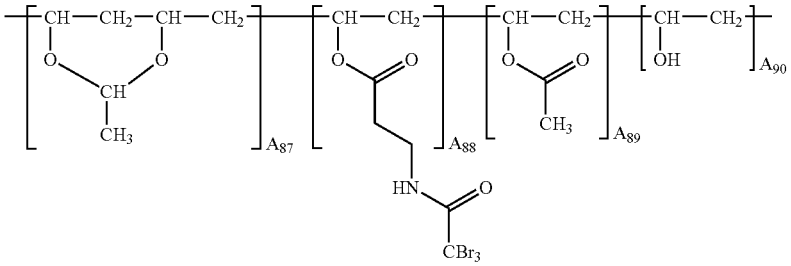

Number average molecular weight of 27,000
Composition (in weight percent) A87:A88:A89:A90 = 71:20:3:6 respectively Incidentally, other than the above-mentioned compounds, compounds which are conventionally known as an antifogging agent may be incorporated in the silver salt photothermographic dry imaging materials of the present invention. For example, listed are the compounds described in U.S. Pat. Nos. 3,589,903, 4,546,075, and 4,452,885, and JP-A Nos. 9-288328 and 9-90550. Listed as other antifogging agents are compounds disclosed in U.S. Pat. No. 5,028,523, and European Patent Nos. 600,587, 605,981 and 631,176.

(Polycarboxyl Compounds)

In the imaging materials according to the present invention, it is preferable to use the compounds represented by the following General Formula (PC) as an antifogging agent and a storage stabilizer.

$$R—(CO—O—M)_n \qquad \text{General Formula (PC)}$$

wherein R represents a linkable atom, an aliphatic group, an aromatic group, a heterocyclic group, or a group of atoms capable of forming a ring as they combine with each other; M represents a hydrogen atom, a metal atom, a quaternary ammonium group, or a phosphonium group; and n represents an integer of 2-20.

Listed as linkable atoms represented by R are those such as nitrogen, oxygen, sulfur or phosphor.

Listed as aliphatic groups represented by R are straight or branched alkyl, alkenyl, alkynyl, and cycloalkyl groups having 1-30 and preferably 1-20 carbon atoms. Specific examples include methyl, ethyl, butyl, hexyl, decyl, dodecyl, isopropyl, t-butyl, 2-ethylhexyl, allyl, butenyl, 7-octenyl, propagyl, 2-butynyl, cyclopropyl, cyclopentyl, cyclohexyl, and cyclododecyl groups.

Listed as aromatic groups represented by R are those having 6-20 carbon atoms, and specific examples include phenyl, naphthyl, and anthranyl groups.

Heterocyclic groups represented by R may be in the form of a single ring or a condensed ring and include 5- to 6-membered heterocyclic groups which have at least O, S, or N atoms, or an amineoxido group. Listed as specific examples are pyrrolidine, piperidine, tetrahydrofuran, tetrahydropyran, oxirane, morpholine, thiomorpholine, thiopyran, tetrahydrothiophene, pyrrole, pyridine, furan, thiophene, imidazole, pyrazole, oxazole, thiazole, isoxazole, isothiazole, triazole, tetrazole, thiadiazole, and oxadiazole, and groups derived from these benzelogues.

In the case in which R is formed employing $R_1$ and $R_2$, each $R_1$ or $R_2$ is defined as R, and $R_1$ and $R_2$ may be the same or different. Listed as rings which are formed employing $R_1$ and $R_2$ may be 4- to 7-membered rings. Of these, are preferred 5- to 7-membered rings. Preferred groups represented by $R_1$ and $R_2$ include aromatic groups as well as heterocyclic groups. Aliphatic groups, aromatic groups, or heterocyclic rigs may be further substituted with a substituent. Listed as the above substituents are a halogen atom (e.g., a chlorine atom or a bromine atom), an alkyl group (e.g., a methyl group, an ethyl group, an isopropyl group, a hydroxyethyl group, a methoxymethyl group, a trifluoromethyl group, or a t-butyl group), a cycloalkyl group (e.g., a cyclopentyl group or a cyclohexyl group), aralkyl group (e.g., a benzyl group or a 2-phenetyl group), an aryl group (e.g., phenyl group, a naphthyl group, a p-tolyl group, or a p-chlorophenyl group), an alkoxy group (e.g., a methoxy group, an ethoxy group, an isopropoxy group, or a butoxy group), an aryloxy group (e.g., a phenoxy group or a 4-methoxyphenoxy group), a cyano group, an acylamino group (e.g., an acetylamino group or a propionylamino group), an alkylthio group (e.g., a methylthio group, an ethylthio group, or a butylthio group), an arylthio group (e.g., a phenylthio group or a p-methylphenylthio group), a sulfonylamino group (e.g, a methanesulfonylamino group or a benzenesulfonylamino group), a ureido group (e.g., a 3-methylureido group, a 3,3-dimethylureido group, or a 1,3-dimethylureido group), a sulfamoylamino group (a dimethylsulfamoylamino group or a diethylsulfamoylamino group), a carbamoyl group (e.g., a methylcarbamoyl group, an ethylcarbmoyl group, or a dimerthylcarbamoyl group), a sulfamoyl group (e.g., an ethylsulfamoyl group or a dimethylsulfamoyl group), an alkoxycarbonyl group (e.g., a methoxycarbonyl group or an ethoxycarbonyl group), an aryloxycarbonyl group (e.g., a phenoxycarbonyl group or a p-chlorophenoxycarbonyl group), a sulfonyl group (e.g., a methanesulfonyl group, a butanesulfonyl group, or a phenylsulfonyl group), an acyl group (e.g., an acetyl group, a propanoyl group, or a butyroyl group), an amino group (e.g., a methylamino group, an ethylamino group, and a dimethylamino group), a hydroxy group, a nitro group, a nitroso group, an amineoxide group (e.g., a pyridine-oxide group), an imido group (e.g., a phthalimido group), a disulfide group (e.g., a benzenedisulfide group or a benzthiazoryl-2-disulfide group), and a heterocyclic group (e.g., a pyridyl group, a benzimidazolyl group, a benzthiazoyl group, or a benzoxazolyl group). $R_1$ and $R_2$ may each have a single substituent or a plurality of substituents selected from the above. Further, each of the substituents maybe further substituted with the above substituents. Still further, $R_1$ and $R_2$ may be the same or different. Yet further, when General Formula (PC-1) is an oligomer or a polymer $(R—(COOM)_{n0})_m$, desired effects are obtained, wherein n is preferably 2-20, and m is preferably 1-100, or the molecular weight is preferably at most 50,000.

Acid anhydrides of General Formula (PC-1), as described in the present invention, refer to compounds which are formed in such a manner that two carboxyl groups of the compound represented by General Formula (PC-1) undergo dehydration reaction. Acid anhydrides are preferably prepared from compounds having 3-10 carboxyl groups and derivatives thereof.

Further preferably employed are simultaneously dicarboxylic acids described in JP-A Nos. 58-95338, 10-288824, 11-174621, 11-218877, 2000-10237, 2000-10236, and 2000-10231.

(Thiosulfonic Acid Restrainers)

It is preferable that imaging materials according to the present invention contain the compounds represented by aforesaid General Formula (ST).

The aforesaid compounds will now be detailed.

In the compounds represented by General Formula (ST), the alkyl group, aryl group, heterocyclic group, aromatic ring and heterocyclic ring, which are represented by Z may be substituted. Listed as the substituents may be, for example, a lower alkyl group such as a methyl group or an ethyl group, an aryl group such as a phenyl group, an alkoxyl group having 1-8 carbon atoms, a halogen atom such as chlorine, a nitro group, an amino group, or a carboxyl group. Metal atoms represented by M are alkaline metals such as a sodium ion or a potassium ion, while as the organic cation preferred are an ammonium ion or a guanidine group.

Listed as specific examples of the compounds represented by General Formula (ST) may be those described below. However, the present invention is not limited thereto.

(ST-1)

$CH_3SO_2SNa$ (ST-2)

$C_2H_5SO_2SNa$ (ST-3)

$HOOC—CH_2CH_2SO_2SK$ (ST-4)

$(n)C_4H_9SO_2SNa$ (ST-5)

$NC—CH_2CH_2CH_2SO_2SNa$ (ST-6)

$(n)C_8H_{17}SO_2SNa$ (ST-7)

$(n)C_{12}H_{25}SO_2SNa$ (ST-8)

$ClCH_2(CH_2)_4SO_2SK$ (ST-9)

$(n)C_{18}H_{37}SO_2SNa$ (ST-10)

$(n)C_4H_9SO_2SK$ (ST-11)

$(n)C_8H_{17}SO_2SK$ (ST-12)

$$\begin{array}{l} CH_3 \\ \quad\backslash \\ \quad\ CHCH_2SO_2SNa \\ \quad\ / \\ CH_3 \end{array}$$

(ST-13)

$$\begin{array}{l} CH_3 \\ \quad\backslash \\ \quad\ CHCH_2CH_2SO_2SNa \\ \quad\ / \\ CH_3 \end{array}$$

-continued (ST-14)

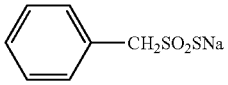

(ST-15)

$(n)C_8H_{17}SO_2S^-$ $\bullet(n)(C_4H_9)_4N^+$ (ST-16)

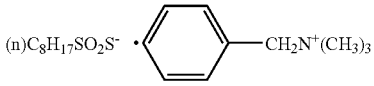

(ST-17)

$H_2N—CH_2CH_2SO_2SH$ (ST-18)

$CH_3O—CH_2CH_2SO_2SNa$ (ST-19)

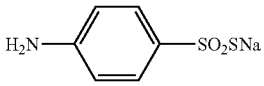

(ST-20)

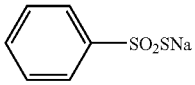

(ST-21)

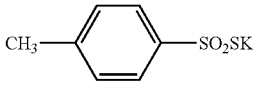

(ST-22)

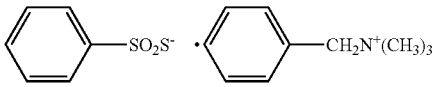

(ST-23)

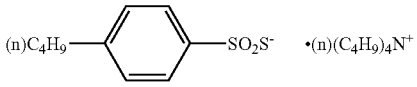

(ST-24)

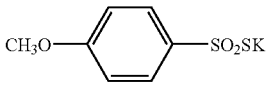

(ST-25)

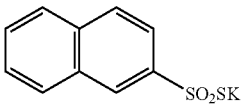

(ST-26)

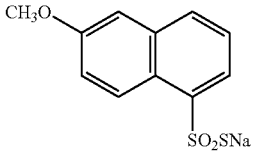

(ST-27)

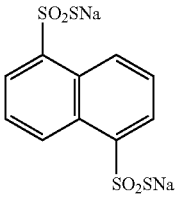

(ST-28)

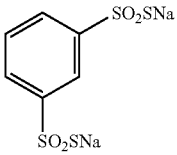

-continued (ST-29)

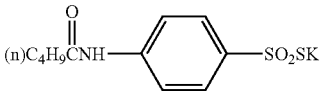

(ST-30)

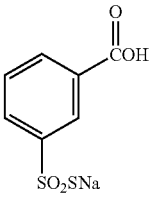

(ST-31)

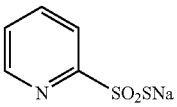

(ST-32)

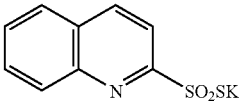

(ST-33)

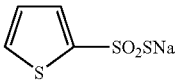

(ST-34)

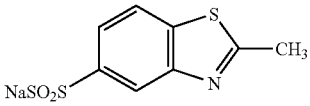

(ST-35)

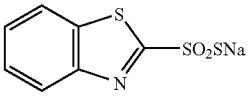

(ST-36)

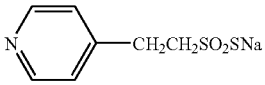

(ST-37)

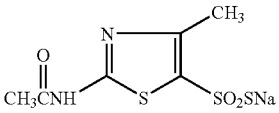

(ST-38)

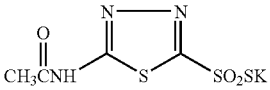

(ST-39)

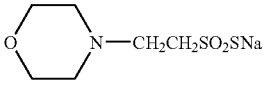

(ST-40)

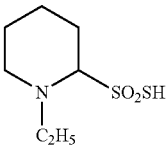

It is possible to synthesize the compounds represented by General Formula (ST), employing methods which are generally well known. For example, it is possible to synthesize them employing a method in which corresponding sulfonyl fluoride is allowed to react with sodium sulfide, or corresponding sodium sulfinate is allowed to react with sulfur. On the other hand, these compounds are also easily available on the market.

The compounds represented by General Formula (ST) may be added at any time prior to the coating process of the production process of the imaging materials according to the present invention. However, it is preferable that they are added to a liquid coating composition just before the coating.

The added amount of the compounds represented by General Formula (ST) is not particularly limited, but is preferably in the range of $1\times10^{-6}$–1 g per mol of the total silver amount, including silver halides.

Incidentally, similar compounds are disclosed in JP-A No. 8-314059.

(Electron Attractive Group Containing Vinyl Type Restrainers)

In the present invention, it is preferable to simultaneously use the fog restrainers represented by aforesaid General Formula (CV) described in Japanese Patent Application No. 2003-199555.

Compounds represented by aforesaid General Formula (CV) preferably utilized in this invention will now be explained.

An electron withdrawing group represented by X is a substituent, Hammett's σp of which is positive. Specifically, listed are substituted alkyl groups (such as halogen-susbstituted alkyl), substituted alkenyl groups (such as cyanovinyl), substituted and non-substituted alkynyl groups (such as trifluoroacetylenyl, cyanoacetylenyl and formylacetylenyl), substituted aryl groups (such as cyanophenyl), substituted and non-substituted heterocyclic groups (pyridyl, triazinyl and benzooxazolyl), a halogen atom, a cyano group, acyl groups (such as acetyl, trifluoroacetyl and formyl), thioacyl groups (such as thioformyl and thioacetyl), oxalyl groups (such as methyloxalyl), oxyoxalyl groups (such as ethoxalyl), —S-oxalyl groups (such as ethylthiooxalyl), oxamoyl groups (such as methyloxamoyl), oxycarbonyl groups (such as ethoxycarbonyl and carboxyl), —S-carbonyl groups (such as ethylthiocarbonyl), a carbamoyl group, a thiocarbamoyl group, a sulfonyl group, a sulfinyl group, oxysulfonyl groups (such as ethoxysulfonyl), —S-sulfonyl groups (such as ethylthiosulfonyl), a sulfamoyl group, oxysulfinyl groups (such as methoxysulfinyl), —S-sulfinyl groups (such as methylthiosulfinyl), a sulfinamoyl group, a phosphoryl group, a nitro group, imino groups (such as imino, N-methylimino, N-phenylimino, N-pyridylimino, N-cyanoimino and N-nitroimino), N-carbonylimino groups (such as N-acetylimino, N-ethoxycarbonylimino, N-ethoxalylimino, N-formylimino, N-trifluoroacetylimino and N-carbamoylimino), N-sulfonylimino groups (such as N-methanesulfonylimino, N-trifluoromethanesulfonylimino, N-methoxysulfonylimino and N-sulfamoylimino), an ammonium group, a sulfonium group, a phosphonium group, a pyrilium group or an immonium group, and also listed are heterocyclic groups in which rings are formed by such as an ammonium group, a sulfonium group, a phosphonium group and an immonium group. The σp value is preferably not less than 0.2 and more preferably not less than 0.3.

W includes a hydrogen atom, alkyl groups (such as methyl, ethyl and trifluoromethyl), alkenyl groups (such as vinyl, halogen substituted vinyl and cyano vinyl), alkynyl groups (such as acetylenyl and cyanoacetylenyl), aryl groups (such as phenyl, chlorophenyl, nitrophenyl, cyanophenyl and pentafluorophenyl), a heterocyclic group (such as pyridyl, pyrimidyl, pyrazinyl, quinoxalinyl, triazinyl, succineimido, tetrazonyl, triazolyl, imidazolyl and benzooxazolyl), in addition to these, also include those explained in aforesaid X such as a halogen atom, a cyano group, an acyl group, a thioacyl group, an oxalyl group, an oxyoxalyl group, a —S-oxalyl group, an oxamoyl group, an oxycarbonyl group, a —S-carbonyl group, a carbamoyl group, a thiocarbamoyl group, a sulfonyl group, a sulfinyl group, an oxysulfonyl group, a —S-sulfonyl group, a sulfamoyl group, an oxysulfinyl group, a —S-sulfinyl group, a sulfinamoyl group, a phosphoryl group, a nitro group, an imino group, a N-carbonylimino group, N-sulfonylimino group, an ammonium group, a sulfonium group, a phosphonium group, a pyrilium group and an immonium group.

Preferable as W are also aryl groups and heterocyclic groups as described above, in addition to electron withdrawing groups having a positive Hammett's substituent constant σp.

X and W may form a ring structure by bonding to each other. Rings formed by X and W include a saturated or unsaturated carbon ring or heterocyclic ring, which may be provided with a condensed ring, and also a cyclic ketone. Heterocyclic rings are preferably those having at least one atom among N, O, and S and more preferably those containing one or two of said atoms.

$R_1$ includes a hydroxyl group or organic or inorganic salts of the hydroxyl group. Specific examples of alkyl groups, alkenyl groups, alkynyl groups, aryl groups and heterocyclic groups represented by $R_2$ include each example of alkyl groups, alkenyl groups, alkynyl groups, aryl groups and heterocyclic groups exemplified as W.

Further, in this invention, any of X, W and $R_2$ may contain a ballast group. A ballast group means a so-called ballast group in such as a photographic coupler, which makes the added compound have a bulky molecular weight not to migrate in a coated film of a light-sensitive material.

Further, in this invention, X, W and $R_2$ may contain a group enhancing adsorption to a silver salt. Groups enhancing adsorption to a silver salt include a thioamido group, an aliphatic mercapto group, an aromatic mercapto group, a heterocyclic mercapto group, and each group represented by 5- or 6-membered nitrogen-containing heterocyclic rings such as benzotriazole, triazole, tetrazole, indazole, benzimidazole, imidazole, benzothiazole, thiazole, benzoxazole, oxazole, thiadiazole, oxadiazole and triazine.

In this invention, it is preferred that at least one of X and W represents a cyano group, or X and W form a cyclic structure by bonding to each other.

Further, in this invention, preferable are compounds in which a thioether group (—S—) is contained in the substituents represented by X, W and $R_2$.

Further, preferable are those in which at least one of X and W is provided with an alkene group represented by following General Formula (CV1).

$$—C(R)=C(Y)(Z) \qquad \text{General Formula (CV1)}$$

wherein, R represents a hydrogen atom or a substituent, Y and Z each represent a hydrogen atom or a substituent, however, at least one of Y and Z represents an electron withdrawing group.

Examples of electron withdrawing groups among the substituents represented by Y and Z include the aforesaid electron withdrawing groups listed as X and W, such as a cyano group and a formyl group.

X and W represented by above General Formula (CV1) include, for example, the following groups.

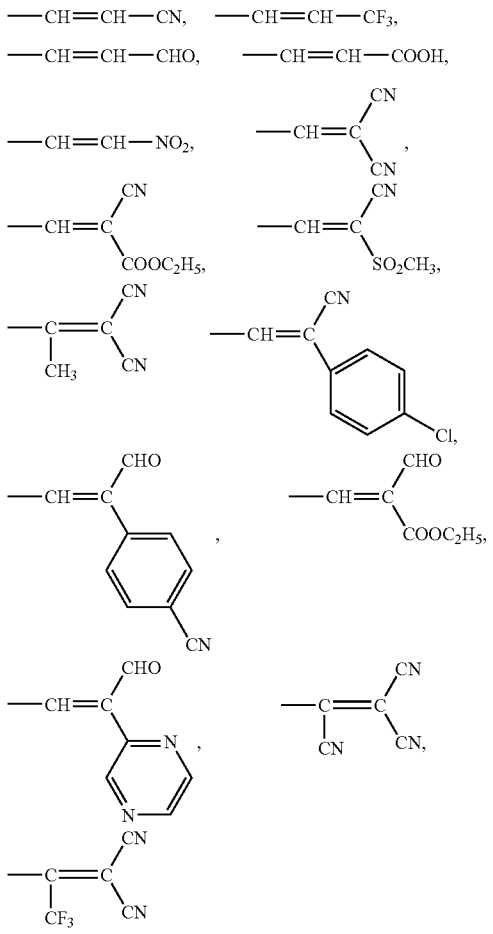

Further, preferable are those in which at least one of X and W is provided with alkyne groups described below.

—C≡C—$R_5$

R represents a hydrogen atom or a substituent, and the substituent is preferably an election withdrawing group such as those listed in the aforesaid X and W. X and W represented by the above General Formula (CV1) include the following groups.

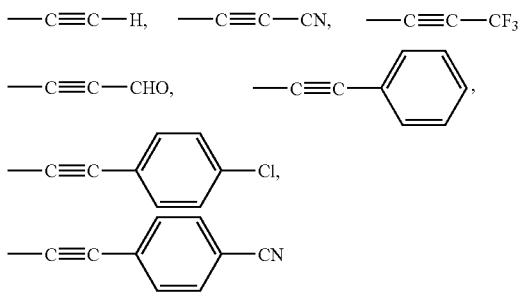

Further, at least one of X and W is preferably provided with an acyl group selected from a substituted alkylcarbonyl group, alkenylcarbonyl group and alkynylcarbonyl group, and X and W, for example, include the following groups.

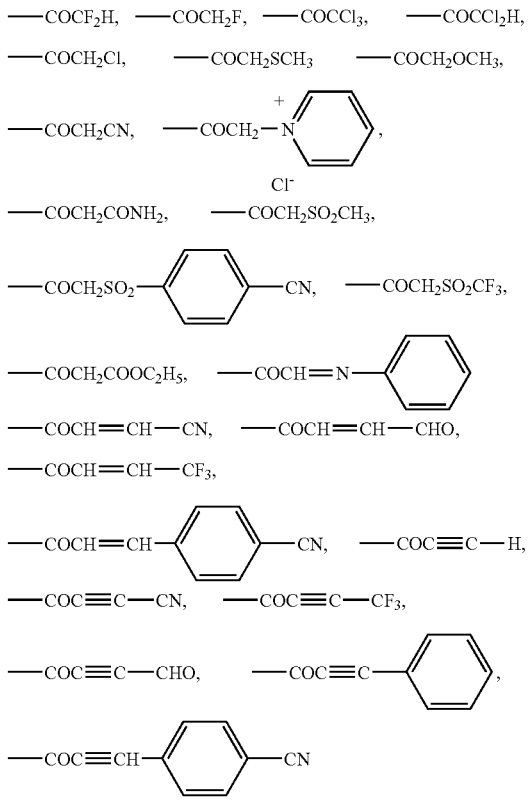

Further, at least one of X and W is preferably provided with an oxalyl group, and X and W provided with an oxalyl group include the following groups:

—$COCOCH_3$, —$COCOOC_2H_5$, —$COCONHCH_3$, —$COCOSC_2H_5$ and $COCOOC_2H_4SCH_3$.

Further, at least one of X and W is also preferably provided with an aryl group or a nitrogen containing hetrocyclic group substituted by an electron withdrawing group, and such X and W, for example, include the following groups.

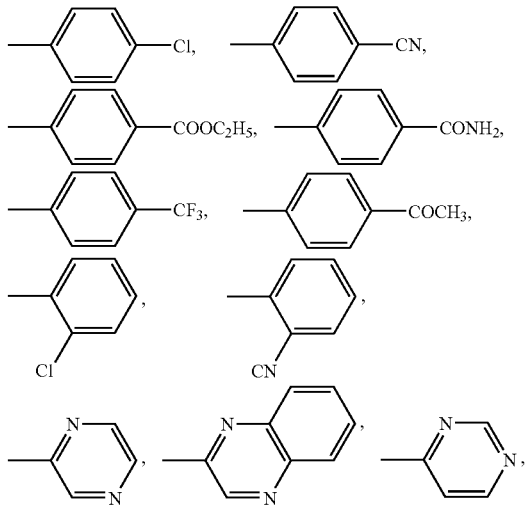

-continued

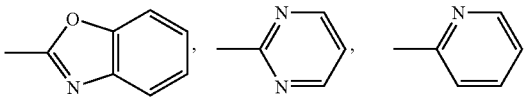

In this invention, alkene compounds represented by General Formula (CV) include every isomers when they can take isomeric structures with respect to a double bond, where X, W, $R_1$ and $R_2$ substitute, and also include every isomers when they can take tautomeric structures such as a keto-enol form.

In the following, specific examples of compounds represented by General Formula (CV) will be described, however, this invention is not limited thereto.

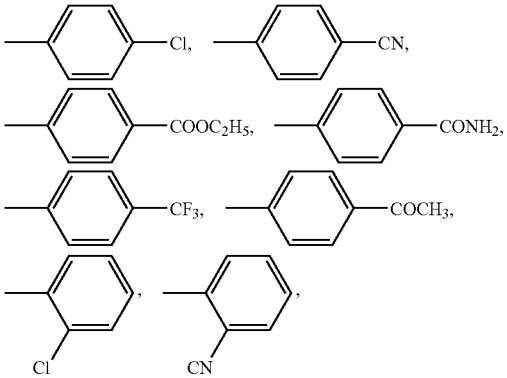

CV-1

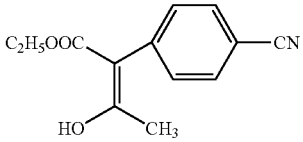

CV-2

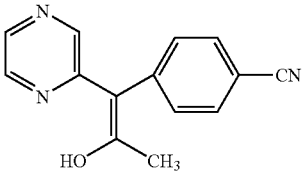

CV-3

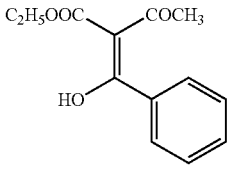

-continued

CV-4

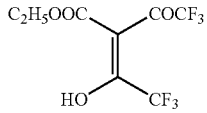

CV-5

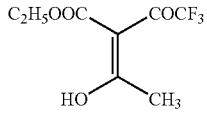

CV-6

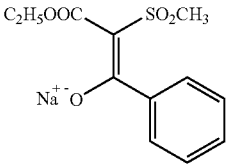

CV-7

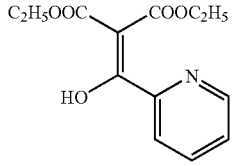

CV-8

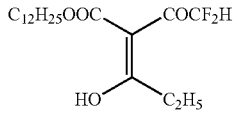

CV-9

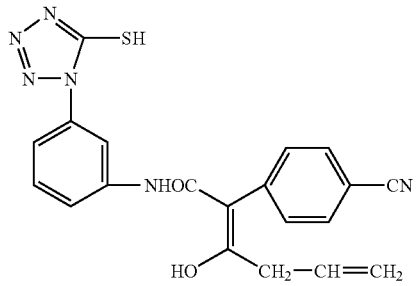

CV-10

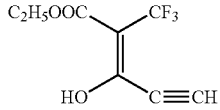

CV-11

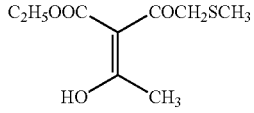

CV-12

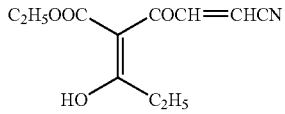

CV-13

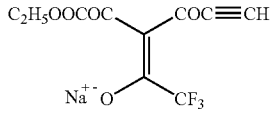

-continued
CV-14
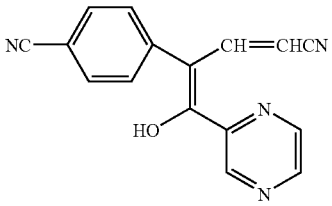
CV-15
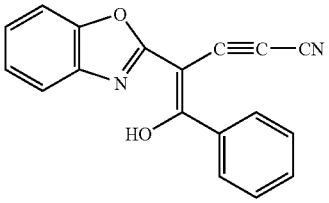
CV-16
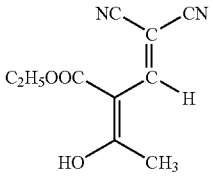
CV-17
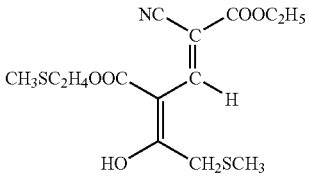
CV-18
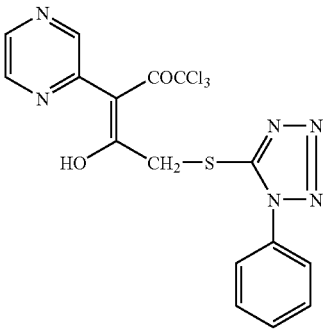
CV-19
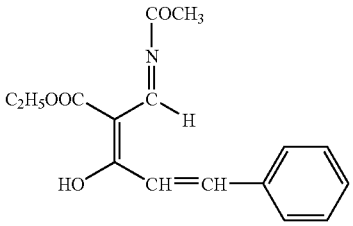
CV-20
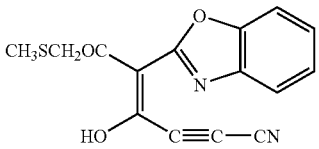
-continued
CV-21
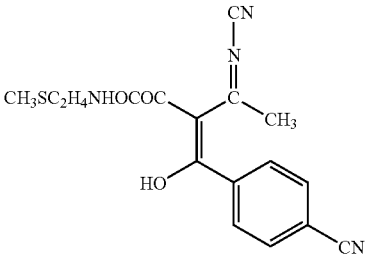
CV-22
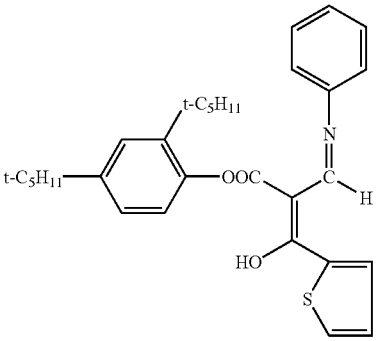
CV-23
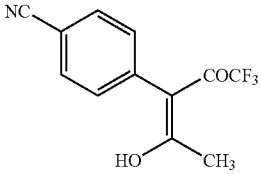
CV-24
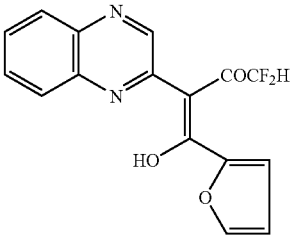
CV-25
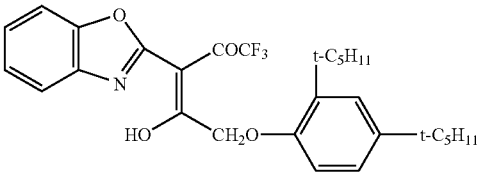
CV-26
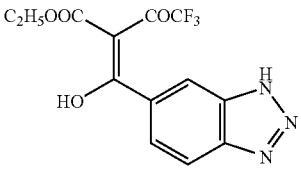

-continued
CV-27
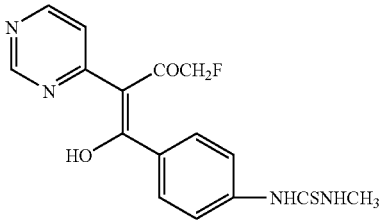
CV-28
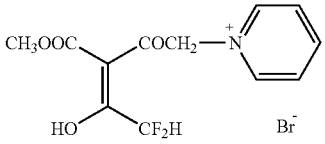
CV-29
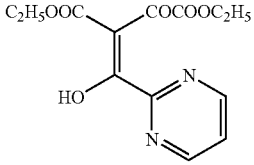
CV-30
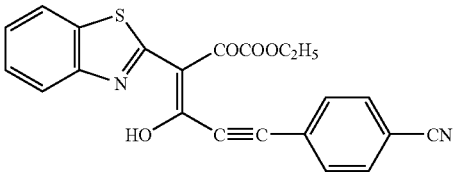
CV-31
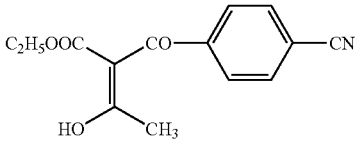
CV-32
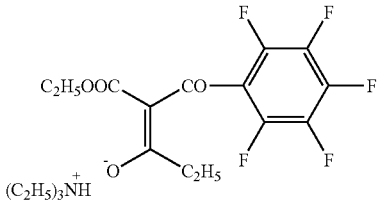
CV-33
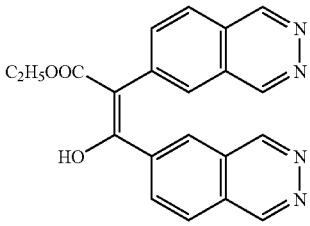
CV-34
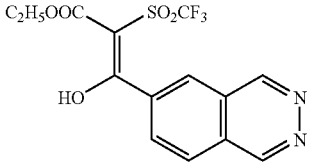
-continued
CV-35
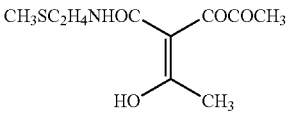
CV-36
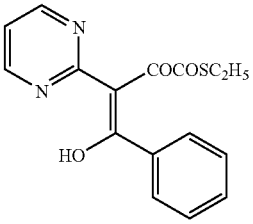
CV-37
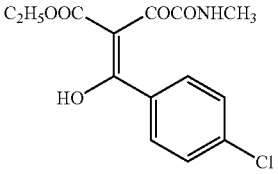
CV-38
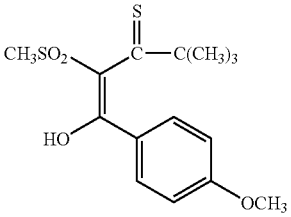
CV-39
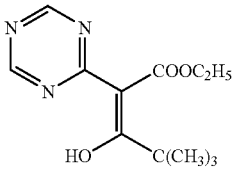
CV-40
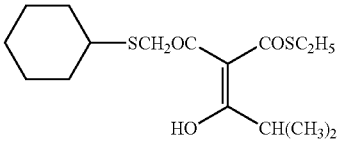
CV-41
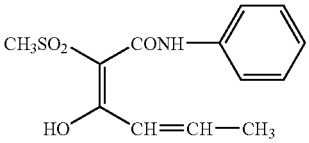
CV-42
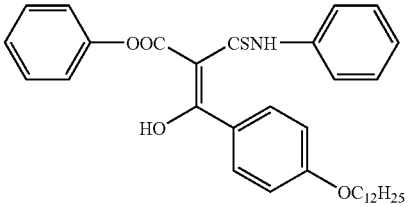

-continued
CV-43
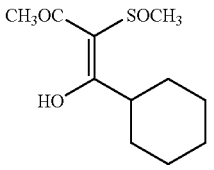
CV-44
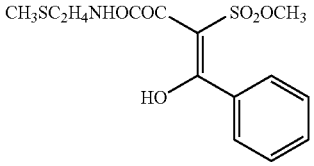
CV-45
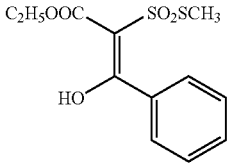
CV-46
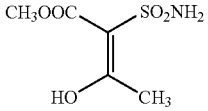
CV-47
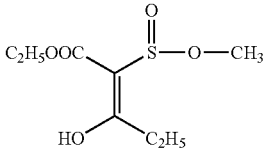
CV-48
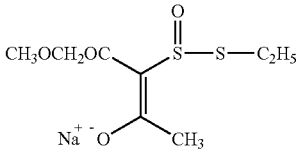
CV-49
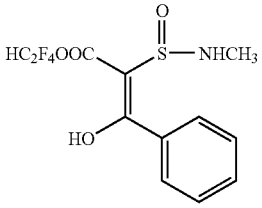
CV-50
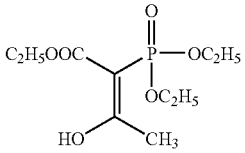
CV-51
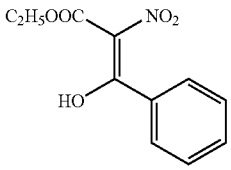
-continued
CV-52
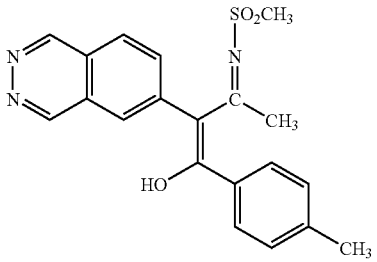
CV-53
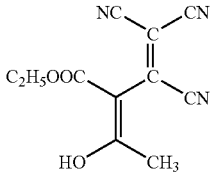
CV-54
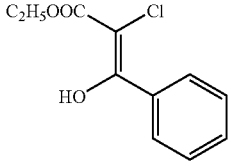
CV-55
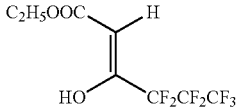
CV-56
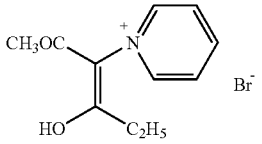
CV-57
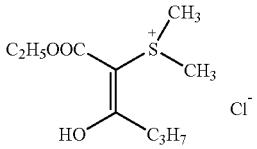
CV-58
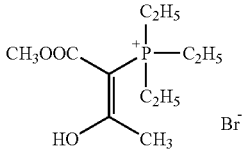
CV-59
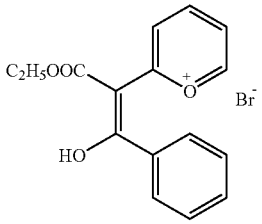
CV-60
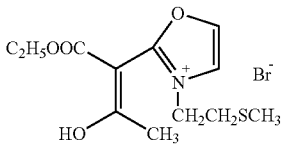

-continued
CV-61
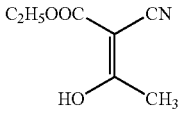
CV-62
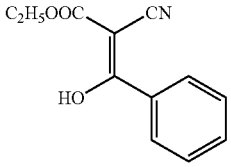
CV-63
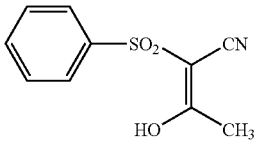
CV-64
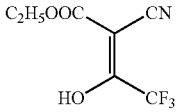
CV-65
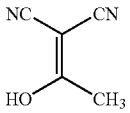
CV-66
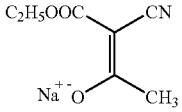
CV-67
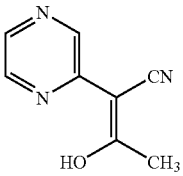
CV-68
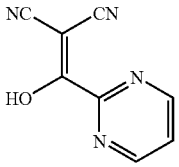
CV-69
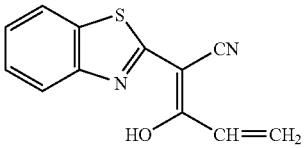
CV-70
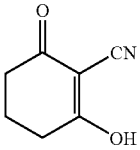
-continued
CV-71
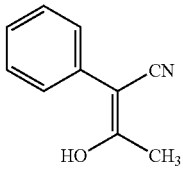
CV-72
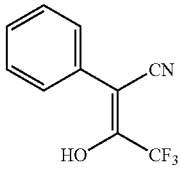
CV-73
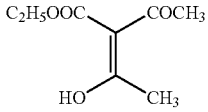
CV-74
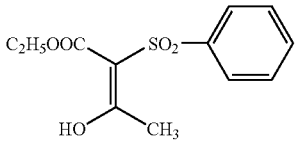
CV-75
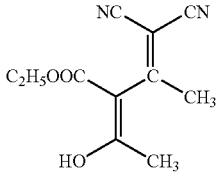
CV-76
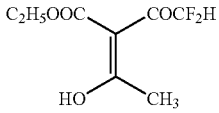
CV-77
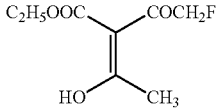
CV-101
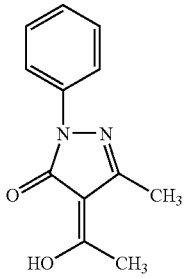
CV-102
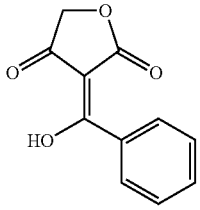

-continued
CV-103
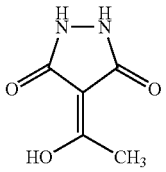
CV-104
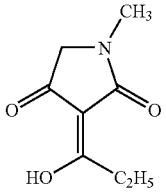
CV-105
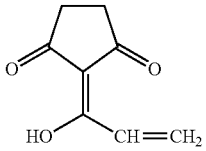
CV-106
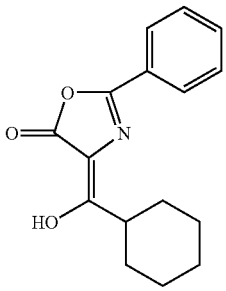
CV-107
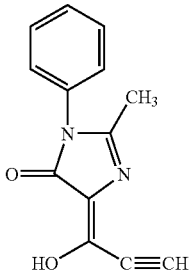
CV-108
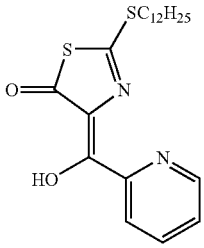
-continued
CV-109
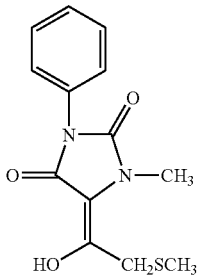
CV-110
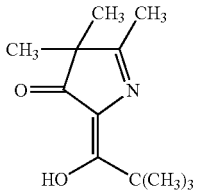
CV-111
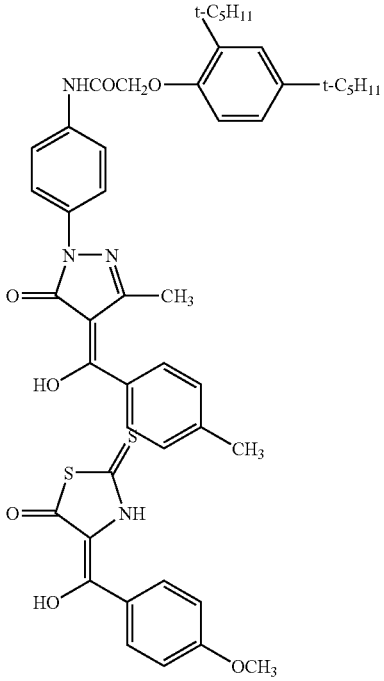
CV-112
CV-113
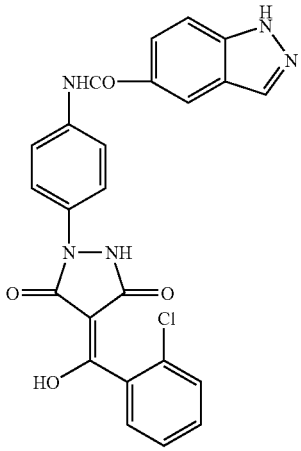

-continued
CV-114
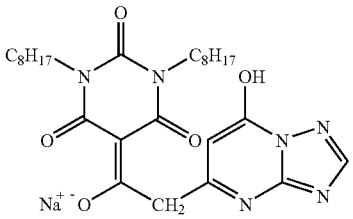
CV-115
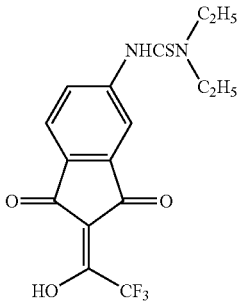
CV-116
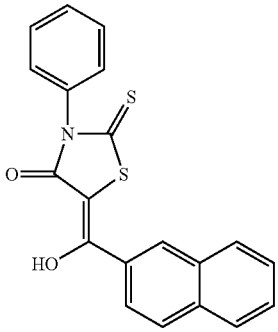
CV-117
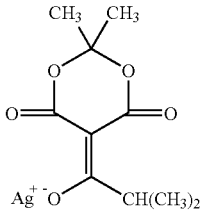
CV-118
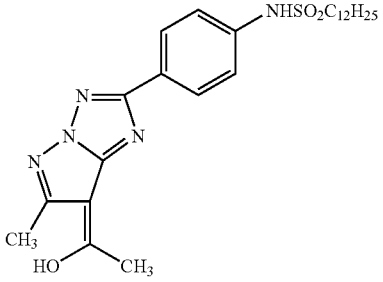
-continued
CV-119
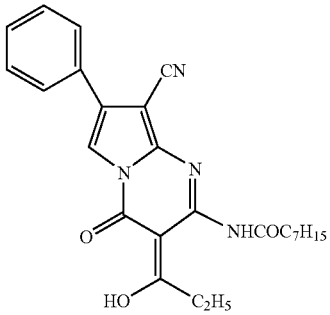
CV-120
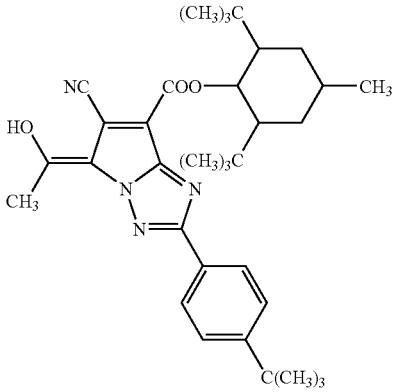
CV-121
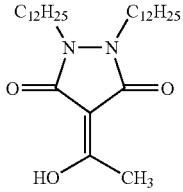
CV-122
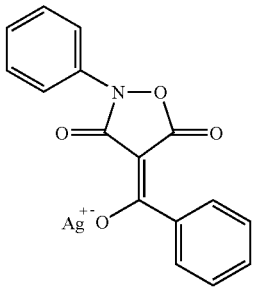
CV-123
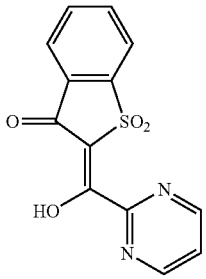

-continued
CV-124
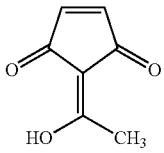
CV-125
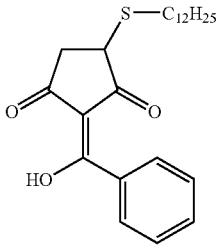
CV-126
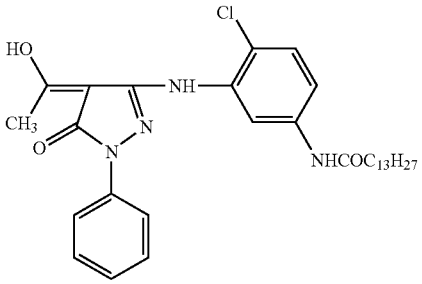
CV-127
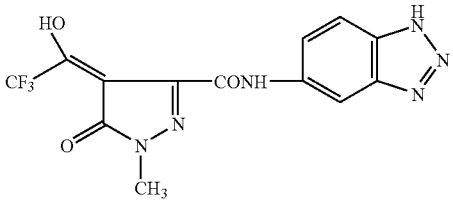
CV-128
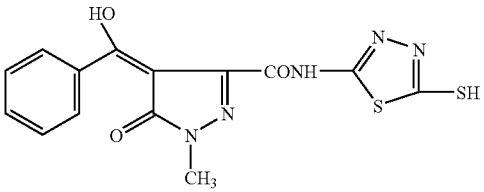
CV-129
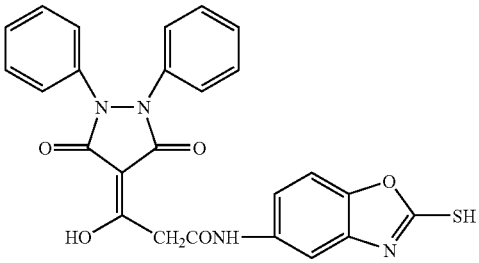
CV-130
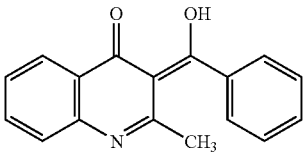
-continued
CV-131
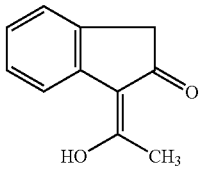
CV-132
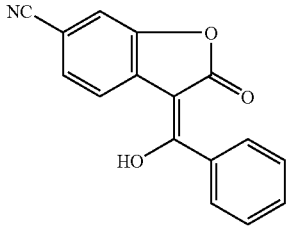
CV-133
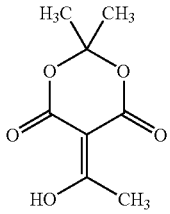
CV-134
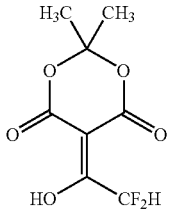
CV-135
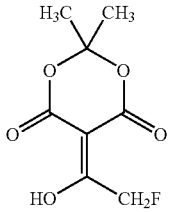
CV-136
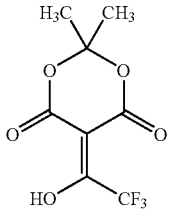
CV-137
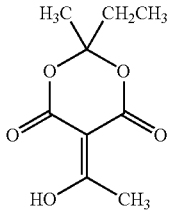
Compounds represented by General Formula (CV) of this invention can be synthesized by various methods, and they can be synthesized by referring to, for example, a method described in Japanese Translated PCT Patent Publication No. 2000-515995.

Example compound (CV)-5 can be synthesized, for example, by the following rout.

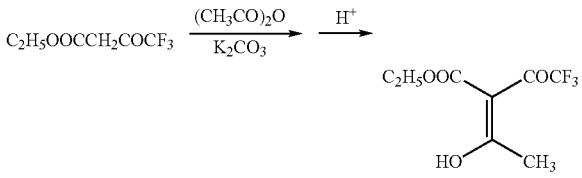

Other compounds represented by General Formula (CV) can be synthesized in a similar manner.

The compound represented by General Formula (CV) is incorporated at least in one of a light-sensitive layer and light-insensitive layers on said light-sensitive layer side, of a thermally developable light-sensitive material, and preferably at least in a light-sensitive layer. The addition amount of compounds represented by General Formula (1) is preferably $1\times10^{-8}$–1 mol/Ag mol, more preferably $1\times10^{-6}$–$1\times10^{-1}$ mol/Ag mol and most preferably $1\times10^{-4}$–$1\times10^{-2}$ mol/Ag mol.

The compound represented by General Formula (CV) can be added in a light-sensitive layer or a light-insensitive layer according to commonly known methods. That is, they can be added in light-sensitive layer or light-insensitive layer coating solution by being dissolved in alcohols such as methanol and ethanol, ketones such as methyl ethyl ketone and acetone, and polar solvents such as dimethylsulfoxide and dimethylformamide. Further, they can be added also by being made into micro-particles of not more than 1 μm followed by being dispersed in water or in an organic solvent. As for microparticle dispersion techniques, many techniques have been disclosed and the compound can be dispersed according to these techniques.

(Silver Ion Reducing Agents)

In the present invention, employed as a silver ion reducing agent (hereinafter occasionally referred simply to as a reducing agent) may be polyphenols described in U.S. Pat. Nos. 3,589,903 and 4,021,249, British Patent No. 1,486,148, JP-A Nos. 51-5193350-36110, 50-116023, and 52-84727, and Japanese Patent Publication No. 51-35727; bisnaphthols such as 2,2'-dihydroxy-1,1'-binaphthyl and 6,6'-dibromo-2,2'-dihydroxy-1,1'-binaphthyl described in U.S. Pat. No. 3,672,904; sulfonamidophenols and sulfonamidonaphthols such as 4-benzenesulfonamidophenol, 2-benznesulfonamidophenol, 2,6-dichloro-4-benenesulfonamidophenol, and 4-benznesulfonamidonaphthol described in U.S. Pat. No. 3,801,321.

In the present invention, preferred reducing agents for silver ions are compounds represented by the aforesaid General Formula (RED).

General Formula (RED) is detailed below.

$X_1$ in General Formula (RED) represents a chalcogen atom or $CHR_1$. Specifically listed as chalcogen atoms are a sulfur atom, a selenium atom, and a tellurium atom. Of these, a sulfur atom is preferred.

$R_1$ in $CHR_1$ represents a hydrogen atom, a halogen atom, an alkyl group, an alkenyl group, an alkynyl group, an aryl group or a heterocyclic group. Listed as halogen atoms are, for example, a fluorine atom, a chlorine atom, and a bromine atom. Listed as alkyl groups are, alkyl groups having 1-20 carbon atoms, for example, a methyl group, an ethyl group, a propyl group, a butyl group, a hexyl group, a heptyl group and a cycloalkyl group. Examples of alkenyl groups are, a vinyl group, an allyl group, a butenyl group, a hexenyl group, a hexadienyl group, an ethenyl-2-propenyl group, a 3-butenyl group, a 1-methyl-3-propenyl group, a 3-pentenyl group, a 1-methyl-3-butenyl group and a cyclohexenyl group. Examples of aryl groups are, a phenyl group and a naphthyl group. Examples of heterocylic groups are, a thienyl group, a furyl group, an imidazolyl group, a pyrazolyl group and a pyrrolyl group. Of these, cyclic groups such as cycloalkyl groups and cycloalkenyl groups are preferred.

These groups may have a substituent. Listed as said substituents are a halogen atom (for example, a fluorine atom, a chlorine atom, or a bromine atom), a cycloalkyl group (for example, a cyclohexyl group or a cyclobutyl group), a cycloalkenyl group (for example, a 1-cycloalkenyl group or a 2-cycloalkenyl group), an alkoxy group (for example, a methoxy group, an ethoxy group, or a propoxy group), an alkylcarbonyloxy group (for example, an acetyloxy group), an alkylthio group (for example, a methylthio group or a trifluoromethylthio group), a carboxyl group, an alkylcarbonylamino group (for example, an acetylamino group), a ureido group (for example, a methylaminocarbonylamino group), an alkylsulfonylamino group (for example, a methanesulfonylamino group), an alkylsulfonyl group (for example, a methanesulfonyl group and a trifluoromethanesulfonyl group), a carbamoyl group (for example, a carbamoyl group, an N,N-dimethylcarbamoyl group, or an N-morpholinocarbonyl group), a sulfamoyl group (for example, a sulfamoyl group, an N,N-dimethylsulfamoyl group, or a morpholinosulfamoyl group), a trifluoromethyl group, a hydroxyl group, a nitro group, a cyano group, an alkylsulfonamido group (for example, a methanesulfonamido group or a butanesulfonamido group), an alkylamino group (for example, an amino group, an N,N-dimethylamino group, or an N,N-diethylamino group), a sulfo group, a phosphono group, a sulfite group, a sulfino group, an alkylsulfonylaminocarbonyl group (for example, a methanesulfonylaminocarbonyl group or an ethanesulfonylaminocarbonyl group), an alkylcarbonylaminosulfonyl group (for example, an acetamidosulfonyl group or a methoxyacetamidosulfonyl group), an alkynylaminocarbonyl group (for example, an acetamidocarbonyl group or a methoxyacetamidocarbonyl group), and an alkylsulfinylaminocarbonyl group (for example, a methanesulfinylaminocarbonyl group or an ethanesulfinylaminocarbonyl group). Further, when at least two substituents are present, they may be the same or different.

Most preferred substituent is an alkyl group.

$R_2$ represents an alkyl group. Preferred as the alkyl groups are those, having 1-20 carbon atoms, which are substituted or unsubstituted. Specific examples include a methyl, ethyl, i-propyl, butyl, i-butyl, t-butyl, t-pentyl, t-octyl, cyclohexyl, 1-methylcyclohexyl, or 1-methylcyclopropyl group.

Substituents of the alkyl group are not particularly limited and include, for example, an aryl group, a hydroxyl group, an alkoxy group, an aryloxy group, an alkylthio group, an arylthio group, an acylamino group, a sulfonamide group, a sulfonyl group, a phosphoryl group, an acyl group, a carbamoyl group, an ester group, and a halogen atom. In addition, $(R_4)_n$ and $(R_4)_m$ may form a saturated ring. $R_2$ is preferably a secondary or tertiary alkyl group and preferably has 2-20 carbon atoms. $R_2$ is more preferably a tertiary alkyl group, is still more preferably a t-butyl group, a t-pentyl group, or a methylcyclohexyl group, and is most preferably a t-butyl group.

$R_3$ represents a hydrogen atom or a group capable of being substituted to a benzene ring. Listed as groups capable of being substituted to a benzene ring are, for example, a halogen atom such as fluorine, chlorine, or bromine, an alkyl group, an aryl group, a cycloalkyl group, an alkenyl group, a cycloalkenyl group, an alkynyl group, an amino group, an acyl group, an acyloxy group, an acylamino group, a sulfonylamino group, a sulfamoyl group, a carbamoyl group, an alkylthio group, a sulfonyl group, an alkylsulfonyl group, a sulfonyl group, a cyano group, and a heterocyclic group.

Preferably listed as $R_3$ are methyl, ethyl, i-propyl, t-butyl, cyclohexyl, 1-methylcyclohexyl, and 2-hydroxyethyl. Of these, more preferably listed is 2-hydroxyethyl.

These groups may further have a substituent. Employed as such substituents may be those listed in aforesaid $R_1$.

Further, $R_3$ is more preferably an alkyl group having 1-10 carbon atoms. Specifically listed is the hydroxyl group disclosed in Japanese Patent Application No. 2002-120842, or an alkyl group, such as a 2-hydroxyethyl group, which has as a substituent a group capable of forming a hydroxyl group while being deblocked. In order to achieve high maximum density (Dmax) at a definite silver coverage, namely to result in silver image density of high covering power (CP), sole use or use in combination with other kinds of reducing agents is preferred.

The most preferred combination of $R_2$ and $R_3$ is that $R_2$ is a tertiary alkyl group (t-butyl, or 1-methylcyclohexyl) and $R_3$ is an alkyl group, such as a 2-hydoxyethyl group, which has, as a substituent, a hydroxyl group or a group capable of forming a hydroxyl group while being deblocked. Incidentally, a plurality of $R_2$ and $R_3$ is may be the same or different.

$R_4$ represents a group capable of being substituted to a benzene ring. Listed as specific examples may be an alkyl group having 1-25 carbon atoms (methyl, ethyl, propyl, i-propyl, t-butyl, pentyl, hexyl, or cyclohexyl), a halogenated alkyl group (trifluoromethyl or perfluorooctyl), a cycloalkyl group (cyclohexyl or cyclopentyl); an alkynyl group (propagyl), a glycidyl group, an acrylate group, a methacrylate group, an aryl group (phenyl), a heterocyclic group (pyridyl, thiazolyl, oxazolyl, imidazolyl, furyl, pyrrolyl, pyradinyl, pyrimidyl, pyridadinyl, selenazolyl, piperidinyl, sliforanyl, piperidinyl, pyrazolyl, or tetrazolyl), a halogen atom (chlorine, bromine, iodine or fluorine), an alkoxy group (methoxy, ethoxy, propyloxy, pentyloxy, cyclopentyloxy, hexyloxy, or cyclohexyloxy), an aryloxy group (phenoxy), an alkoxycarbonyl group (methyloxycarbonyl, ethyloxycarbonyl, or butyloxycarbonyl), an aryloxycarbonyl group (phenyloxycarbonyl), a sulfonamido group (methanesulfonamide, ethanesulfonamide, butanesulfonamide, hexanesulfonamide group, cyclohexabesulfonamide, benzenesulfonamide), sulfamoyl group (aminosulfonyl, methyaminosulfonyl, dimethylaminosulfonyl, butylaminosulfonyl, hexylaminosulfonyl, cyclohexylaminosufonyl, phenylaminosulfonyl, or 2-pyridylaminosulfonyl), a urethane group (methylureido, ethylureido, pentylureido, cyclopentylureido, phenylureido, or 2-pyridylureido), an acyl group (acetyl, propionyl, butanoyl, hexanoyl, cyclohexanoyl, benzoyl, or pyridinoyl), a carbamoyl group (aminocarbonyl, methylaminocarbonyl, dimethylaminocarbonyl, propylaminocarbonyl, a pentylaminocarbonyl group, cyclohexylaminocarbonyl, phenylaminocarbonyl, or 2-pyridylaminocarbonyl), an amido group (acetamide, propionamide, butaneamide, hexaneamide, or benzamide), a sulfonyl group (methylsulfonyl, ethylsulfonyl, butylsulfonyl, cyclohexylsulfonyl, phenylsulfonyl, or 2-pyridylsulfonyl), an amino group (amino, ethylamino, dimethylamino, butylamino, cyclopentylamino, anilino, or 2-pyridylamino), a cyano group, a nitro group, a sulfo group, a carboxyl group, a hydroxyl group, and an oxamoyl group. Further, these groups may further be substituted with these groups. Each of n and m represents an integer of 0-2. However, the most preferred case is that both n and m are 0. A plurality of $R_4$s may be the same or different.

Further, $R_4$ may form a saturated ring together with $R_2$ and $R_3$. $R_4$ is preferably a hydrogen atom, a halogen atom, or an alkyl group, and is more preferably a hydrogen atom.

Specific examples of the compounds represented by General Formula (RED) are listed below. However, the present invention is not limited thereto.

(RED-1)

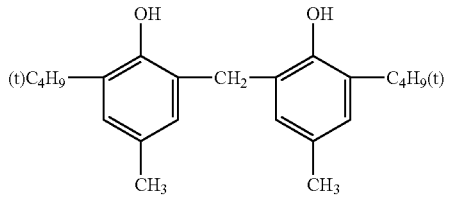

(RED-2)

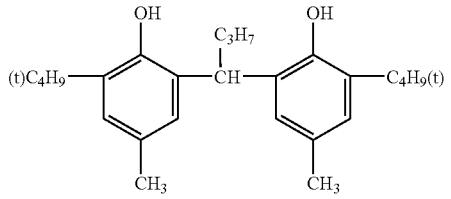

(RED-3)

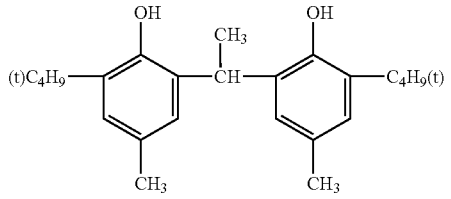

(RED-4)

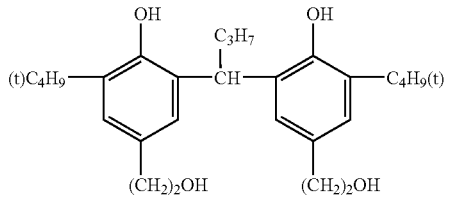

(RED-5)

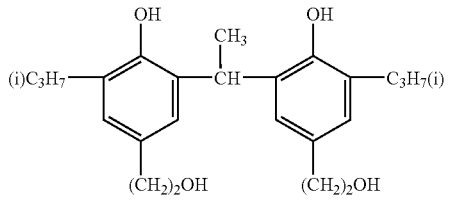

-continued
(RED-6)
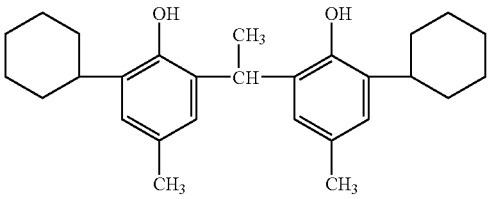
(RED-7)
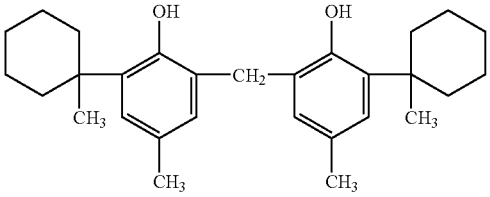
(RED-8)
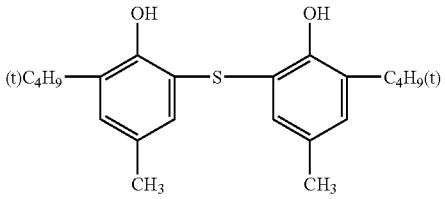
(RED-9)
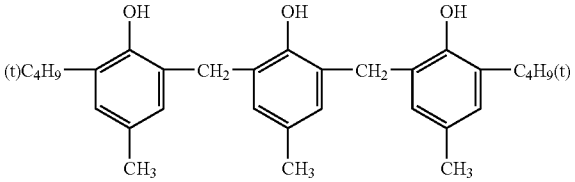
(RED-10)
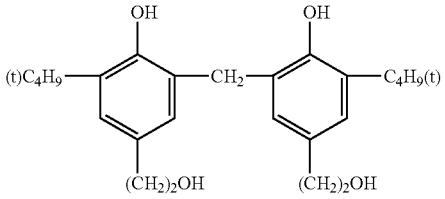
(RED-11)
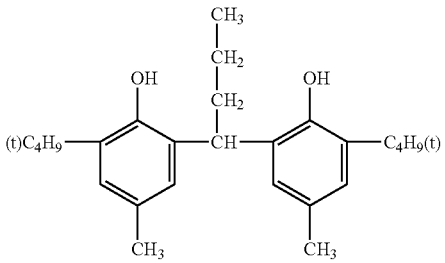
-continued
(RED-12)
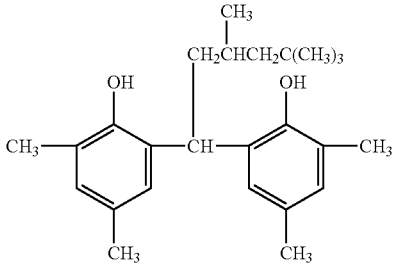
(RED-13)
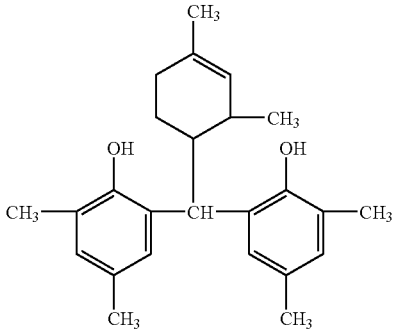
(RED-14)
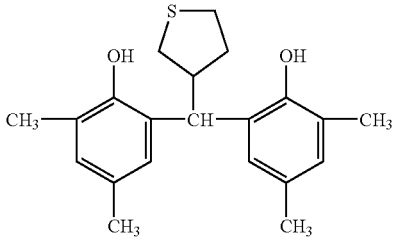
(RED-15)
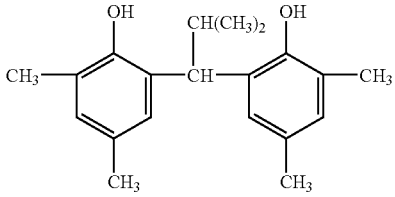
(RED-16)
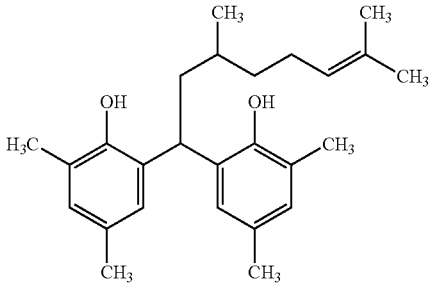
(RED-17)
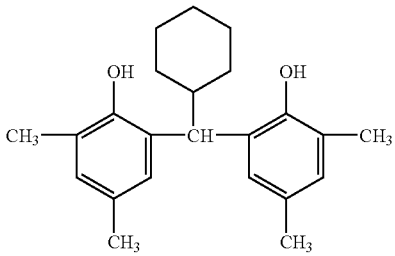

-continued (RED-18)

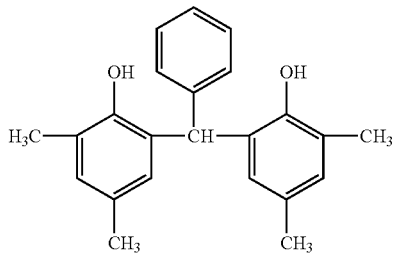

(RED-19)

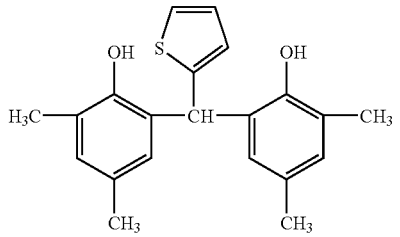

(RED-20)

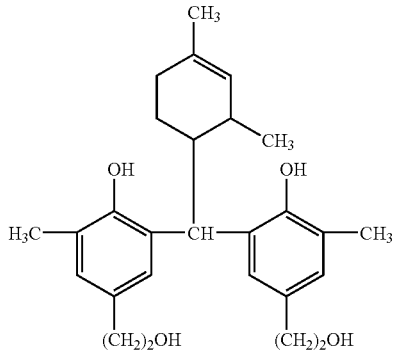

(RED-21)

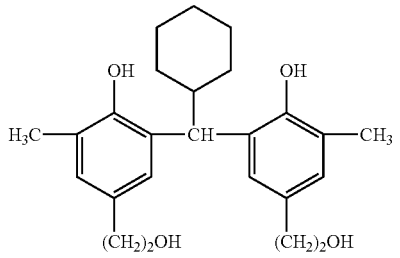

It is possible to synthesize these compounds (bisphenol compounds) represented by General Formula (RED) employing conventional methods known in the art (for example, refer to the reference literature: Japanese Patent Application No. 2002-147562).

The specific examples of the synthesis methods will now be described.

Synthesis of Compound RED-13

Dissolved in 5.94 ml of water was 1.97 g of sodium hydroxide, and subsequently added were 30.1 g of 2,4-xylenol and 15 ml of toluene. Thereafter, the water and toluene were distilled out at 120° C. The resulting reaction solution was then cooled to room temperature, and 13.65 g of 2,4-dimethyl-3-cyclohexanecarboxyaldehyde was added and the resulting mixture was stirred at 120° C. for 8 hours. While distilling out the resulting water, stirring was carried out for 12 hours under heating. Thereafter, heating was terminated. When the reaction solution was cooled to 80° C., 64 ml of heptane was gradually added, whereby the resulting reaction solution was dispersed. After cooling to room temperature by being allowed to stand, a solution prepared by mixing 5.28 g of concentrated hydrochloric acid and 14.4 ml of water were added, and the resulting mixture was stirred for 4 hours. After cooling the resulting mixture employing iced water for an additional 4 hours while stirring, filtration was carried out. Thereafter, washing was carried out employing 54 ml of heptane, whereby crude crystals were obtained. The resulting crude crystals were dissolved in 133 ml of acetonitrile while heated. After filtration, 88 ml of water was added and stirring was carried out for 4 hours at room temperature. Further, stirring was carried out while being cooled employing iced water for an additional 4 hours, and deposited crystals were collected by filtration, whereby 28.8 g (at a yield of 80 percent) of the targeted compound was obtained.

Incidentally, the aforesaid crystals were mixed crystals consisting of 25 percent (being a mol percentage) of cis form and 75 percent of trans form, resulting in a melting point of 198.5-199.5° C.

(Separation Method of the Cis Form)

Employing the same method as above, 100 g of a cis form/trans form mixture was obtained. After dissolving the resulting mixture in 800 ml of acetone while heating, the resulting solution was cooled to room temperature while allowed to stand, and stirring continued throughout the night without any modification. Deposited crystals were collected via filtration and dried under vacuum for 15 hours, whereby crystals comprised of a trans form as a main component were obtained. On the other hand, the mother liquor was concentrated to approximately ⅓ of the original volume, whereby 10.9 g of crystals comprised of cis form as a main component was obtained. The aforesaid mother liquor was further concentrated to ⅔ of the original volume, into which cis form seed crystals were placed while stirring, whereby 3.2 g of cis form crystals as a main component was obtained. Subsequently, dissolved in 100 ml of tetrahydrofuran were the aforesaid two types of crystals comprised of cis form as a main component. Subsequently, while performing partial concentration employing an evaporator, 300 ml of hexane was added and the total volume was concentrated to approximately 100 ml. Thereafter, deposited crystals were collected via filtration and dried at 40° C. for 4 hours under vacuum, whereby 11.1 g of cis form Crystals (1) comprised as a main component was obtained.

The aforesaid mother liquors were collected and concentrated, whereby 24.4 g residue was obtained. All the resulting residue was separated into a fraction containing trans form in a greater amount and a fraction containing the cis form, employing gas chromatography (500 g of silica gel and isopropyl ether/hexane=¼). The residue which was obtained by concentrating the fraction containing cis form in a greater amount was dissolved in tetrahydrofuran, and while performing partial concentration, hexane was added. Deposited crystals were collected via filtration, whereby 12.5 g of cis form crystals as a main component was obtained. The resulting crystals were again dissolved in 100 ml of tetrahydrofuran while added by 300 ml of hexane, and the resulting solution was concentrated to approximately 100 ml. Thereafter, deposited crystals were collected via filtration and dried at 60° C. for 4 hours under vacuum, whereby 7.8 g of cis form Crystals (2) as a main component was obtained.

Subsequently, 11.1 g of aforesaid cis form Crystals (1) as a main component and 7.8 g of Crystals (2) were mixed and dissolved in 300 ml of tetrahydrofuran. After an active carbon treatment, while performing partial concentration, 1,000 ml of hexane was added, and the resulting mixture was concentrated to approximately 300 ml. Thereafter, deposited crystals were collected via filtration and dried at 60° C. for 4 hours under vacuum. The resulting crystals were suspended in 200 ml of hexane, stirred for 30 minutes, and collected via filtration, dried for 15 hours under vacuum, whereby 15.3 g of cis form crystals (at a purity of 99.9 percent) was obtained at a melting point of 190° C.

Synthesis of Compound RED-10

First Step

Placed in a 100 ml 4-necked flask fitted with a refluxing device and a stirrer were 10.0 g ($7.24\times10^{-2}$ mol) of 4-hydroxyphenetyl alcohol, 13.7 g ($1.19\times10^{-1}$ mol) of 85 percent phosphoric acid, and 50.0 ml of toluene. After heating the resulting mixture to 95-100° C. while stirring, a solution consisting of 90 g ($7.96\times10^{-2}$ mol) and 6.00 ml of toluene was dripped over a period of 30 minutes while maintaining the temperature of the solution in the range of 90-100° C.

After completion of the dripping, the resulting mixture was stirred for one hour at the same temperature. Thereafter, the interior temperature was lowered to 50° C., and 25.0 ml of ethyl acetate and 50.0 ml of water were added. Subsequently, the content was transferred to a separating funnel. After performing washing three times employing 50.0 ml of water each time, the pH was adjusted to 6-7 by the addition of an aqueous $Na_2CO_3$ solution. Further, after performing washing employing a saturated sodium chloride solution, the water in the organic layer was removed by $MgSO_4$.

After dehydration, $MgSO_4$ was removed via filtration, and solvents were distilled out under vacuum. After completion of the distilling-out, a product in the form of glutinous starch syrup was obtained, resulting in a yield of 14.0 g. The resulting product was dissolved in 28 ml of toluene, and employed in the subsequent step without any modification.

Second Step

Placed in a 100 ml flask fitted with a refluxing device and a stirrer were the entire first step product (being a toluene solution), 1.4 g ($7.24\times10^{-3}$ mol) of p-tolunesulfonic acid monohydrate, and 1.2 g ($3.98\times10^{-2}$ mol) of paraformaldehyde. The resulting mixture underwent reaction at 70-75° C. for 3 hours.

After completion of the reaction, 30.0 ml of ethyl acetate and 20.0 ml of water were added to the reaction product, and the resulting mixture was then transferred to a separating flask.

Washing was performed employing 20.0 ml of water and the pH was adjusted to 6-7. Further, after washing employing a saturated sodium chloride solution, water in the organic layer was removed employing $MgSO_4$. After dehydration, $MgSO_4$ was removed via filtration, and solvents were distilled out under vacuum. After completion of the distilling-out, a product in the form of a glutinous starch syrup was obtained. The resulting product was subjected to column purification*1. The separated targeted product was dissolved in 11.5 ml of dichloromethane, cooled by iced water and crystallized, whereby crude crystals were obtained, resulting in a crude yield of 9.5 g (65 percent).

Crude crystals were dissolved in 9.5 ml of ethyl acetate and the resulting solution was chilled by iced water to result in crystallization, whereby a targeted product was obtained, resulting in a crude yield of 9.5 g (65 percent). *1: Due to a minute amount of impurities which were formed in the first step, it was difficult to achieve crystallization without any modification, and as a result, column purification was reluctantly performed.

Incidentally, the second step proceeds at a high reaction rate. Therefore, if it is possible to sufficiently remove impurities formed in the first step, the aforesaid column purification becomes unnecessary.

The amount of silver ion reducing agents employed in the photothermographic dry imaging materials of the present invention varies depending on the types of organic silver salts, reducing agents and other additives. However, the aforesaid amount is customarily 0.05-10 mol per mol of organic silver salts, and is preferably 0.1-3 mol. Further, in the aforesaid range, silver ion reducing agents of the present invention may be employed in combinations of at least two types. Namely, in view of achieving images exhibiting excellent storage stability, high image quality and high CP, it is preferable to simultaneously use reducing agents which differ in reactivity, due to a different chemical structure.

In the present invention, preferred cases occasionally occur in which the aforesaid reducing agents are added, just prior to coating, to a photosensitive emulsion comprised of photosensitive silver halide, organic silver salt particles, and solvents and the resulting mixture is coated to minimize variations of photographic performance due to the standing time.

Further, hydrazine derivatives and phenol derivatives represented by General Formulas (1)-(4) in JP-A No. 2003-43614, and General Formulas (1)-(3) in JP-A 2003-66559 are preferably employed as a development accelerator which are simultaneously employed with the aforesaid reducing agents.

The oxidation potential of development accelerators employed in the silver salt photothermographic materials of the present invention, which is determined by polarographic measurement, is preferably lower 0.01-0.4 V, and is more preferably lower 0.01-0.3 V than that of the compounds represented by General Formula (RED). Incidentally, the oxidation potential of the aforesaid development accelerators is preferably 0.2-0.6 V, which is polarographically determined in a solvent mixture of tetrahydrofuran:Britton Robinson buffer solution=3:2 the pH of which is adjusted to 6 employing an SCE counter electrode, and is more preferably 0.3-0.55 V. Further, the pKa value in a solvent mixture of tetrahydrofuran:water=3:1 is preferably 3-12, and is more preferably 5-10. It is particularly preferable that the oxidation potential which is polarographically determined in the solvent mixture of tetrahydrofuran:Britton Robinson buffer solution=3:2, the pH of which is adjusted to 6, employing an SCE counter electrode is 0.3-0.55, and the pKa value in the solvent mixture of tetrahydrofuran:water=3:2 is 5-10.

Further employed as silver ion reducing agents according to the present invention may be various types of reducing agents disclosed in European Patent No. 1,278,101 and JP-A No. 2003-15252.

The amount of silver ion reducing agents employed in the photothermographic imaging materials of the present invention varies depending on the types of organic silver salts, reducing agents, and other additives. However, the aforesaid amount is customarily 0.05-10 mol per mol of organic silver salts and is preferably 0.1-3 mol. Further, in this amount range, silver ion reducing agents of the present invention may be employed in combinations of at least two types. Namely, in view of achieving images exhibiting excellent storage stability, high image quality, and high CP, it is preferable to simultaneously employ reducing agents which differ in reactivity due to different chemical structure.

In the present invention, preferred cases occasionally occur in which when the aforesaid reducing agents are added to and mixed with a photosensitive emulsion comprised of photosensitive silver halide, organic silver salt particles, and solvents just prior to coating, and then coated, variation of photographic performance during standing time is minimized.

The photosensitive silver halide of the present invention may undergo chemical sensitization. For instance, it is possible to create chemical sensitization centers (being chemical sensitization nuclei) utilizing compounds which release chalcogen such as sulfur, as well as noble metal compounds which release noble metals ions, such as gold ions, while employing methods described in, for example, Japanese Patent Application Nos. 2000-057004 and 2000-061942.

The chemical sensitization nuclei is capable of trapping an electron or a hole produced by a photo-excitation of a sensitizing dye.

It is preferable that the aforesaid silver halide is chemically sensitized employing organic sensitizers containing chalcogen atoms, as described below.

It is preferable that the aforesaid organic sensitizers, comprising chalcogen atoms, have a group capable of being adsorbed onto silver halide grains as well as unstable chalcogen atom positions.

Employed as the aforesaid organic sensitizers may be those having various structures, as disclosed in JP-A Nos. 60-150046, 4-109240, and 11-218874. Of these, the aforesaid organic sensitizer is preferably at least one of compounds having a structure in which the chalcogen atom bonds to a carbon atom, or to a phosphorus atom, via a double bond. More specifically, a thiourea derivative having a heterocylic group and a triphenylphosphine derivative are preferred.

Chemical sensitization methods of the present invention can be applied based on a variety of methods known in the field of wet type silver halide materials. Examples are disclosed in: (1) T. H. James ed., "The Theory of the Photographic Process" $4^{th}$ edition, Macmillan Publishing Co., Ltd. 1977; and (2) Japan Photographic Society, "Shashin Kogaku no Kiso" (Basics of Photographic Engineering), Corona Publishing, 1998.

Specifically, when a silver halide emulsion is chemically sensitized, then mixed with a light-insensitive organic silver salt, the conventionally known chemical sensitizing methods ca be applied.

The employed amount of chalcogen compounds as an organic sensitizer varies depending on the types of employed chalcogen compounds, silver halide grains, and reaction environments during performing chemical sensitization, but is preferably from $10^{-8}$ to $10^{-2}$ mol per mol of silver halide, and is more preferably from $10^{-7}$ to $10^{-3}$ mol. The chemical sensitization environments are not particularly limited. However, it is preferable that in the presence of compounds which diminish chalcogenized silver or silver nuclei, or decrease their size, especially in the presence of oxidizing agents capable of oxidizing silver nuclei, chalcogen sensitization is performed employing organic sensitizers, containing chalcogen atoms. The sensitization conditions are that the pAg is preferably from 6 to 11, but is more preferably from 7 to 10, while the pH is preferably from 4 to 10, but is more preferably from 5 to 8. Further, the sensitization is preferably carried out at a temperature of lass than or equal to 30° C.

Accordingly, in the silver salt photothermographic dry imaging material of the present invention, it is preferable to employ a photosensitive emulsion prepared in such a manner that photosensitive silver halide undergoes chemical sensitization at a temperature of less than or equal to 30° C. in the presence of oxidizing agents capable of oxidizing silver nuclei on the grains; and that the resultant silver halide is mixed with aliphatic carboxylic acid silver salts; and further that the resultant mixture is dispersed, followed by dehydration and drying.

Further, it is preferable that chemical sensitization, employing the aforesaid organic sensitizers, is carried out in the presence of either spectral sensitizing dyes or compounds containing heteroatoms, which exhibit the adsorption onto silver halide grains. By carrying out chemical sensitization in the presence of compounds which exhibit adsorption onto silver halide grains, it is possible to minimize the dispersion of chemical sensitization center nuclei, whereby it is possible to achieve higher speed as well as lower fogging. Though spectral sensitizing dyes will be described below, the compounds comprising heteroatoms, which result in adsorption onto silver halide grains, as descried herein, refer to, as preferable examples, nitrogen containing heterocyclic compounds described in JP-A No. 3-24537. Listed as heterocycles in nitrogen-containing heterocyclic compounds may be a pyrazole ring, a pyrimidine ring, a 1,2,4-triazine ring, a 1,2,3-triazole ring, a 1,3,4-thiazole ring, a 1,2,3-thiazole ring, a 1,2,4-thiadiazole ring, a 1,2,5-thiadiazole ring, 1,2,3,4-tetrazole ring, a pyridazine ring, and a 1,2,3-triazine ring, and a ring which is formed by combining 2 or 3 of the rings such as a triazolotriazole ring, a diazaindene ring, a triazaindene ring, and a pentaazaindenes ring. It is also possible to employ heterocyclic rings such as a phthalazine ring, a benzimidazole ring, an indazole ring and a benzthiazole ring, which are formed by condensing a single heterocyclic ring and an aromatic ring.

Of these, preferred is an azaindene ring. Further, preferred are azaindene compounds having a hydroxyl group, as a substituent, which include compounds such as hydroxytriazaindene, tetrahydroxyazaindene, and hydroxypentaazaindene.

The aforesaid heterocyclic ring may have substituents other than a hydroxyl group. As substituents, the aforesaid heterocyclic ring may have, for example, an alkyl group, a substituted alkyl group, an alkylthio group, an amino group, a hydroxyamino group, an alkylamino group, a dialkylamino group, an arylamino group, a carboxyl group, an alkoxycarbonyl group, a halogen atom, and a cyano group.

The added amount of these heterocyclic compounds varies widely depending on the size and composition of silver halide grains, and other conditions. However, the amount is in the range of about $10^{-6}$ to 1 mol per mol with respect to silver halide, and is preferably in the range of $10^{-4}$ to $10^{-1}$ mol.

The photosensitive silver halide of the present invention may undergo noble metal sensitization utilizing compounds which release noble metal ions such as gold ions. For example, employed as gold sensitizers may be chloroaurates and organic gold compounds.

Further, other than the aforesaid sensitization methods, it is possible to employ a reduction sensitization method. Employed as specific compounds for the reduction sensitization may be ascorbic acid, thiourea dioxide, stannous chloride, hydrazine derivatives, boron compounds, silane compounds, and polyamine compounds. Further, it is possible to perform reduction sensitization by ripening an emulsion while maintaining a pH higher than or equal to 7 or a pAg less than or equal to 8.3.

Silver halide which undergoes the chemical sensitization, according to the present invention, includes one which has been formed in the presence of organic silver salts, another which has been formed in the absence of organic silver salts, or still another which has been formed by mixing those above.

In the present invention, it is preferable that the surface of photosensitive silver halide grains undergoes chemical sensitization and the resulting chemical sensitizing effects are substantially lost after the thermal development process. "Chemical sensitization effects are substantially lost after the thermal development process", as described herein, means that the speed of the aforesaid imaging material which has been achieved by the aforesaid chemical sensitization techniques decreases to 1.1 times or less compared to the speed of aforesaid material which does not undergo chemical sensitization.

In order to decrease the effect of chemical sensitization after thermal development treatment, it is required to incorporate sufficient amount of an oxidizing agent capable to destroy the center of chemical sensitization by oxidation in an photosensitive emulsion layer or non-photosensitive layer of the imaging material. An example of such compound is a aforementioned compound which release a halogen radical. An amount of incorporated oxidizing agent is preferably adjusted by considering an oxidizing power of the oxidizing agent and the degree of the decrease the effect of chemical sensitization.

It is preferable that photosensitive silver halide in the present invention is adsorbed by spectral sensitizing dyes so as to result in spectral sensitization. Employed as spectral sensitizing dyes may be cyanine dyes, merocyanine dyes, complex cyanine dyes, complex merocyanine dyes, homopolar cyanine dyes, styryl dyes, hemicyanine dyes, oxonol dyes, and hemioxonol dyes. For example, employed may be sensitizing dyes described in JP-A Nos. 63-159841, 60-140335, 63-231437, 63-259651, 63-304242, and 63-15245, and U.S. Pat. Nos. 4,639,414, 4,740,455, 4,741,966, 4,751,175, and 4,835,096.

Useful sensitizing dyes, employed in the present invention, are described in, for example, Research Disclosure, Item 17645, Section IV-A (page 23, December 1978) and Item 18431, Section X (page 437, August 1978) and publications further cited therein. It is specifically preferable that those sensitizing dyes are used which exhibit spectral sensitivity suitable for spectral characteristics of light sources of various types of laser imagers, as well as of scanners. For example, preferably employed are compounds described in JP-A Nos. 9-34078, 9-54409, and 9-80679.

Useful cyanine dyes include, for example, cyanine dyes having basic nuclei such as a thiazoline nucleus, an oxazoline nucleus, a pyrroline nucleus, a pyridine nucleus, an oxazole nucleus, a thiazole nucleus, a selenazole nucleus, and an imidazole nucleus. Useful merocyanine dyes, which are preferred, comprise, in addition to the basic nuclei, acidic nuclei such as a thiohydantoin nucleus, a rhodanine nucleus, an oxazolizinedione nucleus, a thiazolinedione nucleus, a barbituric acid nucleus, a thiazolinone nucleus, a marononitryl nucleus, and a pyrazolone nucleus.

In the present invention, it is possible to employ sensitizing dyes which exhibit spectral sensitivity, specifically in the infrared region. Listed as preferably employed infrared spectral sensitizing dyes are infrared spectral sensitizing dyes disclosed in U.S. Pat. Nos. 4,536,473, 4,515,888, and 4,959,294.

It is preferred that the imaging material of the present invention incorporates at least one sensitizing dye represented by the following General Formulas (SD-1) or (SD-2).

General Formula (SD-1)

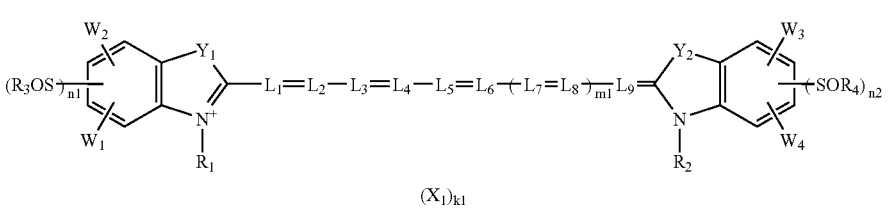

General Formula (SD-2)

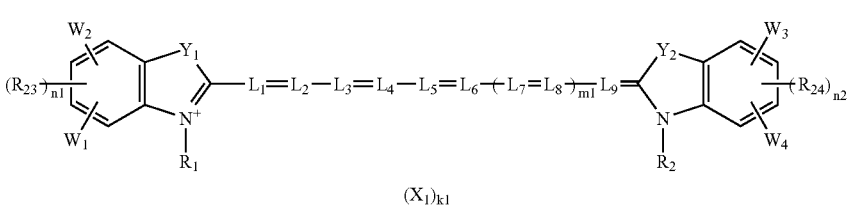

wherein $Y_1$ and $Y_2$ each represent an oxygen atom, a sulfur atom, a selenium atom, or —CH=CH—; $L_1$-$L_9$ each represent a methine group; $R_1$ and $R_2$ each represent an aliphatic group; $R_3$, $R_4$, $R_{23}$, and $R_{24}$ each represent a lower alkyl group, a cycloalkyl group, an alkenyl group, an aralkyl group, an aryl group, or a heterocyclic group; $W_1$, $W_2$, $W_3$, and $W_4$ each represent a hydrogen atom, a substituent, or a group of non-metallic atoms necessary for forming a condensed ring while combined between $W_1$ and $W_2$ and $W_3$ and $W_4$ or represent a group of non-metallic atoms necessary for forming a 5- or 6-membered condensed ring while combined between $R_3$ and $W_1$, $R_3$ and $W_2$, $R_{23}$ and $W_1$, $R_{23}$ and $W_2$, $R_4$ and $W_3$, $R_4$ and $W_4$, $R_{24}$ and $W_3$, or $R_{24}$ and $W_4$; $X_1$ represents an ion necessary for neutralizing the charge in the molecule; $k_1$ represents the number of ions necessary for neutralizing the charge in the molecule; m1 represents 0 or 1; and n1 and n2 each represent 0, 1, or 2, however, n1 and n2 should not represent 0 at the same time.

It is possible to easily synthesize the aforesaid infrared sensitizing dyes, employing the method described in F. M. Harmer, "The Chemistry of Heterocyclic Compounds, Volume 18, The Cyanine Dyes and Related Compounds (A. Weissberger ed., published by Interscience, New York, 1964).

These infrared sensitizing dyes may be added at any time after preparing the silver halide. For example, the dyes may be added to solvents, or the dyes, in a so-called solid dispersion state in which the dyes are dispersed into minute particles, may be added to a photosensitive emulsion comprising silver halide grains or silver halide grains/aliphatic carboxylic acid silver salts. Further, in the same manner as the aforesaid heteroatoms containing compounds which exhibit adsorption onto silver halide grains, the dyes are adsorbed onto silver halide grains prior to chemical sensitization, and subsequently, undergo chemical sensitization, whereby it is possible to minimize the dispersion of chemical sensitization center nuclei so at to enhance speed, as well as to decrease fogging.

In the present invention, the aforesaid spectral sensitizing dyes may be employed individually or in combination. Combinations of sensitizing dyes are frequently employed when specifically aiming for supersensitization, for expanding or adjusting a spectral sensitization range.

An emulsion comprising photosensitive silver halide as well as aliphatic carboxylic acid silver salts, which are employed in the silver salt photothermographic dry imaging material of the present invention, may comprise sensitizing dyes together with compounds which are dyes having no spectral sensitization or have substantially no absorption of visible light and exhibit supersensitization, whereby the aforesaid silver halide grains may be supersensitized.

Useful combinations of sensitizing dyes and dyes exhibiting supersensitization, as well as materials exhibiting supersensitization, are described in Research Disclosure Item 17643 (published December 1978), page 23, Section J of IV; Japanese Patent Publication Nos. 9-25500 and 43-4933; and JP-A Nos. 59-19032, 59-192242, and 5-431432. Preferred as supersensitizers are hetero-aromatic mercapto compounds or mercapto derivatives.

Ar—SM wherein M represents a hydrogen atom or an alkali metal atom, and Ar represents an aromatic ring or a condensed aromatic ring, having at least one of a nitrogen, sulfur, oxygen, selenium, or tellurium atom. Hetero-aromatic rings are preferably benzimidazole, naphthoimidazole, benzimidazole, naphthothiazole, benzoxazole, naphthooxazole, benzoselenazole, benztellurazole, imidazole, oxazole, pyrazole, triazole, triazine, pyrimidine, pyridazine, pyrazine, pyridine, purine, quinoline, or quinazoline. On the other hand, other hetero-aromatic rings are also included.

Incidentally, mercapto derivatives, when incorporated in the dispersion of aliphatic carboxylic acid silver salts and/or a silver halide grain emulsion, are also included which substantially prepare the mercapto compounds. Specifically, listed as preferred examples are the mercapto derivatives described below.

Ar—S—S—Ar wherein Ar is the same as the mercapto compounds defined above.

The aforesaid hetero-aromatic rings may have a substituent selected from the group consisting of, for example, a halogen atom (for example, Cl, Br, and I), a hydroxyl group, an amino group, a carboxyl group, an alkyl group (for example, an alkyl group having at least one carbon atom and preferably having from 1 to 4 carbon atoms), and an alkoxy group (for example, an alkoxy group having at least one carbon atom and preferably having from 1 to 4 carbon atoms).

Other than the aforesaid supersensitizers, employed as supersensitizers may be compounds represented by General Formula (5), shown below, which is disclosed in Japanese Patent Application No. 2000-070296 and large ring compounds containing a hetero atom.

The amount of a supersensitizer of the present invention used in a photosensitive layer containing an organic silver salt and silver halide grains and in the present invention is in the range of 0.001 to 1.0 mol per mol of Ag. More preferably, it is 0.01 to 0.5 mol per mol of Ag.

In the present invention, either a photosensitive layer or a light-insensitive layer may comprise silver saving agents.

The silver saving agents, used in the present invention, refer to compounds capable of reducing the silver amount to obtain a definite silver image density. Even though various mechanisms may be considered to explain functions regarding a decrease in the silver amount, compounds having functions to enhance covering power of developed silver are preferable. The covering power of developed silver, as described herein, refers to optical density per unit amount of silver. These silver saving agents may be incorporated in either a photosensitive layer or a light-insensitive layer or in both such layers.

Listed as preferred examples of silver saving agents are hydrazine derivatives represented by General Formula (H) described below, vinyl compounds represented by General Formula (G) described below, and quaternary onium compounds represented by General Formula (P) described below.

General Formula (H)

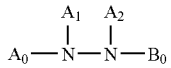

General Formula (G)

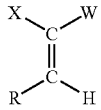

General Formula (P)

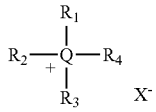

In General Formula (H), $A_0$ represents an aliphatic group, an aromatic group, a heterocyclic group, or a $-G_0-D_0$ group, each of which may have a substituent; $B_0$ represents a blocking group; and $A_1$ and $A_2$ each represents a hydrogen atom, or one represents a hydrogen atom and the other represents an acyl group, a sulfonyl group, or a oxalyl group. Herein, $G_0$ represents a —CO— group, a —COCO— group, a —CS— group, a $—C(=NG_1D_1)$ group, a —SO— group, a $—SO_2—$ group, or a $—P(O)(G_1D_1)$ group, wherein $G_1$ represents a simple bonding atom or a group such as an —O— group, a —S— group, or an $—N(D_1)$ group, wherein $D_1$ represents an aliphatic group, an aromatic group, a heterocyclic group, or a hydrogen atom; when there is a plurality of $D_1$ in the molecule, those may be the same or different; and $D_0$ represents a hydrogen atom, an aliphatic group, an aromatic group, a heterocyclic group, an amino group, an alkoxy group, an aryloxy group, an alkylthio group, or an arylthio group. Listed as preferred $D_0$ are a hydrogen atom, an alkyl group, an alkoxy group, and an amino group.

In General Formula (H), the aliphatic group represented by $A_0$ is preferably a straight chain, branched, or cyclic alkyl group having from 1 to 30 carbon atoms and more preferably from 1 to 20 carbon atoms. Listed as the alkyl groups are, for example, a methyl group, an ethyl group, a t-butyl group, an octyl group, a cyclohexyl group, and a benzyl group. The groups may be substituted with a suitable substituent (for example, an aryl group, an alkoxy group, an aryloxy group, an alkylthio group, an aryl-thio group, a sulfoxyl group, a sulfonamido group, a sulfamoyl group, an acylamino group, and a ureido group).

In General Formula (H), the aromatic group represented by $A_0$ is preferably a single ring or fused ring aryl group. Listed as examples are a benzene ring or a naphthalene ring. Preferably listed as heterocyclic groups represented by $A_0$ are those containing at least one heteroatom selected from nitrogen, sulfur and oxygen atoms. Listed as examples are a pyrrolidine ring, an imidazole ring, a tetrahydrofuran ring, a morpholine ring, a pyridine ring, a pyrimidine ring, a quinoline ring, a thiazole ring, a benzothiazole ring, a thiophene ring, and a furan ring. The aromatic ring, heterocyclic group, and $-G_0-D_0$ group may each have a substituent. Particularly preferred as $A_0$ are an aryl group and a $-G_0-D_0-$ group.

Further, in General Formula (H), $A_0$ preferably contains at least one of non-diffusive groups or silver halide adsorbing groups. Preferred as the non-diffusive groups are ballast groups which are commonly employed for immobilized photographic additives such as couplers. Listed as ballast groups are an alkyl group, an alkenyl group, an alkynyl group, an alkoxy group, a phenyl group, a phenoxy group, and an alkylphenoxy group, which are photographically inactive. The total number of carbon atoms of the portion of the substituent is preferably at least 8.

In General Formula (H), listed as silver halide adsorption enhancing groups are thiourea, a thiourethane group, a mercapto group, a thioether group, a thione group, a heterocyclic group, a thioamido heterocyclic group, a mercapto heterocyclic group, or the adsorption group described in JP-A No. 64-90439.

In General Formula (H), $B_0$ represents a blocking group, and preferably represents $-G_0-D_0$ group, wherein $G_0$ represents a —CO— group, a —COCO— group, a —CS— group, a $—C(=NG_1D_1)$ group, an —SO— group, an $—SO_2—$ group, or a $—P(O)(G_1D_1)$ group. Listed as preferred $G_0$ are a —CO— group and a —COCO— group. $G_1$ represents a simple bonding atom or group such as an —O— atom, an —S— atom or an $—N(D_1)$ group, wherein $D_1$ represents an aliphatic group, an aromatic group, a heterocyclic group, or a hydrogen atom, and when there is a plurality of $D_1$ in a molecule, they may be the same or different. $D_0$ represents a hydrogen atom, an aliphatic group, an aromatic group, a heterocyclic group, an amino group, an alkoxy group, an aryloxy group, an alkylthio group, and an arylthio group. Listed as preferred $D_0$ are a hydrogen atom, an alkyl group, an alkoxy group, or an amino group. $A_1$ and $A_2$ each represents a hydrogen atom, or when one represents a hydrogen atom, the other represents an acyl group (such as an acetyl group, a trifluoroacetyl group, and a benzoyl group), a sulfonyl group (such as a methanesulfonyl group and a toluenesulfonyl group), or an oxalyl group (such as an ethoxalyl group)

The compounds represented by General Formula (H) can be easily synthesized employing methods known in the art. They can be synthesized based on, for example, U.S. Pat. Nos. 5,464,738 and 5,496,695.

Other than those, preferably usable hydrazine derivatives include Compounds H-1 through H-29 described in columns 11 through 20 of U.S. Pat. No. 5,545,505, and Compounds 1 through 12 in columns 9 through 11 of U.S. Pat. No. 5,464,738. The hydrazine derivatives can be synthesized employing methods known in the art.

In General Formula (G), X as well as R are illustrated utilizing a cis form, while X and R include a trans form. This is applied to the structure illustration of specific compounds.

In General Formula (G), X represents an electron attractive group, while W represents a hydrogen atom, an alkyl group, an alkenyl group, an alkynyl group, an aryl group, a heterocyclic group, a halogen atom, an acyl group, a thioacyl group, an oxalyl group, an oxyoxalyl group, a thioxyalyl group, an oxamoyl group, an oxycarbonyl group, a thiocarbonyl group, a carbamoyl group, a thiocarbamoyl group, a sulfonyl group, a sulfinyl group, an oxysulfinyl group, a thiosulfinyl group, a sulfamoyl group, an oxysulfinyl group, a thiosulfinyl group, a sulfamoyl group, a phosphoryl group, a nitro group, an imino group, an N-carbonylimino group, an N-sulfonylimino group, a dicyanoethylene group, an ammonium group, a sulfonium group, a phosphonium group, a pyrylium group, and an immonium group.

R represents a halogen atom, a hydroxyl group, an alkoxy group, an aryloxy group, a heterocyclic oxy group, an alkenyloxy group, an acyloxy group, an alkoxycarbonyloxy group, an aminocarbonyloxy group, a mercapto group, an alkylthio group, an arylthio group, a heterocyclic thio group, an alkenylthio group, an acylthio group, an alkoxycarbonylthio group, an aminocarbonylthio group, a hydroxyl group, an organic or inorganic salt (for example, a sodium salt, a potassium salt, and a silver salt) of a mercapto group, an amino group, an alkylamino group, a cyclic amino group (for example, a pyrrolidino group), an acylamino group, an oxycarbonylamino group, a heterocyclic group (a nitrogen-containing 5- or 6-membered heterocyclic ring such as a benztriazolyl group, an imidazolyl group, a triazolyl group, and a tetrazolyl group), a ureido group, and a sulfonamido group. X and W may be joined together to form a ring structure, while X and R may also be joined together in the same manner. Listed as rings which are formed by X and W are, for example, pyrazolone, pyrazolidinone, cyclopentanedione, β-ketolactone, β-ketolactum.

General Formula (G) will be described further. The electron attractive group represented by X refers to the substituent of which substituent constant σp is able to take a positive value. Specifically, included are a substituted alkyl group (such as a halogen-substituted alkyl group), a substituted alkenyl group (such as a cyanovinyl group), a substituted or unsubstituted alkynyl group (such as a trifluoromethylacetylenyl group and a cyanoacetylenyl group), a substituted aryl group (such as a cyanophenyl group), a substituted or unsubstituted heterocyclic group (such as a pyridyl group, a triazinyl group, or a benzoxazolyl group), a halogen atom, a cyano group, an acyl group (such as an acetyl group, a trifluoroacetyl group, and a formyl group), a thioacetyl group (such as a thioacetyl group and a thioformyl group), an oxalyl group (such as a methyloxalyl group), an oxyoxalyl group (such as an ethoxyoxalyl group), a thiooxyalyl group (such as an ethylthiooxyalyl group), an oxamoyl group (such as a methyloxamoyl group), an oxycarbonyl group (such as an ethoxycarbonyl group), a carboxyl group, a thiocarbonyl group (such as an ethylthiocarbonyl group), a carbamoyl group, a thiocarbamoyl group, a sulfonyl group, a sulfinyl group, an oxysulfonyl group (such as an ethoxysulfonyl group), a thiosulfonyl group (such as an ethylthiosulfonyl group), a sulfamoyl group, an oxysulfinyl group (such as a methoxysulfinyl group), a thiosulfinyl group (such as a methylthiosulfinyl group), a sulfinamoyl group, a phosphoryl group, a nitro group, an imino group, an N-carbonylimino group (such as an N-acetylimino group), an N-sulfonylimino group (such as an N-methanesulfonylimino group), a dicyanoethylene group, an ammonium group, a sulfonium group, a phosphonium group, a pyrylium group, and an immonium group. However, also included are heterocyclic rings which are formed employing an ammonium group, a sulfonium group, a phosphonium group, or an immonium group. Substituents having a σp value of at least 0.30 are particularly preferred.

Alkyl groups represented by W include a methyl group, an ethyl group, and a trifluoromethyl group; alkenyl groups represented by W include a vinyl group, a halogen-substituted vinyl group, and a cyanovinyl group; aryl groups represented by W include a nitrophenol group, a cyanophenyl group, and a pentafluorophenyl group; heterocyclic groups represented by W include a pyridyl group, a triazinyl group, a succinimido group, a tetrazolyl group, an imidazolyl group, and a benzoxyazolyl group. Preferred as W are electron attractive groups having a positive σp value, and more preferred are those having a σp value of at least 0.30.

Of the aforesaid substituents of R, preferably listed are a hydroxyl group, a mercapto group, an alkoxy group, an alkylthio group, a halogen atom, an organic or inorganic salt of a hydroxyl group or a mercapto group, and a heterocyclic group, and of these, more preferably listed are a hydroxyl group, and an organic or inorganic salt of a hydroxyl group or a mercapto group.

Further, of the aforesaid substituents of X and W, preferred are those having an thioether bond in the substituent.

In General Formula (P), Q represents a nitrogen atom or a phosphorus atom; $R_1$, $R_2$, $R_3$, and $R_4$ each represents a hydrogen atom or a substituents; and $X^-$ represents an anion. Incidentally, $R_1$ through $R_4$ may be joined together to form a ring.

Listed as substituents represented by $R_1$ through $R_4$ are an alkyl group (such as a methyl group, an ethyl group, a propyl group, a butyl group, a hexyl group, and a cyclohexyl group), an alkenyl group (such as an allyl group and a butenyl group), an alkynyl group (such as a propargyl group and a butynyl group), an aryl group (such as a phenyl group and a naphthyl group), a heterocyclic group (such as a piperidinyl group, a piperazinyl group, a morpholinyl group, a pyridyl group, a furyl group, a thienyl group, a tetrahydrofuryl group, a tetrahydrothienyl group, and a sulforanyl group), and an amino group.

Listed as rings which are formed by joining $R_1$ through $R_4$ are a piperidine ring, a morpholine ring, a piperazine ring, quinuclidine ring, a pyridine ring, a pyrrole ring, an imidazole ring, a triazole ring, and a tetrazole ring.

Groups represented by $R_1$ through $R_4$ may have a substituent such as a hydroxyl group, an alkoxy group, an aryloxy group, a carboxyl group, a sulfo group, an alkyl group, and an aryl group. $R_1$, $R_2$, $R_3$, and $R_4$ each is preferably a hydrogen atom or an alkyl group.

Listed as anions represented by $X^-$ are inorganic or organic anions such as a halogen ion, a sulfate ion, a nitrate ion, an acetate ion, and a p-toluenesulfonate ion.

The aforesaid quaternary onium compounds can easily be synthesized employing methods known in the art. For instance, the aforesaid tetrazolium compounds can be synthesized based on the method described in Chemical Reviews Vol. 55. pages 335 through 483. The added amount of the aforesaid silver saving agents is commonly from $10^{-5}$ to 1 mol with respect to mol of aliphatic carboxylic acid silver salts, and is preferably from $10^{-4}$ to $5\times10^{-1}$ mol.

In the present invention, it is preferable that at least one of silver saving agents is a silane compound.

The silane compounds employed as a silver saving agent in present invention are preferably alkoxysilane compounds having at least two primary or secondary amino groups or salts thereof, as described in Japanese Patent Application No. 2003-5324.

When alkoxysilane compounds or salts thereof or Schiff bases are incorporated in the image forming layer as a silver saving agent, the added amount of these compound is preferably in the range of 0.00001 to 0.05 mol per mol of silver. Further, both of alkoxysilane compounds or salt thereof and Schiff bases are added, the added amount is in the same range as above.

<Binder>

Suitable binders for the silver salt photothermographic material of the present invention are to be transparent or translucent and commonly colorless, and include natural polymers, synthetic resin polymers and copolymers, as well as media to form film. The binders include, for example, gelatin, gum Arabic, casein, starch, poly(acrylic acid), poly (methacrylic acid), poly(vinyl chloride), poly(methacrylic acid), copoly(styrene-maleic anhydride), coply(styrene-acrylonitrile), coply(styrene-butadiene), poly(vinyl acetals) (for example, poly(vinyl formal) and poly(vinyl butyral), poly(esters), poly(urethanes), phenoxy resins, poly(vinylidene chloride), poly(epoxides), poly(carbonates), poly (vinyl acetate), cellulose esters, poly(amides). The binders may be hydrophilic or hydrophobic.

Preferable binders for the photosensitive layer of the silver salt photothermographic dry imaging material of the present invention are poly(vinyl acetals), and a particularly preferable binder is poly(vinyl butyral), which will be detailed hereunder. Polymers such as cellulose esters, especially polymers such as triacetyl cellulose, cellulose acetate butyrate, which exhibit higher softening temperature, are preferable for an overcoating layer as well as an undercoating layer, specifically for a light-insensitive layer such as a protective layer and a backing layer. Incidentally, if desired, the binders may be employed in combination of at least two types.

Such binders are employed in the range of a proportion in which the binders function effectively. Skilled persons in the art can easily determine the effective range. For example, preferred as the index for maintaining aliphatic carboxylic acid silver salts in a photosensitive layer is the proportion range of binders to aliphatic carboxylic acid silver salts of 15:1 to 1:2 and most preferably of 8:1 to 1:1. Namely, the binder amount in the photosensitive layer is preferably from 1.5 to 6 g/m$^2$, and is more preferably from 1.7 to 5 g/m$^2$. When the binder amount is less than 1.5 g/m$^2$, density of the unexposed portion markedly increases, whereby it occasionally becomes impossible to use the resultant material.

In the present invention, it is preferable that thermal transition point temperature, after development is at higher or equal to 100° C., is from 46 to 200° C. and is more preferably from 70 to 105° C. Thermal transition point temperature, as described in the present invention, refers to the VICAT softening point or the value shown by the ring and ball method, and also refers to the endothermic peak which is obtained by measuring the individually peeled photosensitive layer which has been thermally developed, employing a differential scanning calorimeter (DSC), such as EXSTAR 6000 (manufactured by Seiko Denshi Co.), DSC220C (manufactured by Seiko Denshi Kogyo Co.), and DSC-7 (manufactured by Perkin-Elmer Co.). Commonly, polymers exhibit a glass transition point, Tg. In silver salt photothermographic dry imaging materials, a large endothermic peak appears at a temperature lower than the Tg value of the binder resin employed in the photosensitive layer. The inventors of the present invention conducted diligent investigations while paying special attention to the thermal transition point temperature. As a result, it was discovered that by regulating the thermal transition point temperature to the range of 46 to 200° C., durability of the resultant coating layer increased and in addition, photographic characteristics such as speed, maximum density and image retention properties were markedly improved. Based on the discovery, the present invention was achieved.

The glass transition temperature (Tg) is determined employing the method, described in Brandlap, et al., "Polymer Handbook", pages from III-139 through III-179, 1966 (published by Wiley and Son Co.). The Tg of the binder comprised of copolymer resins is obtained based on the following formula.

$$\text{Tg of the copolymer (in ° C.)} = v_1Tg_1 + v_2Tg_2 + \ldots + v_nTg_n$$

wherein $v_1$, $v_2$, . . . $v_n$ each represents the mass ratio of the monomer in the copolymer, and $Tg_1$, $Tg_2$, . . . $Tg_n$ each represents Tg (in ° C.) of the homopolymer which is prepared employing each monomer in the copolymer. The accuracy of Tg, calculated based on the formula calculation, is ±5° C.

In the silver salt photothermographic dry imaging material of the present invention, employed as binders, which are incorporated in the photosensitive layer, on the support, comprising aliphatic carboxylic acid silver salts, photosensitive silver halide grains and reducing agents, may be conventional polymers known in the art. The polymers have a Tg of 70 to 105° C., a number average molecular weight of 1,000 to 1,000,000, preferably from 10,000 to 500,000, and a degree of polymerization of about 50 to about 1,000. Examples of such polymers include polymers or copolymers comprised of constituent units of ethylenic unsaturated monomers such as vinyl chloride, vinyl acetate, vinyl alcohol, maleic acid, acrylic acid, acrylic acid esters, vinylidene chloride, acrylonitrile, methacrylic acid, methacrylic acid esters, styrene, butadiene, ethylene, vinyl butyral, and vinyl acetal, as well as vinyl ether, and polyurethane resins and various types of rubber based resins.

Further listed are phenol resins, epoxy resins, polyurethane hardening type resins, urea resins, melamine resins, alkyd resins, formaldehyde resins, silicone resins, epoxy-polyamide resins, and polyester resins. Such resins are detailed in "Plastics Handbook", published by Asakura Shoten. These polymers are not particularly limited, and may be either homopolymers or copolymers as long as the resultant glass transition temperature, Tg is in the range of 70 to 105° C.

Listed as homopolymers or copolymers which comprise the ethylenic unsaturated monomers as constitution units are alkyl acrylates, aryl acrylates, alkyl methacrylates, aryl methacrylates, alkyl cyano acrylate, and aryl cyano acrylates, in which the alkyl group or aryl group may not be substituted. Specific alkyl groups and aryl groups include a methyl group, an ethyl group, an n-propyl group, an isopropyl group, an n-butyl group, an isobutyl group, a sec-butyl group, a tert-butyl group, an amyl group, a hexyl group, a cyclohexyl group, a benzyl group, a chlorophenyl group, an octyl group, a stearyl group, a sulfopropyl group, an N-ethyl-phenylaminoethyl group, a 2-(3-phenylpropyloxy) ethyl group, a dimethylaminophenoxyethyl group, a furfuryl group, a tetrahydrofurfuryl group, a phenyl group, a cresyl group, a naphthyl group, a 2-hydroxyethyl group, a 4-hydroxybutyl group, a triethylene glycol group, a dipropylene glycol group, a 2-methoxyethyl group, a 3-methoxybutyl group, a 2-actoxyethyl group, a 2-acetacttoxyethyl group, a 2-methoxyethyl group, a 2-iso-proxyethyl group, a 2-butoxyethyl group, a 2-(2-methoxyethoxy)ethyl group, a 2-(2-ethoxyetjoxy)ethyl group, a 2-(2-bitoxyethoxy)ethyl group, a 2-diphenylphsophorylethyl group, an ω-methoxypolyethylene glycol (the number of addition mol n=6), an ally group, and dimethylaminoethylmethyl chloride.

In addition, employed may be the monomers described below. Vinyl esters: specific examples include vinyl acetate, vinyl propionate, vinyl butyrate, vinyl isobutyrate, vinyl corporate, vinyl chloroacetate, vinyl methoxyacetate, vinyl phenyl acetate, vinyl benzoate, and vinyl salicylate; N-substituted acrylamides, N-substituted methacrylamides and acrylamide and methacrylamide: N-substituents include a methyl group, an ethyl group, a propyl group, a butyl group, a tert-butyl group, a cyclohexyl group, a benzyl group, a hydroxymethyl group, a methoxyethyl group, a dimethylaminoethyl group, a phenyl group, a dimethyl group, a diethyl group, a β-cyanoethyl group, an N-(2-acetacetoxyethyl) group, a diacetone group; olefins: for example, dicyclopentadiene, ethylene, propylene, 1-butene, 1-pentane, vinyl chloride, vinylidene chloride, isoprene, chloroprene, butadiene, and 2,3-dimethylbutadiene; styrenes; for example, methylstyrene, dimethylstyrene, trimethylstyrene, ethylstyrene, isopropylstyrene, tert-butylstyrene, chloromethylstryene, methoxystyrene, acetoxystyrene, chlorostyrene, dichlorostyrene, bromostyrene, and vinyl methyl benzoate; vinyl ethers: for example, methyl vinyl ether, butyl vinyl ether, hexyl vinyl ether, methoxyethyl vinyl ether, and dimethylaminoethyl vinyl ether; N-substituted maleimides: N-substituents include a methyl group, an ethyl group, a propyl group, a butyl group, a tert-butyl group, a cyclohexyl group, a benzyl group, an n-dodecyl group, a phenyl group, a 2-methylphenyl group, a 2,6-diethylphenyl group, and a 2-chlorophenyl group; others include butyl crotonate, hexyl crotonate, dimethyl itaconate, dibutyl itaconate, diethyl maleate, dimethyl maleate, dibutyl maleate, diethyl fumarate, dimethyl fumarate, dibutyl fumarate, methyl vinyl ketone, phenyl vinyl ketone, methoxyethyl vinyl ketone, glycidyl acrylate, glycidyl methacrylate, N-vinyl oxazolidone, N-vinyl pyrrolidone, acrylonitrile, metaacrylonitrile, methylene malonnitrile, vinylidene chloride.

Of these, listed as preferable examples are alkyl methacrylates, aryl methacrylates, and styrenes. Of such polymers, those having an acetal group are preferably employed because they exhibit excellent compatibility with the resultant aliphatic carboxylic acid, whereby an increase in flexibility of the resultant layer is effectively minimized.

Particularly preferred as polymers having an acetal group are the compounds represented by General Formula (V) described below.

General Formula (V)

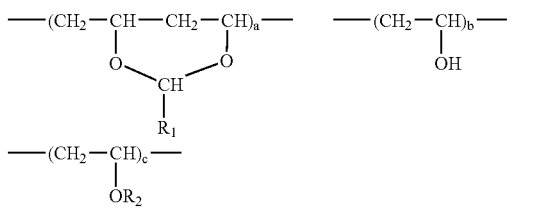

wherein $R_1$ represents a substituted or unsubstituted alkyl group, and a substituted or unsubstituted aryl group, however, groups other than the aryl group are preferred; $R_2$ represents a substituted or unsubstituted alkyl group, a substituted or unsubstituted aryl group, —$COR_3$ or —$CONHR_3$, wherein $R_3$ represents the same as defined above for $R_1$.

Unsubstituted alkyl groups represented by $R_1$, $R_2$, and $R_3$ preferably have from 1 to 20 carbon atoms and more preferably have from 1 to 6 carbon atoms. The alkyl groups may have a straight or branched chain, but preferably have a straight chain. Listed as such unsubstituted alkyl groups are, for example, a methyl group, an ethyl group, an n-propyl group, an isopropyl group, an n-butyl group, an isobutyl group, a t-butyl group, an n-amyl group, a t-amyl group, an n-hexyl group, a cyclohexyl group, an n-heptyl group, an n-octyl group, a t-octyl group, a 2-ethylhexyl group, an n-nonyl group, an n-decyl group, an n-dodecyl group, and an n-octadecyl group. Of these, particularly preferred is a methyl group or a propyl group.

Unsubstituted aryl groups preferably have from 6 to 20 carbon atoms and include, for example, a phenyl group and a naphthyl group. Listed as groups which can be substituted for the alkyl groups as well as the aryl groups are an alkyl group (for example, a methyl group, an n-propyl group, a t-amyl group, a t-octyl group, an n-nonyl group, and a dodecyl group), an aryl group (for example, a phenyl group), a nitro group, a hydroxyl group, a cyano group, a sulfo group, an alkoxy group (for example, a methoxy group), an aryloxy group (for example, a phenoxy group), an acyloxy group (for example, an acetoxy group), an acylamino group (for example, an acetylamino group), a sulfonamido group (for example, methanesulfonamido group), a sulfamoyl group (for example, a methylsulfamoyl group), a halogen atom (for example, a fluorine atom, a chlorine atom, and a bromine atom), a carboxyl group, a carbamoyl group (for example, a methylcarbamoyl group), an alkoxycarbonyl group (for example, a methoxycarbonyl group), and a sulfonyl group (for example, a methylsulfonyl group). When at least two of the substituents are employed, they may be the same or different. The number of total carbons of the substituted alkyl group is preferably from 1 to 20, while the number of total carbons of the substituted aryl group is preferably from 6 to 20.

$R_2$ is preferably —$COR_3$ (wherein $R_3$ represents an alkyl group or an aryl group) and —$CONHR_{53}$ (wherein $R_3$ represents an aryl group). "a", "b", and "c" each represents the value in which the weight of repeated units is shown utilizing mol percent; "a" is in the range of 40 to 86 mol percent; "b" is in the range of from 0 to 30 mol percent; "c" is in the range of 0 to 60 mol percent, so that a+b+c=100 is satisfied. Most preferably, "a" is in the range of 50 to 86 mol percent, "b" is in the range of 5 to 25 mol percent, and "c" is in the range of 0 to 40 mol percent. The repeated units having each composition ratio of "a", "b", and "c" may be the same or different.

Employed as polyurethane resins usable in the present invention may be those, known in the art, having a structure of polyester polyurethane, polyether polyurethane, polyether polyester polyurethane, polycarbonate polyurethane, polyester polycarbonate polyurethane, or polycaprolactone polyurethane. It is preferable that, if desired, all polyurethanes described herein are substituted, through copolymerization or addition reaction, with at least one polar group selected from the group consisting of —COOM, —$SO_3M$, —$OSO_3M$, —P═O$(OM)_2$, —O—P═O$(OM)_2$ (wherein M represents a hydrogen atom or an alkali metal salt group), —N$(R_4)_2$, —$N^+(R_4)_3$ (wherein $R_{54}$ represents a hydrocarbon group, and a plurality of $R_{54}$ may be the same or different), an epoxy group, —SH, and —CN. The amount of such polar groups is commonly from $10^{-1}$ to $10^{-8}$ mol/g, and is preferably from $10^{-2}$ to $10^{-6}$ mol/g. Other than the polar groups, it is preferable that the molecular terminal of the polyurethane molecule has at least one OH group and at least two OH groups in total. The OH group cross-links with polyisocyanate as a hardening agent so as to form a 3-dimensinal net structure. Therefore, the more OH groups which are incorporated in the molecule, the more preferred. It is particularly preferable that the OH group is positioned at the terminal of the molecule since thereby the reactivity with the hardening agent is enhanced. The polyurethane preferably has at least three OH groups at the terminal of the molecules, and more preferably has at least four OH groups. When polyurethane is employed, the polyurethane preferably has a glass transition temperature of 70 to 105° C., a breakage elongation of 100 to 2,000 percent, and a breakage stress of 0.5 to 100 M/$mm^2$.

Polymers represented by aforesaid General Formula (V) of the present invention can be synthesized employing common synthetic methods described in "Sakusan Binihru Jushi (Vinyl Acetate Resins)", edited by Ichiro Sakurada (Kohbunshi Kagaku Kankoh Kai, 1962).

Examples of representative synthetic methods will now be described. However, the present invention is not limited to these representative synthetic examples.

SYNTHETIC EXAMPLE 1

Synthesis of P-1

Charged into a reaction vessel were 20 g of polyvinyl alcohol (Gosenol GH18) manufactured by Nihon Gosei Co., Ltd. and 180 g of pure water, and the resulting mixture was dispersed in pure water so that 10 weight percent polyvinyl alcohol dispersion was obtained. Subsequently, the resultant dispersion was heated to 95° C. and polyvinyl alcohol was dissolved. Thereafter, the resultant solution was cooled to 75° C., whereby an aqueous polyvinyl alcohol solution was prepared. Subsequently, 1.6 g of 10 percent by weight hydrochloric acid, as an acid catalyst, was added to the solution. The resultant solution was designated as Dripping Solution A. Subsequently, 11.5 g of a mixture consisting of butylaldehyde and acetaldehyde in a mol ratio of 4:5 was prepared and was designated as Dripping Solution B. Added to a 1,000 ml four-necked flask fitted with a cooling pipe and a stirring device was 100 ml of pure water which was heated to 85° C. and stirred well. Subsequently, while stirring, Dripping Solution A and Dripping Solution B were simultaneously added dropwise into the pure water over 2 hours, employing a dripping funnel. During the addition, the reaction was conducted while minimizing coalescence of deposit particles by controlling the stirring rate. After the dropwise addition, 7 g of 10 weight percent hydrochloric acid, as an acid catalyst, was further added, and the resultant mixture was stirred for 2 hours at 85° C., whereby the reaction had sufficiently progressed. Thereafter, the reaction mixture was cooled to 40° C. and was neutralized employing sodium bicarbonate. The resultant product was washed with water 5 times, and the resultant polymer was collected through filtration and dried, whereby P-1 was prepared. The Tg of obtained P-1 was determined employing a DSC, resulting in 83° C.

Other polymers described in Table 1 were synthesized in the same manner as above.

These polymers may be employed individually or in combinations of at least two types as a binder. The polymers are employed as a main binder in the photosensitive silver salt containing layer (preferably in a photosensitive layer) of the present invention. The main binder, as described herein, refers to the binder in "the state in which the proportion of the aforesaid binder is at least 50 percent by weight of the total binders of the photosensitive silver salt containing layer". Accordingly, other binders may be employed in the range of less than 50 weight percent of the total binders. The other polymers are not particularly limited as long as they are soluble in the solvents capable of dissolving the polymers of the present invention. More preferably listed as the polymers are poly(vinyl acetate), acrylic resins, and urethane resins.

Compositions of polymers, which are preferably employed in the present invention, are shown in Table 1. Incidentally, Tg in Table 1 is a value determined employing a differential scanning calorimeter (DSC), manufactured by Seiko Denshi Kogyo Co., Ltd.

TABLE 1

| Polymer Name | Acetoacetal mol % | Butyral mol % | Acetal mol % | Acetyl mol % | Hydroxyl Group mol % | Tg Value (° C.) |
|---|---|---|---|---|---|---|
| P-1 | 6 | 4 | 73.7 | 1.7 | 24.6 | 85 |
| P-2 | 3 | 7 | 75.0 | 1.6 | 23.4 | 75 |
| P-3 | 10 | 0 | 73.6 | 1.9 | 24.5 | 110 |
| P-4 | 7 | 3 | 71.1 | 1.6 | 27.3 | 88 |
| P-5 | 10 | 0 | 73.3 | 1.9 | 24.8 | 104 |
| P-6 | 10 | 0 | 73.5 | 1.9 | 24.6 | 104 |
| P-7 | 3 | 7 | 74.4 | 1.6 | 24.0 | 75 |
| P-8 | 3 | 7 | 75.4 | 1.6 | 23.0 | 74 |
| P-9 | — | — | — | — | — | 60 |

Incidentally, in Table 1, P-9 is a polyvinyl butyral resin B-79, manufactured by Solutia Ltd. "–" in the table 1 means "not measured".

In the present invention, it is known that by employing cross-linking agents in the aforesaid binders, uneven development is minimized due to the improved adhesion of the layer to the support. In addition, it results in such effects that fogging during storage is minimized and the creation of printout silver after development is also minimized.

Employed as cross-linking agents used in the present invention may be various conventional cross-linking agents, which have been employed for silver halide photosensitive photographic materials, such as aldehyde based, epoxy based, ethyleneimine based, vinylsulfone based sulfonic acid ester based, acryloyl based, carbodiimide based, and silane compound based cross-linking agents, which are described in Japanese Patent Application Open to Public Inspection No. 50-96216. Of these, preferred are isocyanate based compounds, silane compounds, epoxy compounds or acid anhydrides, as shown below.

As one of preferred cross-linking agents, isocyanate based and thioisocyanate based cross-linking agents represented by General Formula (IC), shown below, will now be described.

$$X{=}C{=}N\text{-}Lz(N{=}C{=}X)_v \qquad \text{General Formula (IC)}$$

wherein v represents 1 or 2; L represents an alkyl group, an aryl group, or an alkylaryl group which is a linking group having a valence of v+1; and X represents an oxygen atom or a sulfur atom.

Incidentally, in the compounds represented by aforesaid General Formula (IC), the aryl ring of the aryl group may have a substituent. Preferred substituents are selected from the group consisting of a halogen atom (for example, a bromine atom or a chlorine atom), a hydroxyl group, an amino group, a carboxyl group, an alkyl group and an alkoxy group.

The aforesaid isocyanate based cross-linking agents are isocyanates having at least two isocyanate groups and adducts thereof. More specifically, listed are aliphatic isocyanates, aliphatic isocyanates having a ring group, benzene diisocyanates, naphthalene diisocyanates, biphenyl isocyanates, diphenylmethane diisocyanates, triphenylmethane diisocyanates, triisocyanates, tetraisocyanates, and adducts of these isocyanates and adducts of these isocyanates with dihydric or trihydric polyalcohols.

Employed as specific examples may be isocyanate compounds described on pages 10 through 12 of JP-A No. 56-5535.

Incidentally, adducts of isocyanates with polyalcohols are capable of markedly improving the adhesion between layers and further of markedly minimizing layer peeling, image dislocation, and air bubble formation. Such isocyanates may be incorporated in any portion of the silver salt photothermographic dry imaging material. They may be incorporated in, for example, a support (particularly, when the support is paper, they may be incorporated in a sizing composition), and optional layers such as a photosensitive layer, a surface protective layer, an interlayer, an antihalation layer, and a subbing layer, all of which are placed on the photosensitive layer side of the support, and may be incorporated in at least two of the layers.

Further, as thioisocyanate based cross-linking agents usable in the present invention, compounds having a thioisocyanate structure corresponding to the isocyanates are also useful.

The amount of the cross-linking agents employed in the present invention is in the range of 0.001 to 2.000 mol per mol of silver, and is preferably in the range of 0.005 to 0.500 mol.

Isocyanate compounds as well as thioisocyanate compounds, which may be incorporated in the present invention, are preferably those which function as the cross-linking agent. However, it is possible to obtain the desired results by employing compounds which have a v of 0, namely compounds having only one functional group.

Listed as examples of silane compounds which can be employed as a cross-linking agent in the present invention are compounds represented by General Formal (1) or General Formula (2), described in JP-A No. 2002-22203.

In these General Formulas, $R^1$, $R^2$, $R^3$, $R^4$, $R^5$, $R^6$, $R^7$, and $R^8$ each represents a straight or branched chain or cyclic alkyl group having from 1 to 30 carbon atoms, which may be substituted, (such as a methyl group, an ethyl group, a butyl group, an octyl group, a dodecyl group, and a cycloalkyl group), an alkenyl group (such as a propenyl group, a butenyl group, and a nonenyl group), an alkynyl group (such as an acetylene group, a bisacetylene group, and a phenylacetylene group), an aryl group, or a heterocyclic group (such as a phenyl group, a naphthyl group, a tetrahydropyrane group, a pyridyl group, a furyl group, a thiophenyl group, an imidazole group, a thiazole group, a thiadiazole group, and an oxadiazole group, which may have either an electron attractive group or an electron donating group as a substituent.

At least one of substituents selected from $R^1$, $R^2$, $R^3$, $R^4$, $R^5$, $R^6$, $R^7$, and $R^8$ is preferably either a non-diffusive group or an adsorptive group. Specifically, $R^2$ is preferably either a non-diffusive group or an adsorptive group.

Incidentally, the non-diffusive group, which is called a ballast group, is preferably an aliphatic group having at least 6 carbon atoms or an aryl group substituted with an alkyl group having at least 3 carbon atoms. Non-diffusive properties vary depending on binders as well as the used amount of cross-linking agents. By introducing the non-diffusive groups, migration distance in the molecule at room temperature is retarded, whereby it is possible to retard reactions during storage.

Compounds, which can be used as a cross-linking agent, may be those having at least one epoxy group. The number of epoxy groups and corresponding molecular weight are not limited. It is preferable that the epoxy group be incorporated in the molecule as a glycidyl group via an ether bond or an imino bond. Further, the epoxy compound may be a monomer, an oligomer, or a polymer. The number of epoxy groups in the molecule is commonly from about 1 to about 10, and is preferably from 2 to 4. When the epoxy compound is a polymer, it may be either a homopolymer or a copolymer, and its number average molecular weight Mn is most preferably in the range of about 2,000 to about 20,000.

Preferred as epoxy compounds are those represented by General Formula (EP) described below.

General Formula (EP)

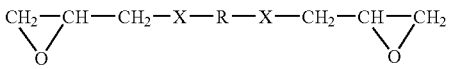

In General Formula (EP), the substituent of the alkylene group represented by R is preferably a group selected from a halogen atom, a hydroxyl group, a hydroxyalkyl group, or an amino group. Further, the linking group represented by R preferably has an amido linking portion, an ether linking portion, or a thioether linking portion. The divalent linking group, represented by X, is preferably —$SO_2$—, —$SO_2NH$—, —S—, —O—, or —$NR_1$—, wherein $R_1$ represents a univalent group, which is preferably an electron attractive group.

These epoxy compounds may be employed individually or in combinations of at least two types. The added amount is not particularly limited but is preferably in the range of $1\times10^{-6}$ to $1\times10^{-2}$ mol/$m^2$, and is more preferably in the range of $1\times10^{-5}$ to $1\times10^{-3}$ mol/$m^2$.

The epoxy compounds may be incorporated in optional layers on the photosensitive layer side of a support, such as a photosensitive layer, a surface protective layer, an interlayer, an antihalation layer, and a subbing layer, and may be incorporated in at least two layers. In addition, the epoxy compounds may be incorporated in optional layers on the side opposite the photosensitive layer on the support. Incidentally, when a photosensitive material has a photosensitive layer on both sides, the epoxy compounds may be incorporated in any layer.

Acid anhydrides are compounds which have at least one acid anhydride group having the structural formula described below.

—CO—O—CO—

The acid anhydrites are to have at least one such acid anhydride group. The number of acid anhydride groups, and the molecular weight are not limited, but the compounds represented by General Formula (SA) are preferred.

General Formula (SA)

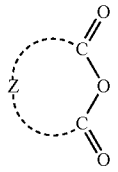

In General Formula (SA), Z represents a group of atoms necessary for forming a single ring or a polycyclic system. These cyclic systems may be unsubstituted or substituted. Example of substituents include an alkyl group (for example, a methyl group, an ethyl group, or a hexyl group), an alkoxy group (for example, a methoxy group, an ethoxy group, or an octyloxy group), an aryl group (for example, a phenyl group, a naphthyl group, or a tolyl group), a hydroxyl group, an aryloxy group (for example, a phenoxy group), an alkylthio group (for example, a methylthio group or a butylthio group), an arylthio group (for example, a phenylthio group), an acyl group (for example, an acetyl group, a propionyl group, or a butyryl group), a sulfonyl group (for example, a methylsulfonyl group, or a phenylsulfonyl group), an acylamino group, a sulfonylamino group, an acyloxy group (for example, an acetoxy group or a benzoxy group), a carboxyl group, a cyano group, a sulfo group, and an amino group. Substituents are preferably those which do not contain a halogen atom.

These acid anhydrides may be employed individually or in combinations of at least two types. The added amount is not particularly limited, but is preferably in the range of $1\times10^{-6}$ to $1\times10^{-2}$ mol/$m^2$ and is more preferably in the range of $1\times10^{-6}$ to $1\times10^{-3}$ mol/$m^2$.

In the present invention, the acid anhydrides may be incorporated in optional layers on the photosensitive layer side on a support, such as a photosensitive layer, a surface protective layer, an interlayer, an antihalation layer, or a subbing layer, and may be incorporated in at least two layers. Further, the acid anhydrides may be incorporated in the layer(s) in which the epoxy compounds are incorporated.

<Tone Controlling Agent>

The tone of images obtained by thermal development of the imaging material is described.

It has been pointed out that in regard to the output image tone for medical diagnosis, cold image tone tends to result in more accurate diagnostic observation of radiographs. The cold image tone, as described herein, refers to pure black tone or blue black tone in which black images are tinted to blue. On the other hand, warm image tone refers to warm black tone in which black images are tinted to brown. The tone is more described below based on an expression defined by a method recommended by the Commission Internationale de l'Eclairage (CIE) in order to define more quantitatively.

"Colder tone" as well as "warmer tone", which is terminology of image tone, is expressed, employing minimum density $D_{min}$ and hue angle $h_{ab}$ at an optical density D of 1.0. The hue angle $h_{ab}$ is obtained by the following formula, utilizing color specifications a* and b* of L*a*b* Color Space which is a color space perceptively having approximately a uniform rate, recommended by Commission Internationale de l'Eclairage (CIE) in 1976.

$$h_{ab}=\tan^{-1}(b^*/a^*)$$

In the present invention, $h_{ab}$ is preferably in the range of 180 degrees<$h_{ab}$<270 degrees, is more preferably in the range of 200 degrees<$h_{ab}$<270 degrees, and is most preferably in the range of 220 degrees<$h_{ab}$<260 degrees.

This finding is also disclosed in JP-A 2002-6463.

Incidentally, as described, for example, in JP-A No. 2000-29164, it is conventionally known that diagnostic images with visually preferred color tone are obtained by adjusting, to the specified values, u* and v* or a* and b* in CIE 1976 (L*u*v*) color space or (L*a*b*) color space near an optical density of 1.0.

Diligent investigation was performed for the silver salt photothermographic imaging material according to the present invention. As a result, it was discovered that when a linear regression line was formed on a graph in which in the CIE 1976 (L*u*v*) color space or the (L*a*b*) color space, u* or a* was used as the abscissa and v* or b* was used as the ordinate, the aforesaid materiel exhibited diagnostic properties which were equal to or better than conventional wet type silver salt photosensitive materials by regulating the resulting linear regression line to the specified range. The condition ranges of the present invention will now be described.

The coefficient of determination value $R^2$ of the linear regression line is 0.998-1.000, which is formed in such a manner that each of optical density of 0.5, 1.0, and 1.5 and the minimum optical density of the aforesaid imaging material is measured, and a* and b* in terms of each of the above optical densities are arranged in two-dimensional coordinates in which a* is used as the abscissa of the CIE 1976 (L*a*b*) color space, while b* is used as the ordinate of the same.

In addition, value b* of the intersection point of the aforesaid linear regression line with the ordinate is −5-+5, while gradient (b*/a*) is 0.7-2.5.

Incidentally, it is preferable that the coefficient of determination value $R^2$ of the linear regression line which is made by arranging u* and v* in terms of each of the above optical densities is also 0.998-1.000; value v* of the intersection point of the aforesaid linear regression line with the ordinate is −5-+5; and gradient (v*/u*) is 0.7-2.5.

A method for making the above-mentioned linear regression line, namely one example of a method for determining u* and v* as well as a* and b* in the CIE 1976 color space, will now be described.

By employing a thermal development apparatus, a 4-step wedge sample including an unexposed portion and optical densities of 0.5, 1.0, and 1.5 is prepared. Each of the wedge density portions prepared as above is determined employing a spectral chronometer (for example, CM-3600d, manufactured by Minolta Co., Ltd.) and either u* and v* or a* and b* are calculated. Measurement conditions are such that an F7 light source is used as a light source, the visual field angle is 10 degrees, and the transmission measurement mode is used. Subsequently, either measured u* and v* or measured a* and b* are plotted on the graph in which u* or a* is used as the abscissa, while v* or b* is used as the ordinate, and a linear regression line is formed, whereby the coefficient of determination value $R^2$ as well as intersection points and gradients are determined.

The specific method enabling to obtain a linear regression line having the above-described characteristics will be described below.

In the present invention, by regulating the added amount of the aforesaid toning agents, developing agents, silver halide grains, and aliphatic carboxylic acid silver, which are directly or indirectly involved in the development reaction process, it is possible to optimize the shape of developed silver so as to result in the desired tone. For example, when the developed silver is shaped to dendrite, the resulting image tends to be bluish, while when shaped to filament, the resulting imager tends to be yellowish. Namely, it is possible to adjust the image tone taking into account the properties of shape of developed silver.

Usually, toning agents such as phthalazinones or a combinations of phthalazine with phthalic acids, or phthalic anhydride are employed.

Examples of suitable image toning agents are disclosed in Research Disclosure, Item 17029, and U.S. Pat. Nos. 4,123,282, 3,994,732, 3,846,136, and 4,021,249.

Other than such toners, it is preferable to control color tone employing couplers disclosed in JP-A No. 11-288057 and EP 1134611A2 as well as leuco dyes detailed below.

Further, it is possible to unexpectedly minimize variation of tone during storage of silver images by simultaneously employing silver halide grains which are converted into an internal latent image-forming type after the thermal development according to the present invention.

(Leuco Dyes)

Leuco dyes are employed in the silver salt photothermographic dry imaging materials of the present invention.

Employed as leuco dyes may be any of the colorless or slightly tinted compounds which are oxidized to form a colored state when heated at temperatures of about 80-about 200° C. for about 0.5-about 30 seconds. It is possible to use any of the leuco dyes which are oxidized by silver ions to form dyes. Compounds are useful which are sensitive to pH and oxidizable to a colored state.

Representative leuco dyes suitable for the use in the present invention are not particularly limited. Examples include biphenol leuco dyes, phenol leuco dyes, indoaniline leuco dyes, acrylated azine leuco dyes, phenoxazine leuco dyes, phenodiazine leuco dyes, and phenothiazine leuco dyes. Further, other useful leuco dyes are those disclosed in U.S. Pat. Nos. 3,445,234, 3,846,136, 3,994,732, 4,021,249, 4,021,250, 4,022,617, 4,123,282, 4,368,247, and 4,461,681, as well as JP-A Nos. 50-36110, 59-206831, 5-204087, 11-231460, 2002-169249, and 2002-236334.

In order to control images to specified color tones, it is preferable that various color leuco dyes are employed individually or in combinations of a plurality of types. In the present invention, for minimizing excessive yellowish color tone due to the use of highly active reducing agents, as well as excessive reddish images especially at a density of at least 2.0 due to the use of minute silver halide grains, it is preferable to employ leuco dyes which change to cyan. Further, in order to achieve precise adjustment of color tone, it is further preferable to simultaneously use yellow leuco dyes as well as other leuco dyes which change to cyan.

It is preferable to appropriately control the density of the resulting color while taking into account the relationship with the color tone of developed silver itself. In the present invention, color formation is performed so that the sum of maximum densities at the maximum adsorption wavelengths of dye images formed by leuco dyes is customarily 0.01-0.30, is preferably 0.02-0.20, and is most preferably 0.02-0.10. Further, it is preferable that images be controlled within the preferred color tone range described below.

(Yellow Forming Leuco Dyes)

In the present invention, particularly preferably employed as yellow forming leuco dyes are color image forming agents represented by following General Formula (YL) which increase absorbance between 360 and 450 nm via oxidation.

General Formula (YL)

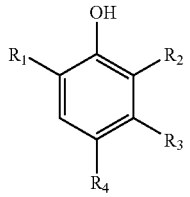

The compounds represented by General Formula (YL) will now be detailed.

In aforesaid General Formula (YL), preferably as the alkyl groups represented by $R_1$ are those having 1-30 carbon atoms, which may have a substituent. Specifically preferred is methyl, ethyl, butyl, octyl, i-propyl, t-butyl, t-octyl, t-pentyl, sec-butyl, cyclohexyl, or 1-methyl-cyclohexyl. Groups (i-propyl, i-nonyl, t-butyl, t-amyl, t-octyl, cyclohexyl, 1-methyl-cyclohexyl or adamantyl) which are three-dimensionally larger than 1-propyl are preferred. Of these, preferred are secondary or tertiary alkyl groups and t-butyl, t-octyl, and t-pentyl, which are tertiary alkyl groups, are particularly preferred. Listed as substituents which $R_1$ may have are a halogen atom, an aryl group, an alkoxy group, an amino group, an acyl group, an acylamino group, an alkylthio group, an arylthio group, a sulfonamide group, an acyloxy group, an oxycarbonyl group, a carbamoyl group, a sulfamoyl group, a sulfonyl group, and a phosphoryl group.

$R_2$ represents a hydrogen atom, a substituted or unsubstituted alkyl group, or an acylamino group. The alkyl group represented by $R_2$ is preferably one having 1-30 carbon atoms, while the acylamino group is preferably one having 1-30 carbon atoms. Of these, description for the alkyl group is the same as for aforesaid $R_1$.

The acylamino group represented by $R_2$ may be unsubstituted or have a substituent. Specifically listed are an acetylamino group, an alkoxyacetylamino group, and an aryloxyacetylamino group. $R_2$ is preferably a hydrogen atom or an unsubstituted group having 1-24 carbon atoms, and specifically listed are methyl, i-propyl, and t-butyl. Further, neither $R_1$ nor $R_2$ is a 2-hydroxyphenylmethyl group.

$R_3$ represents a hydrogen atom, and a substituted or unsubstituted alkyl group. Preferred as alkyl groups are those having 1-30 carbon atoms. Description for the above alkyl groups is the same as for $R_1$. Preferred as $R_3$ are a hydrogen atom and an unsubstituted alkyl group having 1-24 carbon atoms, and specifically listed are methyl, i-propyl and t-butyl. It is preferable that either $R_{12}$ or $R_{13}$ represents a hydrogen atom.

$R_4$ represents a group capable of being substituted to a benzene ring, and represents the same group which is described for substituent $R_4$, for example, in aforesaid General Formula (RED). $R_4$ is preferably a substituted or unsubstituted alkyl group having 1-30 carbon atoms, as well as an oxycarbonyl group having 2-30 carbon atoms. The alkyl group having 1-24 carbon atoms is more preferred. Listed as substituents of the alkyl group are an aryl group, an amino group, an alkoxy group, an oxycarbonyl group, an acylamino group, an acyloxy group, an imide group, and a ureido group. Of these, more preferred are an aryl group, an amino group, an oxycarbonyl group, and an alkoxy group. The substituent of these alkyl group may be substituted with any of the above alkyl groups.

Among the compounds represented by General Formula (YL), preferred compounds are bis-phenol compounds represented by General Formula (YL')

General Formula (YL')

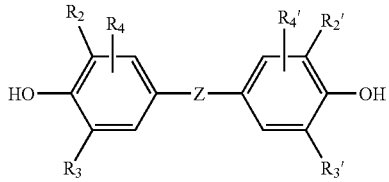

wherein, Z represents a —S— or —C($R_1$)($R_{1'}$)— group. $R_1$ and $R_{1'}$ each represent a hydrogen atom or a substituent. The substituents represented by $R_1$ and $R_{1'}$ are the same substituents listed for $R_1$ in the aforementioned General Formula (RED). $R_1$ and $R_{1'}$ are preferably a hydrogen atom or an alkyl group.

$R_2$, $R_3$, $R_{2'}$ and $R_{3'}$ each represent a substituent. The substituents represented by $R_2$, $R_3$, $R_{2'}$ and $R_{3'}$ are the same substituents listed for $R_2$ and $R_3$ in the aforementioned General Formula (RED).

$R_2$, $R_3$, $R_{2'}$ and $R_{3'}$ are preferably, an alkyl group, an alkenyl group, an alkynyl group, an aryl group, a heterocyclic group, and more preferably, an alkyl group. Substituents on the alkyl group are the same substituents listed for the substituents in the aforementioned General Formula (RED).

$R_2$, $R_3$, $R_{2'}$ and $R_{3'}$ are more preferably tertiary alkyl groups such as t-butyl, t-amino, t-octyl and 1-methyl-cyclohexyl.

$R_4$ and $R_{4'}$ each represent a hydrogen atom or a substituent, and the substituents are the same substituents listed for $R_4$ in the aforementioned General Formula (RED).

Examples of the bis-phenol compounds represented by General Formula (RED) are, the compounds disclosed in JP-A No. 2002-169249, Compounds (II-1) to (II-40), paragraph Nos. [0032]-[0038]; and EP 1211093, Compounds (ITS-1) to (ITS-12), paragraph No. [0026].

In the following, specific examples of bisphenol compounds represented by General Formula (YL) are shown.

5-1

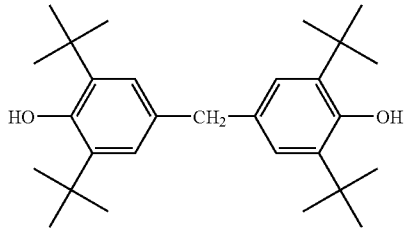

5-2

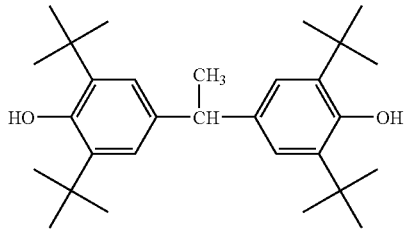

-continued
5-3
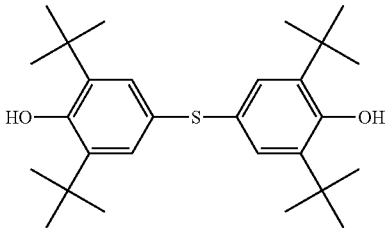
5-4
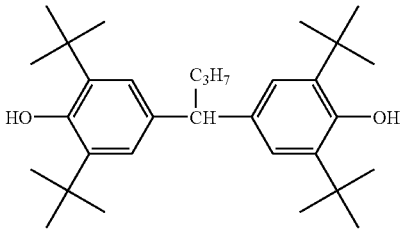
5-5
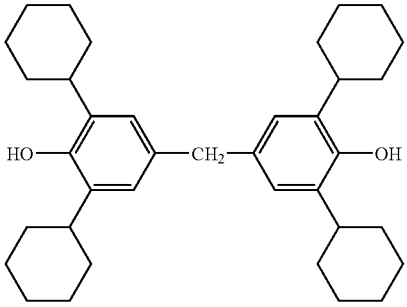
5-6
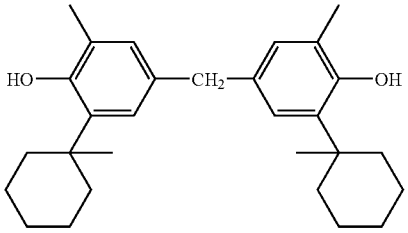
5-7
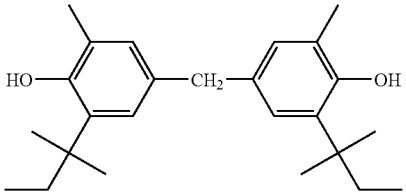
5-8
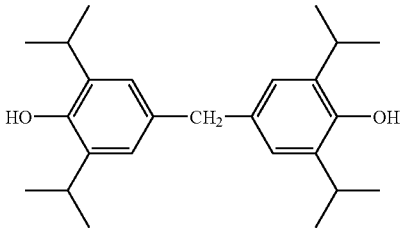
-continued
5-9
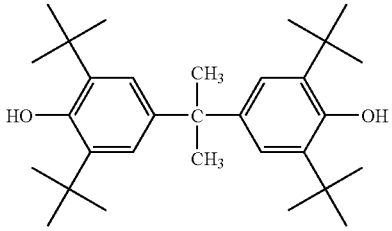
5-10
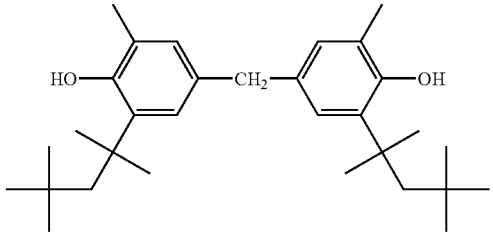
(YL-11)
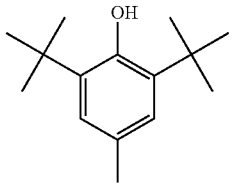
(YL-12)
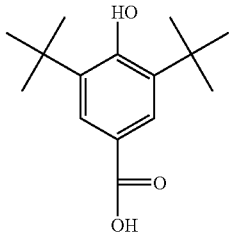
(YL-13)
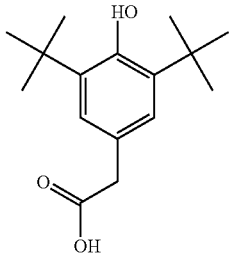
(YL-14)
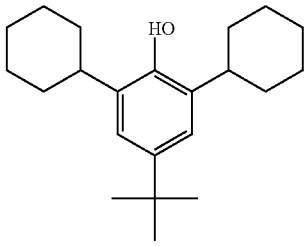

-continued (YL-15)

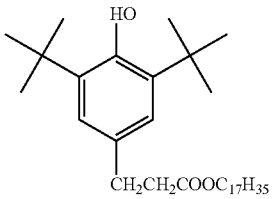

An amount of an incorporated compound represented by General Formula (YL) is; usually, 0.00001 to 0.01 mol, and preferably, 0.0005 to 0.01 mol, and more preferably, 0.001 to 0.008 mol per mol of Ag.

(Cyan Forming Leuco Dyes)

Cyan forming leuco dyes will now be described. In the present invention, particularly preferably employed as cyan forming leuco dyes are color image forming agents which increase absorbance between 600 and 700 nm via oxidation, and include the compounds described in JP-A No. 59-206831 (particularly, compounds of λmax in the range of 600-700 nm), compounds represented by General Formulas (I)-(IV) of JP-A No. 5-204087 (specifically, compounds (1)-(18) described in paragraphs [0032]-[0037]), and compounds represented by General Formulas 4-7 (specifically, compound Nos. 1-79 described in paragraph [0105]) of JP-A No. 11-231460.

Cyan forming leuco dyes which are particularly preferably employed in the present invention are represented by following General Formula (CL).

General Formula (CL)

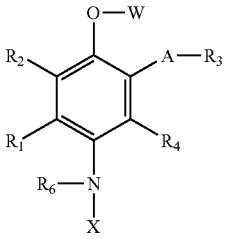

wherein $R_1$ and $R_2$ each represent a hydrogen atom, a substituted or unsubstituted alkyl group, an NHCO—$R_{10}$ group wherein $R_{10}$ is an alkyl group, an aryl group, or a heterocyclic group, while $R_1$ and $R_2$ may bond to each other to form an aliphatic hydrocarbon ring, an aromatic hydrocarbon ring, or a heterocyclic ring; A represents a —NHCO— group, a —CONH— group, or a —NHCONH— group; $R_3$ represents a substituted or unsubstituted alkyl group, an aryl group, or a heterocyclic group, or -A-$R_3$ is a hydrogen atom; W represents a hydrogen atom or a —CONH$R_5$— group, —CO$R_5$ or a —CO—O—$R_5$ group wherein $R_5$ represents a substituted or unsubstituted alkyl group, an aryl group, or a heterocyclic group; $R_4$ represents a hydrogen atom, a halogen atom, a substituted or unsubstituted alkyl group, an alkoxy group, a carbamoyl group, or a nitrile group; $R_6$ represents a —CONH—$R_7$ group, a —CO—$R_7$ group, or a —CO—O—$R_7$ group wherein $R_7$ is a substituted or unsubstituted alkyl group, an aryl group, or a heterocyclic group; and X represents a substituted or unsubstituted aryl group or a heterocyclic group.

In General Formula (CL), halogen atoms include fluorine, bromine, and chlorine; alkyl groups include those having at most 20 carbon atoms (methyl, ethyl, butyl, or dodecyl); alkenyl groups include those having at most 20 carbon atoms (vinyl, allyl, butenyl, hexenyl, hexadienyl, ethenyl-2-propenyl, 3-butenyl, 1-methyl-3-propenyl, 3-pentenyl, or 1-methyl-3-butenyl); alkoxy groups include those having at most 20 carbon atoms (methoxy or ethoxy); aryl groups include those having 6-20 carbon atoms such as a phenyl group, a naphthyl group, or a thienyl group; heterocyclic groups include each of thiophene, furan, imidazole, pyrazole, and pyrrole groups. A represents a —NHCO— group, a —CONH— group, or a —NHCONH— group; $R_3$ represents a substituted or unsubstituted alkyl group (preferably having at most 20 carbon atoms such as methyl, ethyl, butyl, or dodecyl), an aryl group (preferably having 6-20 carbon atoms, such as phenyl, naphthyl, or thienyl), or a heterocyclic group (thiophene, furan, imidazole, pyrazole, or pyrrole); -A-$R_3$ is a hydrogen atom; W represents a hydrogen atom or a —CONH$R_5$ group, a —CO—$R_5$ group or a —CO—O$R_5$ group wherein $R_5$ represents a substituted or unsubstituted alkyl group (preferably having at most 20 carbon atoms, such as methyl, ethyl, butyl, or dodecyl), an aryl group (preferably having 6-20 carbon atoms, such as phenyl, naphthyl, or thienyl), or a heterocyclic group (such as thiophene, furan, imidazole, pyrazole, or pyrrole); $R_4$ is preferably a hydrogen atom, a halogen atom (e.g., fluorine, chlorine, bromine, iodine), a chain or cyclic alkyl group (e.g., a methyl group, a butyl group, a dodecyl group, or a cyclohexyl group), an alkoxy group (e.g., a methoxy group, a butoxy group, or a tetradecyloxy group), a carbamoyl group (e.g., a diethylcarbamoyl group or a phenylcarbamoyl group), and a nitrile group and of these, a hydrogen atom and an alkyl group are more preferred. Aforesaid $R_1$ and $R_2$, and $R_3$ and $R_4$ bond to each other to form a ring structure. The aforesaid groups may have a single substituent or a plurality of substituents. For example, typical substituents which may be introduced into aryl groups include a halogen atom (fluorine, chlorine, or bromine), an alkyl group (methyl, ethyl, propyl, butyl, or dodecyl), a hydroxyl group, a cyan group, a nitro group, an alkoxy group (methoxy or ethoxy), an alkylsulfonamide group (methylsulfonamido or octylsulfonamido), an arylsulfonamide group (phenylsulfonamido or naphthylsulfonamido), an alkylsulfamoyl group (butylsulfamoyl), an arylsulfamoyl group (phenylsulfamoyl), an alkyloxycarbonyl group (methoxycarbonyl), an aryloxycarbonyl group (phenyloxycarbonyl), an aminosulfonamide group, an acylamino group, a carbamoyl group, a sulfonyl group, a sulfinyl group, a sulfoxy group, a sulfo group, an aryloxy group, an alkoxy group, an alkylcarbonyl group, an arylcarbonyl group, or an aminocarbonyl group. It is possible to introduce two different groups of these groups into an aryl group. Either $R_{10}$ or $R_{85}$ is preferably a phenyl group, and is more preferably a phenyl group having a plurality of substituents containing a halogen atom or a cyano group.

$R_6$ is a —CONH—$R_7$ group, a —CO—$R_7$ group, or —CO—O—$R_7$ group, wherein $R_7$ is a substituted or unsubstituted alkyl group (preferably having at most 20 carbon atoms, such as methyl, ethyl, butyl, or dodecyl), an aryl group (preferably having 6-20 carbon atoms, such as phenyl, naphthol, or thienyl), or a heterocyclic group (thiophene, furan, imidazole, pyrazole, or pyrrole). Employed as substituents of the alkyl group represented by $R_7$ may be the same ones as substituents in $R_1$-$R_4$. $X_8$ represents a substituted or unsubstituted aryl group or a heterocyclic group.

These aryl groups include groups having 6-20 carbon atoms such as phenyl, naphthyl, or thienyl, while the heterocyclic groups include any of the groups such as thiophene, furan, imidazole, pyrazole, or pyrrole. Employed as substituents which may be substituted to the group represented by X may be the same ones as the substituents in $R_1$-$R_4$. As the groups represented by X, preferred are an aryl group, which is substituted with an alkylamino group (a diethylamino group) at the para position, or a heterocyclic group. These may contain other photographically useful groups.

Specific examples of cyan forming leuco dyes (CL) are listed below, however are not limited thereto.

(CL-1)

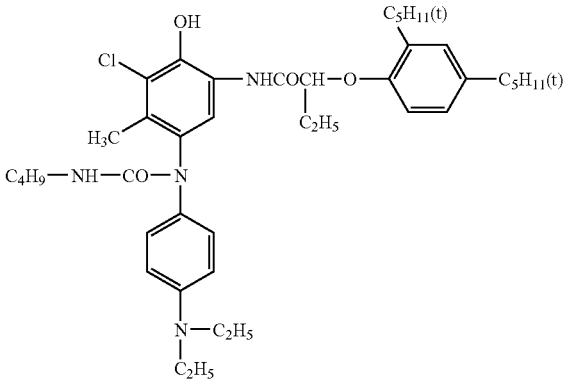

(CL-2)

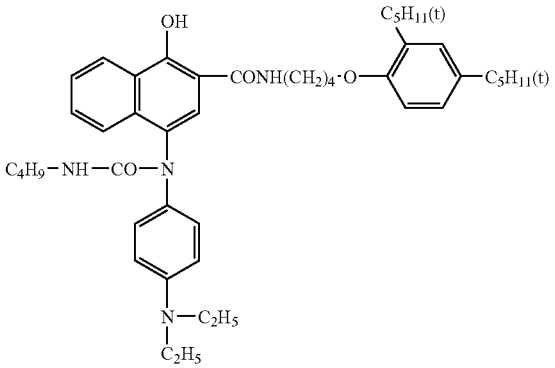

(CL-3)

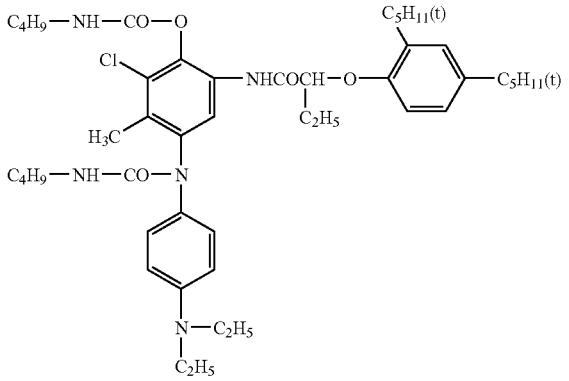

-continued (CL-4)

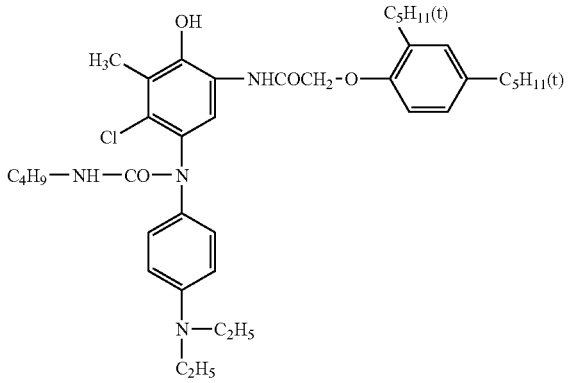

(CL-5)

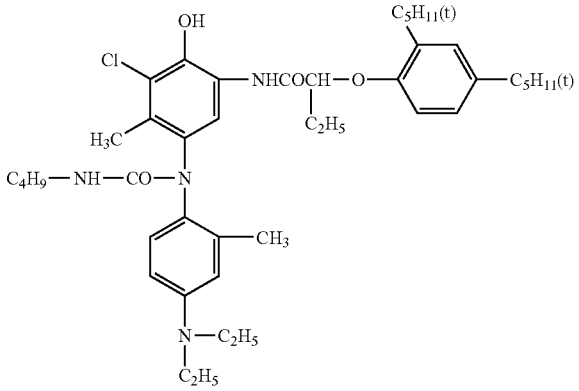

(CL-6)

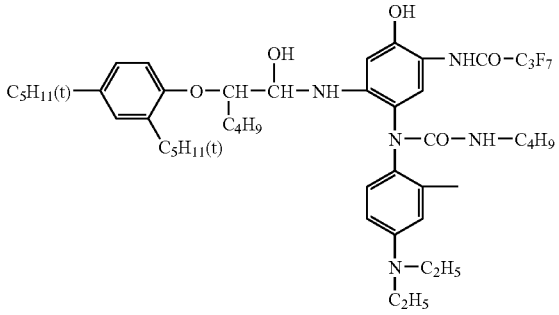

(CL-7)

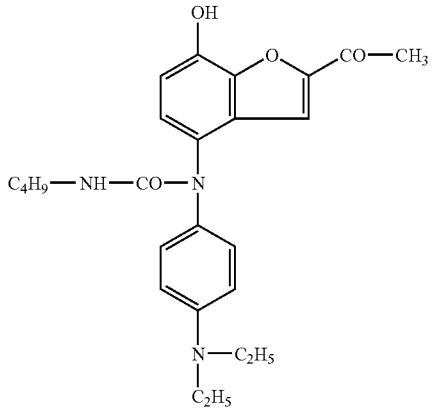

-continued (CL-8)

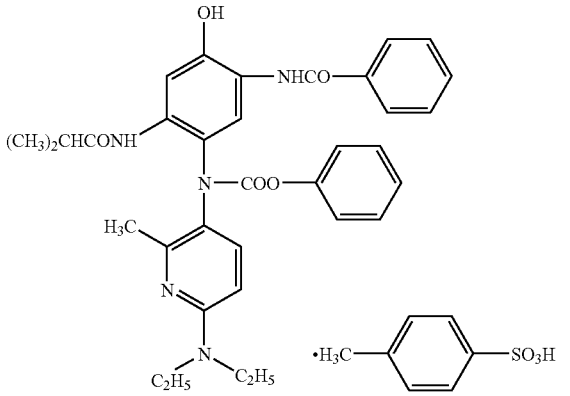

(CL-9)

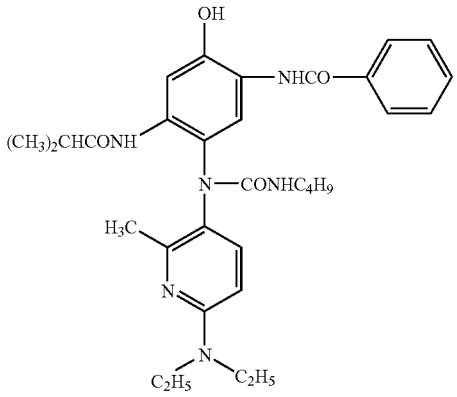

(CL-10)

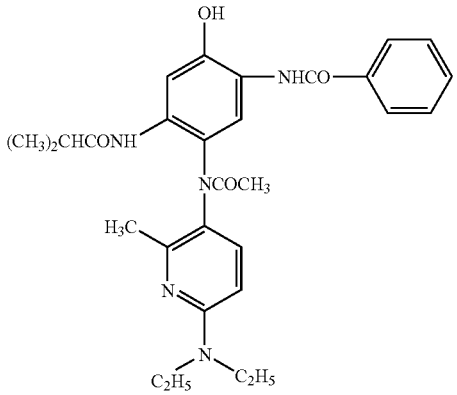

(CL-11)

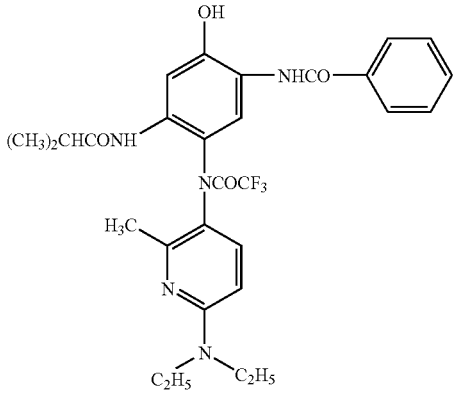

-continued (CL-12)

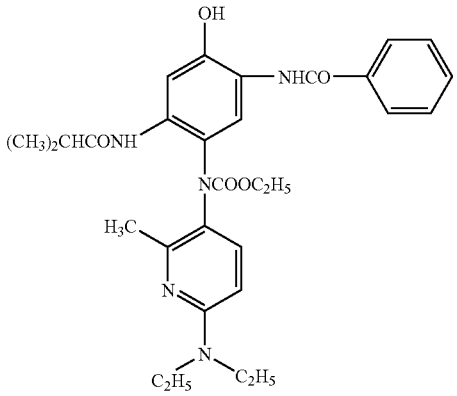

The added amount of cyan forming leuco dyes is customarily 0.00001-0.05 mol/mol of Ag, is preferably 0.0005-0.02 mol/mol, and is more preferably 0.001-0.01 mol.

The compounds represented by General Formula (YL) and cyan forming leuco dyes may be added employing the same method as for the reducing agents represented by General Formula (RED). They may be incorporated in liquid coating compositions employing an optional method to result in a solution form, an emulsified dispersion form, or a minute solid particle dispersion form, and then incorporated in a photosensitive material.

It is preferable to incorporate the compounds represented by General Formula (YL) and cyan forming leuco dyes into an image forming layer containing organic silver salts. On the other hand, the former may be incorporated in the image forming layer, while the latter may be incorporated in a non-image forming layer adjacent to the aforesaid image forming layer. Alternatively, both may be incorporated in the non-image forming layer. Further, when the image forming layer is comprised of a plurality of layers, incorporation may be performed for each of the layers.

<Coating Auxiliaries and Others>

In the present invention, in order to minimize image abrasion caused by handling prior to development as well as after thermal development, matting agents are preferably incorporated in the surface layer (on the photosensitive layer side, and also on the other side when the light-insensitive layer is provided on the opposite side across the support). The added amount is preferably from 0.1 to 30.0 percent by weight with respect to the binders.

Matting agents may be comprised of organic or inorganic materials. Employed as inorganic materials for the matting agents may be, for example, silica described in Swiss Patent No. 330,158, glass powder described in French Patent No. 1,296,995, and carbonates of alkali earth metals or cadmium and zinc described in British Patent No. 1,173,181. Employed as organic materials for the matting agents are starch described in U.S. Pat. No. 2,322,037, starch derivatives described in Belgian Patent No. 625,451 and British Patent No. 981,198, polyvinyl alcohol described in Japanese Patent Publication No. 44-3643, polystyrene or polymethacrylate described in Swiss Patent No. 330,158, acrylonitrile described in U.S. Pat. No. 3,079,257, and polycarbonate described in U.S. Pat. No. 3,022,169.

The average particle diameter of the matting agents is preferably from 0.5 to 10.0 μm, and is more preferably from 1.0 to 8.0 μm. Further, the variation coefficient of the particle size distribution of the same is preferably less than or equal to 50 percent, is more preferably less than or equal to 40 percent, and is most preferably from less than or equal to 30 percent.

Herein, the variation coefficient of the particle size distribution refers to the value expressed by the formula described below.

((Standard deviation of particle diameter)/(particle diameter average))×100

Addition methods of the matting agent according to the present invention may include one in which the matting agent is previously dispersed in a coating composition and the resultant dispersion is applied onto a support, and the other in which after applying a coating composition onto a support, a matting agent is sprayed onto the resultant coating prior to completion of drying. Further, when a plurality of matting agents is employed, both methods may be used in combination.

(Fluorine Based Surface Active Agents)

It is preferable to employ the fluorine based surface active agents represented by following General Formulas (SA-1)-(SA-3) in the imaging materials according to the present invention.

$(Rf\text{-}L)_p—Y\text{-}(A)_q$ General Formula (SA-1)

$LiO_3S—(CF_2)_n—SO_3Li$ General Formula (SA-2)

$MO_3S—(CF_2)_n—SO_3M$ General Formula (SA-3)

wherein M represents a hydrogen atom, a sodium atom, a potassium atom, and an ammonium group; n represents a positive integer, while in the case in which M represents H, n represents an integer of 1-6 and 8, and in the case in which M represents an ammonium group, n represents an integer of 1-8.

In aforesaid General Formula (SA-1), Rf represents a substituent containing a fluorine atom. Listed as fluorine atom-containing substituents are, for example, an alkyl group having 1-25 carbon atoms (such as a methyl group, an ethyl group, a butyl group, an octyl group, a dodecyl group, or an octadecyl group), and an alkenyl group (such as a propenyl group, a butenyl group, a nonenyl group or a dodecenyl group).

L represents a divalent linking group having no fluorine atom. Listed as divalent linking groups having no fluorine atom are, for example, an alkylene group (e.g., a methylene group, an ethylene group, and a butylene group), an alkyleneoxy group (such as a methyleneoxy group, an ethyleneoxy group, or a butyleneoxy group), an oxyalkylene group (e.g., an oxymethylene group, an oxyethylene group, and an oxybutylene group), an oxyalkyleneoxy group (e.g., an oxymethyleneoxy group, an oxyethyleneoxy group, and an oxyethyleneoxyethyleneoxy group), a phenylene group, and an oxyphenylene group, a phenyloxy group, and an oxyphenyloxy group, or a group formed by combining these groups.

A represents an anion group or a salt group thereof. Examples include a carboxylic acid group or salt groups thereof (sodium salts, potassium salts and lithium salts), a sulfonic acid group or salt groups thereof (sodium salts, potassium salts and lithium salts), and a phosphoric acid group and salt groups thereof (sodium salts, potassium salts and lithium salts).

Y represents a trivalent or tetravalent linking group having no fluorine atom. Examples include trivalent or tetravalent linking groups having no fluorine atom, which are groups of atoms comprised of a nitrogen atom as the center. P represents an integer from 1 to 3, while q represents an integer of 2 or 3.

The fluorine based surface active agents represented by General Formula (SA-1) are prepared as follows. Alkyl compounds having 1-25 carbon atoms into which fluorine atoms are introduced (e.g., compounds having a trifluoromethyl group, a pentafluoroethyl group, a perfluorobutyl group, a perfluorooctyl group, or a perfluorooctadecyl group) and alkenyl compounds (e.g., a perfluorohexenyl group or a perfluorononenyl group) undergo addition reaction or condensation reaction with each of the trivalent-hexavalent alknaol compounds into which fluorine atom(s) are not introduced, aromatic compounds having 3-4 hydroxyl groups or hetero compounds. Anion group (A) is further introduced into the resulting compounds (including alknaol compounds which have been partially subjected to introduction of Rf) employing, for example, sulfuric acid esterification.

Listed as the aforesaid trivalent-hexavalent alkanol compounds are glycerin, pentaerythritol, 2-methyl-2-hydroxymethyl-1,3-propanediol, 2,4-dihydroxy-3-hydroxymethylpentane, 1,2,6-hexanrtriol. 1,1,1-tris(hydroxymethyl)propane, 2,2-bis(butanol), aliphatic triol, tetramethylolmethane, D-sorbitol, xylitol, and D-mannitol.

Listed as the aforesaid aromatic compounds, having 3-4 hydroxyl groups and hetero compounds, are 1,3,5-trihydroxybenzene and 2,4,6-trihydroxypyridine.

n in General Formula (SA-2) represents an integer of 1-4.

In General Formula (SA-3), M represents a hydrogen atom, a potassium atom, or an ammonium group and n represents a positive integer. In the case in which M represents H, n represents an integer from 1 to 6 or 8; in the case in which M represents Na, n represents 4; in the case in which M represents K, n represents an integer from 1 to 6; and in the case in which M represents an ammonium group, n represents an integer from 1 to 8.

It is possible to add the fluorine based surface active agents represented by General Formulas (SA-1)-(SA-3) to liquid coating compositions, employing any conventional addition methods known in the art. Namely, they are dissolved in solvents such as alcohols including methanol or ethanol, ketones such as methyl ethyl ketone or acetone, and polar solvents such as dimethylformamide, and then added. Further, they may be dispersed into water or organic solvents in the form of minute particles at a maximum size of 1 μm, employing a sand mill, a jet mill, or an ultrasonic homogenizer and then added. Many techniques are disclosed for minute particle dispersion, and it is possible to perform dispersion based on any of these. It is preferable that the aforesaid fluorine based surface active agents are added to the protective layer which is the outermost layer.

The added amount of the aforesaid fluorine based surface active agents is preferably $1\times10^{-8}$-$1\times10^{-1}$ mol per $m^2$. When the added amount is less than the lower limit, it is not possible to achieve desired charging characteristics, while it exceeds the upper limit, storage stability degrades due to an increase in humidity dependence.

Incidentally, surface active agents represented by General Formulas (SA-1), (SA-2), and (SA-3) are disclosed in JP-A No. 2003-57786, and Japanese Patent Application Nos. 2002-178386 and 2003-237982.

Listed as materials of the support employed in the silver salt photothermographic dry imaging material of the present invention are various kinds of polymers, glass, wool fabric, cotton fabric, paper, and metal (for example, aluminum).

From the viewpoint of handling as information recording materials, flexible materials, which can be employed as a sheet or can be wound in a roll, are suitable. Accordingly, preferred as supports in the silver salt photothermographic dry imaging material of the present invention are plastic films (for example, cellulose acetate film, polyester film, polyethylene terephthalate film, polyethylene naphthalate film, polyamide film, polyimide film, cellulose triacetate film or polycarbonate film). Of these, in the present invention, biaxially stretched polyethylene terephthalate film is particularly preferred. The thickness of the supports is commonly from about 50 to about 300 μm, and is preferably from 70 to 180 μm.

In the present invention, in order to minimize static-charge buildup, electrically conductive compounds such as metal oxides and/or electrically conductive polymers may be incorporated in composition layers. The compounds may be incorporated in any layer, but are preferably incorporated in a subbing layer, a backing layer, and an interlayer between the photosensitive layer and the subbing layer. In the present invention, preferably employed are electrically conductive compounds described in columns 14 through 20 of U.S. Pat. No. 5,244,773.

The silver salt photothermographic dry imaging material of the present invention comprises a support having thereon at least one photosensitive layer. The photosensitive layer may only be formed on the support. However, it is preferable that at least one light-insensitive layer is formed on the photosensitive layer. For example, it is preferable that for the purpose of protecting a photosensitive layer, a protective layer is formed on the photosensitive layer, and in order to minimize adhesion between photosensitive materials as well as adhesion in a wound roll, a backing layer is provided on the opposite side of the support. As binders employed in the protective layer as well as the backing layer, polymers such as cellulose acetate, cellulose acetate butyrate, which has a higher glass transition point from the thermal development layer and exhibit abrasion resistance as well as distortion resistance are selected from the aforesaid binders. Incidentally, for the purpose of increasing latitude, one of the preferred embodiments of the present invention is that at least two photosensitive layers are provided on the one side of the support or at least one photosensitive layer is provided on both sides of the support.

In the silver salt photothermographic dry imaging material of the present invention, in order to control the light amount as well as the wavelength distribution of light which transmits the photosensitive layer, it is preferable that a filter layer is formed on the photosensitive layer side or on the opposite side, or dyes or pigments are incorporated in the photosensitive layer.

Employed as dyes may be compounds, known in the art, which absorb various wavelength regions according to the spectral sensitivity of photosensitive materials.

For example, when the silver salt photothermographic dry imaging material of the present invention is used as an image recording material utilizing infrared radiation, it is preferable to employ squarylium dyes having a thiopyrylium nucleus (hereinafter referred to as thiopyriliumsquarylium dyes) and squarylium dyes having a pyrylium nucleus (hereinafter referred to as pyryliumsquarylium dyes), as described in Japanese Patent Application No. 11-255557, and thiopyryliumcroconium dyes or pyryliumcroconium dyes which are analogous to the squarylium dyes.

Incidentally, the compounds having a squarylium nucleus, as described herein, refers to ones having 1-cyclobutene-2-hydroxy-4-one in their molecular structure. Herein, the hydroxyl group may be dissociated. Hereinafter, all of these dyes are referred to as squarylium dyes.

Incidentally, preferably employed as the dyes are compounds described in Japanese Patent Publication Open to Public Inspection No. 8-201959.

<Layer Structures and Coating Conditions>

It is preferable to prepare the silver salt photothermographic dry imaging material of the present invention as follows. Materials of each constitution layer as above are dissolved or dispersed in solvents to prepare coating compositions. Resultant coating compositions are subjected to simultaneous multilayer coating and subsequently, the resultant coating is subjected to a thermal treatment. "Simultaneous multilayer coating", as described herein, refers to the following. The coating composition of each constitution layer (for example, a photosensitive layer and a protective layer) is prepared. When the resultant coating compositions are applied onto a support, the coating compositions are not applied onto a support in such a manner that they are individually applied and subsequently dried, and the operation is repeated, but are simultaneously applied onto a support and subsequently dried. Namely, before the residual amount of the total solvents of the lower layer reaches 70 percent by weight, the upper layer is applied.

Simultaneous multilayer coating methods, which are applied to each constitution layer, are not particularly limited. For example, are employed methods, known in the art, such as a bar coater method, a curtain coating method, a dipping method, an air knife method, a hopper coating method, and an extrusion method. Of these, more preferred is the pre-weighing type coating system called an extrusion coating method. The aforesaid extrusion coating method is suitable for accurate coating as well as organic solvent coating because volatilization on a slide surface, which occurs in a slide coating system, does not occur. Coating methods have been described for coating layers on the photosensitive layer side. However, the backing layer and the subbing layer are applied onto a support in the same manner as above.

In the present invention, silver coverage is preferably from 0.1 to 2.5 g/m$^2$, and is more preferably from 0.5 to 1.5 g/m$^2$.

Further, in the present invention, it is preferable that in the silver halide grain emulsion, the content ratio of silver halide grains, having a grain diameter of 0.030 to 0.055 μm in term of the silver weight, is from 3 to 15 percent in the range of a silver coverage of 0.5 to 1.5 g/m$^2$.

The ratio of the silver coverage which is resulted from silver halide is preferably from 2 to 18 percent with respect to the total silver, and is more preferably from 3 to 15 percent.

Further, in the present invention, the number of coated silver halide grains, having a grain diameter (being a sphere equivalent grain diameter) of at least 0.01 μm, is preferably from $1\times10^{14}$ to $1\times10^{18}$ grains/m$^2$, and is more preferably from $1\times10^{15}$ to $1\times10^{17}$.

Further, the coated weight of aliphatic carboxylic acid silver salts of the present invention is from $10^{-17}$ to $10^{-15}$ g per silver halide grain having a diameter (being a sphere equivalent grain diameter) of at least 0.01 μm, and is more preferably from $10^{-16}$ to $10^{-14}$ g.

When coating is carried out under conditions within the aforesaid range, from the viewpoint of maximum optical silver image density per definite silver coverage, namely covering power as well as silver image tone, desired results are obtained.

<Exposure Conditions>

When the silver salt photothermographic dry imaging material of the present invention is exposed, it is preferable to employ an optimal light source for the spectral sensitivity provided to the aforesaid photosensitive material. For example, when the aforesaid photosensitive material is sensitive to infrared radiation, it is possible to use any radiation source which emits radiation in the infrared region. However, infrared semiconductor lasers (at 780 nm and 820 nm) are preferably employed due to their high power, as well as ability to make photosensitive materials transparent.

In the present invention, it is preferable that exposure is carried out utilizing laser scanning. Employed as the exposure methods are various ones. For example, listed as a firstly preferable method is the method utilizing a laser scanning exposure apparatus in which the angle between the scanning surface of a photosensitive material and the scanning laser beam does not substantially become vertical.

"Does not substantially become vertical", as described herein, means that during laser scanning, the nearest vertical angle is preferably from 55 to 88 degrees, is more preferably from 60 to 86 degrees, and is most preferably from 70 to 82 degrees.

When the laser beam scans photosensitive materials, the beam spot diameter on the exposed surface of the photosensitive material is preferably at most 200 μm, and is more preferably at most 100 mm, and is more preferably at most 100 μm. It is preferable to decrease the spot diameter due to the fact that it is possible to decrease the deviated angle from the verticality of laser beam incident angle. Incidentally, the lower limit of the laser beam spot diameter is 10 μm. By performing the laser beam scanning exposure, it is possible to minimize degradation of image quality according to reflection light such as generation of unevenness analogous to interference fringes.

Further, as the second method, exposure in the present invention is also preferably carried out employing a laser scanning exposure apparatus which generates a scanning laser beam in a longitudinal multiple mode, which minimizes degradation of image quality such as generation of unevenness analogous to interference fringes, compared to the scanning laser beam in a longitudinal single mode.

The longitudinal multiple mode is achieved utilizing methods in which return light due to integrated wave is employed, or high frequency superposition is applied. The longitudinal multiple mode, as described herein, means that the wavelength of radiation employed for exposure is not single. The wavelength distribution of the radiation is commonly at least 5 nm, and is preferably at least 10 nm. The upper limit of the wavelength of the radiation is not particularly limited, but is commonly about 60 nm.

Incidentally, in the recording methods of the aforesaid first and second embodiments, it is possible to suitably select any of the following lasers employed for scanning exposure, which are generally well known, while matching the use. The aforesaid lasers include solid lasers such as a ruby laser, a YAG laser, and a glass laser; gas lasers such as a HeNe laser, an Ar ion laser, a Kr ion laser, a $CO_2$ laser a CO laser, a HeCd laser, an $N_2$ laser, and an excimer laser; semiconductor lasers such as an InGaP laser, an AlGaAs laser, a GaASP laser, an InGaAs laser, an InAsP laser, a $CdSnP_2$ laser, and a GaSb laser; chemical lasers; and dye lasers. Of these, from the viewpoint of maintenance as well as the size of light sources, it is preferable to employ any of the semiconductor lasers having a wavelength of 600 to 1,200 nm.

The beam spot diameter of lasers employed in laser imagers, as well as laser image setters, is commonly in the range of 5 to 75 μm in terms of a short axis diameter and in the range of 5 to 100 μm in terms of a long axis diameter. Further, it is possible to set a laser beam scanning rate at the optimal value for each photosensitive material depending on the inherent speed of the silver salt photothermographic dry imaging material at laser transmitting wavelength and the laser power.

<Development Conditions>

In the present invention, development conditions vary depending on employed devices and apparatuses, or means. Typically, an imagewise exposed silver salt photothermographic dry imaging material is heated at optimal high temperature. It is possible to develop a latent image formed by exposure by heating the material at relatively high temperature (for example, from about 100 to about 200° C.) for a sufficient period (commonly from about 1 second to about 2 minutes). When heating temperature is less than or equal to 100° C., it is difficult to obtain sufficient image density within a relatively short period. On the other hand, at more than or equal to 200° C., binders melt so as to be transferred to rollers, and adverse effects result not only for images but also for transportability as well as processing devices. Upon heating the material, silver images are formed through an oxidation-reduction reaction between aliphatic carboxylic acid silver salts (which function as an oxidizing agent) and reducing agents. This reaction proceeds without any supply of processing solutions such as water from the exterior.

Heating may be carried out employing typical heating means such as hot plates, irons, hot rollers and heat generators employing carbon and white titanium. When the protective layer-provided silver salt photothermographic dry imaging material of the present invention is heated, from the viewpoint of uniform heating, heating efficiency, and workability, it is preferable that heating is carried out while the surface of the side provided with the protective layer comes into contact with a heating means, and thermal development is carried out during the transport of the material while the surface comes into contact with the heating rollers.

EXAMPLES

The present invention will now be detailed with reference to examples. However, the present invention is not limited to these examples.

Example 1

<<Preparation of Subbed Photographic Supports>>

A photographic support comprised of a 175 μm thick biaxially oriented polyethylene terephthalate film with blue tinted at an optical density of 0.170 (determined by Densitometer PDA-65, manufactured by Konica Corp.), which had been subjected to corona discharge treatment of 8 W·minute/$m^2$ on both sides, was subjected to subbing. Namely, subbing liquid coating composition a-1 was applied onto one side of the above photographic support at 22° C. and 100 m/minute to result in a dried layer thickness of 0.2 μm and dried at 140° C., whereby a subbing layer on the image forming layer side (designated as Subbing Layer A-1) was formed. Further, subbing liquid coating composition b-1 described below was applied, as a backing layer subbing layer, onto the opposite side at 22° C. and 100 m/minute to result in a dried layer thickness of 0.12 μm and dried at 140°

C. An electrically conductive subbing layer (designated as Subbing Lower Layer B-1), which exhibited an antistatic function, was applied onto the backing layer side. The surface of Subbing Lower Layer A-1 and Subbing Lower Layer B-1 was subjected to corona discharge treatment of 8 W·minute/$m^2$. Subsequently, subbing liquid coating composition a-2 was applied onto Subbing Lower Layer A-1 was applied at 33° C. and 100 m/minute to result in a dried layer thickness of 0.03 μm and dried at 140° C. The resulting layer was designated as Subbing Upper Layer A-2. Subbing liquid coating composition b-2 described below was applied onto Subbing Lower Layer B-1 at 33° C. and 100 m/minute to results in a dried layer thickness of 0.2 μm and dried at 140° C. The resulting layer was designated as Subbing Upper Layer B-2. Thereafter, the resulting support was subjected to heat treatment at 123° C. for two minutes and wound up under the conditions of 25° C. and 50 percent relative humidity, whereby a subbed sample was prepared.

(Preparation of Water-based Polyester A-1)

A mixture consisting of 35.4 parts by weight of dimethyl terephthalate, 33.63 parts by weight of dimethyl isophthalate, 17.92 parts by weight of sodium salt of dimethyl 5-sulfoisophthalate, 62 parts by weight of ethylene glycol, 0.065 part by weight of calcium acetate monohydrate, and 0.022 part by weight of manganese acetate tetrahydrate underwent transesterification at 170-220° C. under a flow of nitrogen while distilling out methanol. Thereafter, 0.04 part by weight of trimethyl phosphate, 0.04 part by weight of antimony trioxide, and 6.8 parts by weight of 4-cyclohexanedicarboxylic acid were added. The resulting mixture underwent esterification at a reaction temperature of 220-235° C. while distilling out a nearly theoretical amount of water.

Thereafter, the reaction system was subjected to pressure reduction and heating over a period of one hour and was subjected to polycondensation at a final temperature of 280° C. and a maximum pressure of 133 Pa for one hour, whereby Water-soluble Polyester A-1 was synthesized. The intrinsic viscosity of the resulting Water-soluble Polyester A-1 was 0.33, the average particle diameters was 40 nm, and Mw was 80,000-100,000.

Subsequently, 850 ml of pure water was placed in a 2-liter three-necked flask fitted with stirring blades, a refluxing cooling pipe, and a thermometer, and while rotating the stirring blades, 150 g of Water-soluble Polyester A-1 was gradually added. The resulting mixture was stirred at room temperature for 30 minutes without any modification. Thereafter, the interior temperature was raised to 98° C. over a period of 1.5 hours and at that resulting temperature, dissolution was performed. Thereafter, the temperature was lowered to room temperature over a period of one hour and the resulting product was allow to stand overnight, whereby Water-based Polyester A-1 Solution was prepared.

(Preparation of Modified Water-based Polyester B-1 and B-2 Solutions)

Placed in a 3-liter four-necked flask fitted with stirring blades, a reflux cooling pipe, a thermometer, and a dripping funnel was 1,900 ml of the aforesaid 15 percent by weight Water-based Polyester A-1 Solution, and the interior temperature was raised to 80° C., while rotating the stirring blades. Into this added was 6.52 ml of a 24 percent aqueous ammonium peroxide solution, and a monomer mixed liquid composition (consisting of 28.5 g of glycidyl methacrylate, 21.4 g of ethyl acrylate, and 21.4 g of methyl methacrylate) was dripped over a period of 30 minutes, and reaction was allowed for an additional 3 hours. Thereafter, the resulting product was cooled to at most 30° C., and filtrated, whereby Modified Water-based Polyesters B-1 Solution (vinyl based component modification ratio of 20 percent by weight) at a solid concentration of 18 percent by weight was obtained.

Modified Water-based Polyester B-2 at a solid concentration of 18 percent by weight (a vinyl based component modification ratio of 20 percent by weight) was prepared in the same manner as above except that the vinyl modification ratio was changed to 36 percent by weight and the modified component was changed to styrene glycidyl methacrylate: acetacetoxyethyl methacrylate n-butyl acrylate=39.5:40:20:0.5.

(Preparation of Acryl Based Polymer Latexes C-1-C-3)

Acryl Based Polymer Latexes C-1-C-3 having the monomer compositions shown in the following table were synthesized employing emulsion polymerization. All the solid concentrations were adjusted to 30 percent by weight.

TABLE 2

| Latex No. | Monomer Composition (weight ratio) | Tg (° C.) |
|---|---|---|
| C-1 | styrene:glycidyl methacrylate:n-butyl acrylate = 20:40:40 | 20 |
| C-2 | styrene:n-butyl acrylate:t-butyl acrylate:hydroxyethyl methacrylate = 27:10:35:28 | 55 |
| C-3 | styrene:glycidyl methacrylate:acetacetoxyethyl methacrylate = 40:40:20 | 50 |

<<Water Based Polymers Containing Polyvinyl Alcohol Units>>

D-1: PVA-617 (Water Dispersion (5 percent solids): degree of saponification of 95, manufactured by Kuraray Co., Ltd.)

| (Subbing Lower Layer Liquid Coating Composition a-1 on Image Forming Layer Side) | |
|---|---|
| Acryl Based Polymer Larex C-3 (30 percent solids) | 70.0 g |
| Water dispersion of ethoxylated alcohol and ethylene homopolymer (10 percent solids) | 5.0 g |
| Surface Active Agent (A) | 0.1 g |

A coating liquid composition was prepared by adding water to make 1,000 ml.

<<Image Forming Layer Side Subbing Upper Layer Liquid Coating Composition a-2>>

| | |
|---|---|
| Modified Water-based Polyester B-2 (18 percent by weight) | 30.0 g |
| Surface Active Agent (A) | 0.1 g |
| Spherical silica matting agent (Sea Hoster KE-P50, manufactured by Nippon Shokubai Co., Ltd.) | 0.04 g |

A liquid coating composition was prepared by adding water to make 1,000 ml.

| (Backing Layer Side Subbing Lower Layer Liquid Coating Composition b-1) | |
|---|---|
| Acryl Based Polymer Late C-1 (30 percent solids) | 30.0 g |

-continued

| (Backing Layer Side Subbing Lower Layer Liquid Coating Composition b-1) | |
|---|---|
| Acryl Based Polymer Late C-2 (30 percent solids) | 7.6 g |
| $SnO_2$ sol | 180 g |

(the solid concentration of $SnO_2$ sol synthesized employing the method described in Example 1 of Japanese Patent Publication 35-6616 was heated and concentrated to reach a solid concentration of 10 percent by weight, and subsequently, the pH was adjusted to 10 by the addition of ammonia water)

| | |
|---|---|
| Surface Active Agent (A) | 0.5 g |
| 5 percent by weight of PVA-613 (PVA, manufactured by Kuraray Co., Ltd.) | 0.4 g |

A liquid coating composition was prepared by adding water to make 1,000 ml.

| (Backing Layer Side Subbing Upper Layer Liquid Coatings composition b-2) | |
|---|---|
| Modified Water-based Polyester B-1 (18 percent by weight) | 145.0 g |
| Spherical silica matting agent (Sea Hoster KE-P50, manufactured by Nippon Shokubai Co., Ltd.) | 0.2 g |
| Surface Active Agent (A) | 0.1 g |

A liquid coating composition was prepared by adding water to make 1,000 ml.

Incidentally, an antihalation layer having the composition described below was applied onto Subbing Layer A-2 applied onto the aforesaid support.

| (Antihalation Layer Coating Composition) | |
|---|---|
| PVB-1 (binding agent) | 0.8 $g/m^2$ |
| C1 (dye) | $1.2 \times 10^{-5}$ $mol/m^2$ |

On the other hand, each of the liquid coating compositions of a BC layer and its protective layer which was prepared to achieve a coated amount (per $m^2$) described below was successively applied onto the aforesaid Subbing Upper Layer B-2 and subsequently dried, whereby a BC layer and a protective layer were formed.

| (BC Layer Composition) | |
|---|---|
| PVB-1 (binding agent) | 1.8 g |
| C1 (dye) | $1.2 \times 10^{-5}$ mol |
| (BC Layer Protective Layer Liquid Coating Composition) | |
| Cellulose acetate butyrate | 1.1 g |
| Matting agent (polymethyl methacrylate at an average particle diameter of 5 μm) | 0.12 g |

-continued

| | |
|---|---|
| Antistatic agent F-EO | 250 mg |
| Antistatic agent F-DS1 | 30 mg |

Surface Active Agent (A)

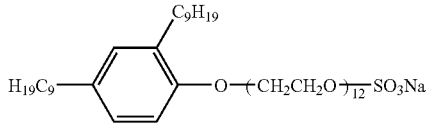

C1 (Dye)

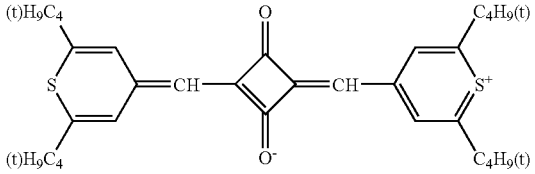

F-EO

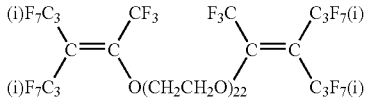

F-DS1

$LiO_3S—(CF_2)_3—SO_3Li$

<<Preparation of Photosensitive Silver Halide Emulsion>>

| (Preparation of Photosensitive Silver Halide Emulsion 1) | |
|---|---|
| (Solution A1) | |
| Phenylcarbamoyl-modified gelatin | 88.3 g |
| Compound(*1) (10% aqueous methanol solution) | 10 ml |
| Potassium bromide | 0.32 g |
| Water to make | 5429 ml |
| (Solution B1) | |
| 0.67 mol/L aqueous silver nitrate solution | 2635 ml |
| (Solution C1) | |
| Potassium bromide | 51.55 g |
| Potassium iodide | 1.47 g |
| Water to make | 660 ml |
| (Solution D1) | |
| Potassium bromide | 154.9 g |
| Potassium iodide | 4.41 g |
| $K_3IrCl_6 + K_4[Fe(CN)_6]$ (equivalent to $2 \times 10^{-5}$ mol/Ag) | 50.0 ml |
| Water to make | 1982 ml |
| (Solution E1) | |
| 0.4 mol/L aqueous potassium bromide solution | the following amount controlled by silver potential |
| (Solution F1) | |
| Potassium hydroxide | 0.71 g |
| Water to make | 20 ml |
| (Solution G1) | |
| 56 percent aqueous acetic acid solution | 18.0 ml |

-continued

| (Preparation of Photosensitive Silver Halide Emulsion 1) | |
|---|---|
| (Solution H1) | |
| Sodium carbonate anhydride | 1.72 g |
| Water to make | 151 ml |

(*1) Compound A: $HO(CH_2CH_2O)_n(CH(CH_3)CH_2O)_{17}(CH_2CH_2O)_mH$ (m + N = 5 through 7)

Upon employing a mixing stirrer shown in Japanese Patent Publication Nos. 58-58288 and 58-58289, ¼ portion of Solution B1 and whole Solution C1 were added to Solution A1 over 4 minutes 45 seconds, employing a double-jet precipitation method while adjusting the temperature to 30° C. and the pAg to 8.09, whereby nuclei were formed. After one minute, whole Solution F1 was added. During the addition, the pAg was appropriately adjusted employing Solution E1. After 6 minutes, ¾ portion of Solution B1 and whole Solution D1 were added over 14 minutes 15 seconds, employing a double-jet precipitation method while adjusting the temperature to 30° C. and the pAg to 8.09. After stirring for 5 minutes, the mixture was cooled to 40° C., and whole Solution G1 was added, whereby a silver halide emulsion was flocculated. Subsequently, while leaving 2000 ml of the flocculated portion, the supernatant was removed, and 10 L of water was added. After stirring, the silver halide emulsion was again flocculated. While leaving 1,500 ml of the flocculated portion, the supernatant was removed. Further, 10 L of water was added. After stirring, the silver halide emulsion was flocculated. While leaving 1,500 ml of the flocculated portion, the supernatant was removed. Subsequently, Solution H1 was added and the resultant mixture was heated to 60° C., and then stirred for an additional 120 minutes. Finally, the pH was adjusted to 5.8 and water was added so that the weight was adjusted to 1,161 g per mol of silver, whereby an emulsion was prepared.

The prepared emulsion was comprised of monodispersed cubic silver iodobromide grains having an average grain size of 0.040 μm, a grain size variation coefficient of 12 percent and a (100) surface ratio of 92 percent.

(Preparation of Photosensitive Silver Halide Emulsion 2)

Photosensitive Silver Halide Emulsion 2 was prepared in the same manner as aforesaid Photosensitive Silver Halide Emulsion 1, except that 5 ml of 0.4 percent aqueous lead bromide solution was added to Solution D1.

Incidentally, the prepared emulsion was comprised of monodispersed cubic silver iodobromide grains having an average grain size of 0.042 μm, a grain size variation coefficient of 14 percent and a (100) surface ratio of 94 percent.

(Preparation of Photosensitive Silver Halide Emulsion 3)

Photosensitive Silver Halide Emulsion 3 was prepared in the same manner as aforesaid Photosensitive Silver Halide Emulsion 1, except that after nucleus formation, all Solution F1 was added, and subsequently 40 ml of a 5 percent aqueous 4-hydroxy-6-methyl-1,3,3a,7-tetraazaindene solution was added.

Incidentally, the prepared emulsion was comprised of monodispersed cubic silver iodobromide grains having an average grain size of 0.041 μm, a grain size variation coefficient of 14 percent and a (100) surface ratio of 93 percent.

(Preparation of Photosensitive Silver Halide Emulsion 4)

Photosensitive Silver Halide Emulsion 4 was prepared in the same manner as aforesaid Photosensitive Silver Halide Emulsion 1, except that after nucleus formation, all Solution F1 was added, and subsequently 4 ml of a 0.1 percent ethanol solution of ETTU (indicated below) was added.

Incidentally, the prepared emulsion was comprised of monodispersed cubic silver iodobromide grains having an average grain size of 0.042 μm, a grain size variation coefficient of 10 percent and a (100) surface ratio of 94.

Stabilizer 1

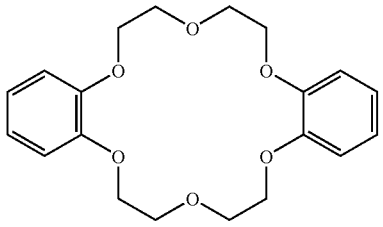

Sulfur sensitizer S-5

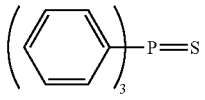

Antifoggant 1

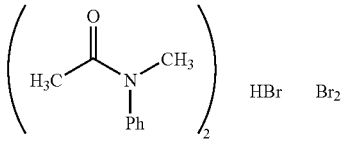

ETTU

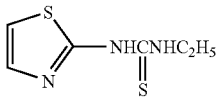

-continued

Stabilizer 2

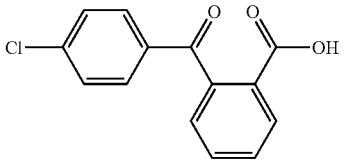

Antifoggant 2

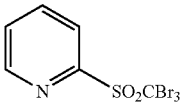

Infrared sensitizing dye 1

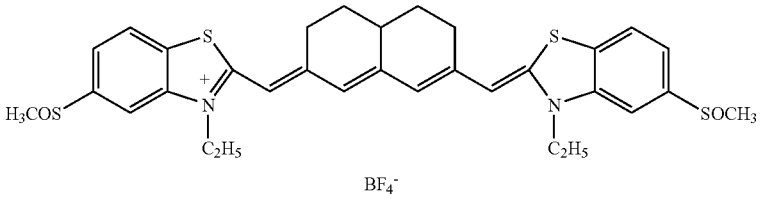

Infrared sensitizing dye 2

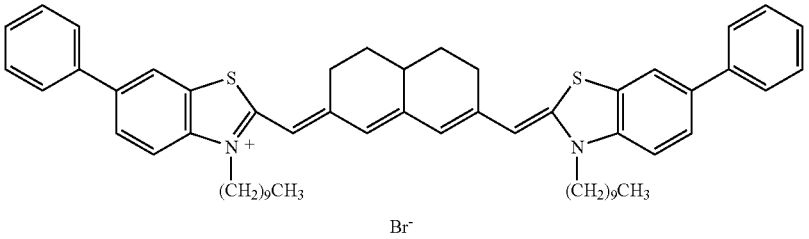

(Preparation of Photosensitive Silver Halide Emulsion 5)

Photosensitive Silver Halide Emulsion 5 was prepared in the same manner as aforesaid Photosensitive Silver Halide Emulsion 1, except that after nucleus formation, all Solution F1 was added, and subsequently 4 ml of a 0.1 percent ethanol solution of 1,2-benzothiazoline-3-one was added.

Incidentally, the prepared emulsion was comprised of monodispersed cubic silver bromide grains having an average grain size of 0.041 μm, a grain size variation coefficient of 11 percent and a (100) surface ratio of 93 percent.

<<Preparation of Photosensitive Layer Coating Composition>>

(Preparation of Powder Aliphatic Carboxylic Acid Silver Salt A)

Dissolved in 4,720 ml of pure water were 117.7 g of behenic acid, 60.9 g of arachidic acid, 39.2 g of stearic acid, and 2.1 g of palmitic acid at 80° C. Subsequently, 486.2 ml of a 1.5 M aqueous sodium hydroxide solution was added, and further, 6.2 ml of concentrated nitric acid was added. Thereafter, the resultant mixture was cooled to 55° C., whereby an aliphatic acid sodium salt solution was prepared. After 347 ml of t-butyl alcohol was added and stirred for 20 min, the above-described Photosensitive Silver Halide Emulsion 1 as well as 450 ml of pure water was added and stirred for 5 minutes.

Subsequently, 702.6 ml of one mol silver nitrate solution was added over two minutes and stirred for 10 minutes, whereby an aliphatic carboxylic acid silver salt dispersion was prepared. Thereafter, the resultant aliphatic carboxylic acid silver salt dispersion was transferred to a water washing machine, and deionized water was added. After stirring, the resultant dispersion was allowed to stand, whereby a flocculated aliphatic carboxylic acid silver salt was allowed to float and was separated, and the lower portion, containing water-soluble salts, were removed. Thereafter, washing was repeated employing deionized water until electric conductivity of the resultant effluent reached 50 μS/cm. After centrifugal dehydration, the resultant cake-shaped aliphatic carboxylic acid silver salt was dried employing an gas flow type dryer Flush Jet Dryer (manufactured by Seishin Kikaku Co., Ltd.), while setting the drying conditions such as nitrogen gas as well as heating flow temperature at the inlet of the dryer, until its water content ratio reached 0.1 percent, whereby Powder Aliphatic Carboxylic Acid Silver Salt A was prepared. The water content ratio of aliphatic carboxylic acid silver salt compositions was determined employing an infrared moisture meter.

A silver salt conversion ratio of the aliphatic carboxylic acid was confirmed to be about 95%, measured by the above-described method.

<<Preparation of Preliminary Dispersion A>>

Dissolved in 1457 g of methyl ethyl ketone (hereinafter referred to as MEK) was 14.57 g of poly(vinyl butyral) resin P-9. While stirring, employing Dissolver DISPERMAT Type CA-40M, manufactured by VMA-Getzmann Co., 500 g of aforesaid Powder Aliphatic Carboxylic Acid Silver Salt A was gradually added and sufficiently mixed, whereby Preliminary Dispersion A was prepared.

(Preparation of Photosensitive Emulsion A)

Preliminary Dispersion A, prepared as above, was charged into a media type homogenizer DISPERMAT Type SL-C12EX (manufactured by VMA-Getzmann Co.), filled with 0.5 mm diameter zirconia beads so as to occupy 80 percent of the interior volume so that the retention time in the mill reached 1.5 minutes and was dispersed at a peripheral rate of the mill of 8 m/second, whereby Photosensitive Emulsion A was prepared.

(Preparation of Stabilizer Solution)

Stabilizer Solution was prepared by dissolving 1.0 g of Stabilizer 1 and 0.31 g of potassium acetate in 4.97 g of methanol.

(Preparation of Infrared Sensitizing Dye A Solution)

Infrared Sensitizing Dye A Solution was prepared by dissolving 19.2 mg of Infrared Sensitizing Dye 1, 10 mg of Infrared Sensitizing Dye 2, 1.48 g of 2-chloro-benzoic acid, 2.78 g of Stabilizer 2, and 365 mg of 5-methyl-2-mercaptobenzimidazole in 31.3 ml of MEK in a light-shielded room.

(Preparation of Additive Solution "a")

Additive Solution "a" was prepared by dissolving 27.98 g of 1,1-bis(2-hydroxy-3,5-dimethylphenyl)-3,5,5-trimethylhexane (Developing Agent A) and 1.54 g of 4-methylphthalic acid, and 0.20 g of aforesaid Infrared Dye 1 in 110 g of MEK.

Incidentally, in the present experiments, other than aforesaid Developing Agent A, other developing agents were selected from the compounds represented by General Formula (RED) as well as development accelerators (10 mol % based on the total development used) shown in Table 3. In addition, 150 ml of a leuco dye shown in Table 3 is also added to Additive Solution "a"

(Preparation of Additive Solution "b")

Additive Solution "b" was prepared by dissolving 3.56 g of Antifoggant 2 and 3.43 g of phthalazine in 40.9 g of MEK.

(Preparation of Photosensitive Layer Coating Composition A)

While stirring, 50 g of aforesaid Photosensitive Emulsion A and 15.11 g of MEK were mixed and the resultant mixture was maintained at 21° C. Subsequently, 390 μl of Antifoggant 1 (being a 10 percent methanol solution) was added and stirred for one hour. Further, 494 μl of calcium bromide (being a 10 percent methanol solution) was added and stirred for 20 minutes. Subsequently, 167 ml of aforesaid Stabilizer Solution was added and stirred for 10 minutes. Thereafter, 1.32 g of aforesaid Infrared Sensitizing Dye A was added and the resulting mixture was stirred for one hour. Subsequently, the resulting mixture was cooled to 13° C. and stirred for an additional 30 minutes. While maintaining at 13° C., 13.31 g of poly(vinyl acetal) Resin P-1 as a binder was added and stirred for 30 minutes. Thereafter, 1.084 g of tetrachlorophthalic acid (being a 9.4 weight percent MEK solution) was added and stirred for 15 minutes. Further, while stirring, 12.43 g of Additive Solution "a", 1.6 ml of Desmodur N300/aliphatic isocyanate, manufactured by Mobay Chemical Co. (being a 10 percent MEK solution), and 4.27 g of Additive Solution "b" were successively added, whereby Photosensitive Layer Coating Composition A was prepared.

<<Surface Protective Layer>>

The liquid coating composition having the formulation described below was prepared in the same manner as the photosensitive layer liquid coating composition and was subsequently applied onto a photosensitive layer to result in the coated amount (per $m^2$) below, and subsequently dried, whereby a photosensitive layer protective layer was formed.

| | |
|---|---|
| Cellulose acetate propionate | 2.0 g |
| 4-Methyl phthalate | 0.7 g |
| Tetrachlorophthalic acid | 0.2 g |
| Tetrachlorophthalic anhydride | 0.5 g |
| Silica matting agent (at an average diameter of 5 μm) | 0.5 g |
| 1,3-bis (vinylsulfonyl)-2-propanol | 50 mg |
| Benzotriazole | 30 mg |
| Antistatic Agent: F-EO | 20 mg |
| Antistatic Agent: F-DS1 | 3 mg |

Incidentally, polyacetal was employed as a binding agent, and methyl ethyl ketone (MEK) was employed as an organic solvent. Polyacetal was prepared as follows. Polyvinyl acetate at a degree of polymerization of 500 was saponified to a ratio of 98 percent, and subsequently, 86 percent of the residual hydroxyl groups were butylated. The resulting polyacetal was designated as PVB-1.

<<Preparation of Silver Salt Photothermographic Dry Imaging Material Samples>>

Photosensitive Layer Liquid Coating Composition A and Surface Protective Layer Liquid Coating Composition, prepared as above, were simultaneously applied onto the subbing layer on the support prepared as above, employing a prior art extrusion type coater, whereby Sample 101 was prepared. The coating was performed so that the coated silver amount of the photosensitive layer reached 1.5 g/$m^2$ and the thickness of the surface protective layer reached 2.5 μm after drying. Thereafter, drying was performed employing a drying air flow at a temperature of 75° C. and a dew point of 10° C. for 10 minutes, whereby Sample 101 was prepared.

Subsequently, Samples 102-119 were prepared in the same manner as Sample 101, except that the kinds of photosensitive silver halide emulsions in Photosensitive Layer Liquid Coating Composition A, developing agents, the silver behenate ratio in aliphatic carboxylic acid silver were changed as shown in Table 3. Incidentally, the relative ratio of the content ratio of the three types of of silver behenate, silver arachidate, and silver palmitate was kept constant.

<<Evaluation of Each Characteristic>>

(Exposure and Development Process)

Scanning exposure was given onto the emulsion side surface of each sample prepared as above, employing an exposure apparatus in which a semiconductor laser, which was subjected to longitudinal multi mode of a wavelength of 800 to 820 nm, employing high frequency superposition, was employed as a laser beam source. In such a case, images were formed while adjusting the angle between the exposed surface of the sample and the exposure laser beam to 75 degrees. By employing such a method, compared to the case in which the angle was adjusted to 90 degrees, images were obtained which minimized unevenness and surprisingly exhibited excellent sharpness.

Thereafter, while employing an automatic processor having a heating drum, the protective layer of each sample was brought into contact with the surface of the drum and thermal development was carried out at 110° C. for 15 seconds. In such a case, exposure as well as development was carried out in the room which was conditioned at 23° C. and 50 percent relative humidity.

(Measurement of Speed, Fog Density, and Maximum Density)

The density of the resulting images formed as above was measured employing a densitometer and characteristic curves were prepared in which the abscise shows the exposure amount and the ordinate shows the density. Utilizing the resulting characteristic curve, speed was defined as the reciprocal of an exposure amount to result in density higher 1.0 than the unexposed part, and fog density (minimum density) as well as maximum density was determined. Incidentally, the speed and the maximum density were shown as a relative value when each value of Sample 101 was 100.

(Evaluation of Image Retention Properties after Development)

<Measurement of Variation Ratio of Minimum Density ($D_{min}$)>

Each of thermally developed samples, which had been prepared employing the same method as the aforesaid speed determination, was allowed to stand for three days at an ambience of 45° C. and 55 percent relative humidity while a commercially available fluorescent lamp was arranged so as to result in an illuminance of 500 lux on the surface of each sample. The minimum density (D2) of each of fluorescent light-exposed samples and the minimum density (D1) of each of fluorescent light-unexposed samples were determined, and the variation ratio (in percent) of minimum density was calculated based on the formula described below.

Variation ratio of minimum density=$D2/D1\times100$ (in percent)

<Determination of Variation Ratio of Maximum Density ($D_{max}$)>

Each of thermally developed samples, which had been prepared in the same manner as the determination of the variation ratio of minimum density, was allowed to stand for three days at an ambience of 25° C. and 45° C. Thereafter, the variation of the maximum density was determined, and the variation ratio of image density was determined based on the formula described below, which was utilized as the scale of the image retention Properties.

Variation ratio of maximum density=maximum density of the sample stored at 45° C./maximum density of the sample stored at 25° C.×100 (in percent)

(Evaluation of Image Color Tone: Determination of u* and v*, and a* and b*)

Employing a thermal development apparatus, a 4-step wedge sample including an unexposed portion, and optical densities of 0.5, 1.0, and 1.5 was prepared. Each of the density portions of the wedge, prepared as above, was determined employing CM-3600d (manufactured by Minolta Co., Ltd.), and either u* and v* or a* and b* were calculated. When determined, measurement conditions were such that F7 light source was used as a light source, and a transmission measurement mode was employed at a visual field angle of 10 degrees. Subsequently, measured u* and v* or measured a* and b* were plotted on a graph in which u* or a* was used as the abscissa, while v* or b* was used as the ordinate, and a linear regression line was obtained. The coefficient of determination value $R^2$, intercepts and gradients were then obtained.

TABLE 3

| Sample No. | *1 | *2 | Type of Developing Agent or Development Accelerator | Presence of Leuco Dye | Fog | Relative Photographic Speed | *3 | Storage Stability after Development: Dmin Variation Ratio (%) | Storage Stability after Development: Dmax Variation Ratio (%) | Evaluation of Color Tone of Silver Image *4: $R^2$ | Intercept | Gradient | Visual Evaluation | Remarks |
|---|---|---|---|---|---|---|---|---|---|---|---|---|---|---|
| 101 | 1 | 54(K100) | A(RED-12) | none | 0.240 | 100(28) | 100 | 145 | 85 | 0.515 | −8.7 | 0.3 | poor | Comp. |
| 102 | 2 | 54(K100) | A | none | 0.215 | 97(13) | 98 | 125 | 92 | 0.635 | −7.4 | 0.4 | poor | Comp. |
| 103 | 3 | 54(K100) | A | none | 0.210 | 110(15) | 105 | 120 | 94 | 0.640 | −7.2 | 0.4 | poor | Comp. |
| 104 | 4 | 54(K100) | A | none | 0.205 | 125(5) | 130 | 118 | 95 | 0.750 | −7.5 | 0.5 | poor | Comp. |
| 105 | 5 | 54(K100) | A | none | 0.210 | 108(16) | 104 | 122 | 92 | 0.630 | −7.3 | 0.4 | poor | Comp. |
| 106 | 1 | 54(K100) | A | YL-3 | 0.242 | 103(27) | 103 | 148 | 87 | 0.850 | −6.0 | 0.6 | poor | Comp. |
| 107 | 1 | 54(K100) | A | YL-8 | 0.243 | 100(29) | 100 | 143 | 84 | 0.905 | −5.8 | 0.5 | poor | Comp. |
| 108 | 1 | 54(K100) | A | CL-8 | 0.245 | 105(28) | 103 | 147 | 85 | 0.910 | −5.7 | 0.7 | poor | Comp. |
| 109 | 4 | 54(K100) | A | YL-3 | 0.210 | 125(5) | 130 | 118 | 95 | 0.988 | −3.8 | 0.7 | good | Inv. |
| 110 | 4 | 54(K100) | A | YL-8 | 0.212 | 126(5) | 129 | 119 | 94 | 0.988 | −4.0 | 0.8 | good | Inv. |
| 111 | 4 | 54(K100) | A | CL-8 | 0.214 | 127(6) | 131 | 118 | 95 | 0.999 | −2.5 | 0.9 | good | Inv. |
| 112 | 4 | 54(K100) | RED-13 | YL-3 | 0.190 | 130(5) | 135 | 110 | 97 | 0.999 | 0.4 | 1.2 | excellent | Inv. |
| 113 | 4 | 54(K100) | RED-13/-10 | YL-3 | 0.193 | 145(5) | 148 | 112 | 97 | 0.999 | 0.3 | 1.1 | excellent | Inv. |
| 114 | 4 | 54(K100) | RED-13/B* | YL-3 | 0.195 | 140(5) | 140 | 113 | 96 | 0.999 | 0.3 | 1.2 | excellent | Inv. |
| 115 | 4 | 54(K100) | RED-17/-10 | YL-3 | 0.194 | 143(5) | 145 | 113 | 96 | 0.999 | 0.3 | 0.9 | excellent | Inv. |
| 116 | 4 | 65(K100) | RED-17/-10 | YL-3 | 0.196 | 138(5) | 140 | 110 | 97 | 0.999 | 0.3 | 0.9 | excellent | Inv. |
| 117 | 4 | 85(K100) | RED-17/-10 | YL-3 | 0.197 | 136(5) | 135 | 108 | 98 | 1.00 | 0.4 | 1.0 | excellent | Inv. |
| 118 | 4 | 98(K100) | RED-17/-10 | YL-3 | 0.199 | 136(5) | 133 | 104 | 98 | 1.00 | 0.4 | 1.0 | excellent | Inv. |

TABLE 3-continued

| Sample No. | *1 | *2 | Type of Developing Agent or Development Accelerator | Presence of Leuco Dye | Fog | Relative Photographic Speed | *3 | Storage Stability after Development: Dmin Variation Ratio (%) | Storage Stability after Development: Dmax Variation Ratio (%) | Evaluation of Color Tone of Silver Image *4: $R^2$ | Intercept | Gradient | Visual Evaluation | Remarks |
|---|---|---|---|---|---|---|---|---|---|---|---|---|---|---|
| 119 | 4 | 98(K100) | RED-17/-10 | YL-3/CL-8 | 0.200 | 137(5) | 135 | 104 | 98 | 1.10 | 0.1 | 1.0 | excellent | Inv. |

Comp.: Comparative Example
Inv.: Present Invention
*1: Type of Silver Halide Emulsion
*2: Content Ratio of Silver Behenate
*3: Maximum Density (relative value)
*4: Evaluation Based on Linear Regression Line Note: In the above table, K100 means that in the preparation step of aliphatic carboxylic acid silver, the alkaline metal of the aforesaid aliphatic alkaline metals salts is comprised of 100 percent potassium. Further, B* means the following development accelerator. Incidentally, the employed developing agent RED-13 contained at least 90 percent cis form.

Development Accelerator B*

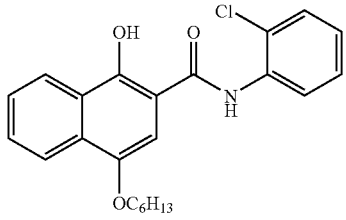

Note: Numerical values in parenthesis are determined as follows. A photosensitive material is subjected to thermal treatment at a thermal development temperature, prior to white light exposure to the aforesaid photosensitive material. Thereafter, the resulting photosensitive material is subjected to white light exposure (4874 K and 30 seconds) through an optical wedge and thermally developed, whereby photographic speed is determined. On the other hand, no thermal treatment is performed prior to exposure, white light exposure is performed under the same conditions, as described above, and thermal development is then performed, whereby photographic speed is also determined. The numerical value is a relative photographic speed when the latter is 100. In this relative comparison, a decrease in relative photographic speed of samples which had been thermally treated at the thermally developing temperature prior to white light exposure was confirmed mainly based on observation/determination of the variation of the relative relationship between the surface speed and the internal speed of silver halide grains, due to disappearance or a decrease of spectral sensitization effects.

As can clearly be seen from Table 3, silver salt photothermographic dry imaging materials of the present invention resulted in fog (minimum density) equal to or less than the comparative examples. Even though the photographic speed and the maximum density were equal to or better than the comparative examples, image storage stability after photographic processing was excellent.

Further, in the color tone evaluation of the samples according to the present invention, the coefficient of determination value $R^2$ was 0.998-1.000; b* value of the intersection of the aforesaid linear regression line with the ordinate was −5-+5; gradient (b*/a*) was 0.7-2.5, whereby it was possible to state that the desired color tone was obtained.

Example 2

Various types of the following silver halide emulsions were prepared employing the same method as Example 1.

(Preparation of Photosensitive Silver Halide Emulsion 6)

Photosensitive Silver Halide Emulsion 6 was prepared in the same manner as aforesaid Photosensitive Silver Halide Emulsion 1, except that the temperature prior to the addition of Solution (G1) was set at 25° C., and after the addition of all Solution F1 after nucleolus formation, 4 ml of 0.1 percent ethanol solution of the aforesaid Compound (ETTU) was added.

The resulting emulsion was comprised of monodipsersed cubic silver iodobromide grains of an average grain size of 0.035, a variation coefficient of the particle size of 12 percent, and a [100] plane ratio of 93 percent.

(Preparation of Photosensitive Silver Halide Emulsion 7)

Photosensitive Silver Halide Emulsion 7 was prepared in the same manner as aforesaid Photosensitive Silver Halide Emulsion 1, except that the temperature prior to the addition of Solution (G1) was set at 45° C., and after the addition of all Solution F1 after nucleolus formation, 4 ml of 0.1 percent ethanol solution of the aforesaid Compound (ETTU) was added.

The resulting emulsion was comprised of monodipsersed cubic iodobromide grains of an average grain size of 0.060 μm, a variation coefficient of the particle size of 12 percent, and a ratio of the [100] plane of 93 percent.

(Preparation of Photosensitive Silver Halide Emulsion 8)

Photosensitive Silver Halide Emulsion 8 was prepared in the same manner as aforesaid Photosensitive Silver Halide Emulsion 1, except that the temperature prior to the addition of Solution (G1) was set at 60° C., and after the addition of all Solution F1 after nucleolus formation, 4 ml of 0.1 percent ethanol solution of the aforesaid Compound (ETTU) was added.

The resulting emulsion was comprised of monodipsersed cubic iodobromide grains of an average grain size of 0.080 μm, a variation coefficient of the particle size of 12 percent, and a ratio of the [100] plane of 93 percent.

(Preparation of Photosensitive Silver Halide Emulsion 9)

Photosensitive Silver Halide Emulsion 9 was prepared in the same manner as aforesaid Photosensitive Silver Halide Emulsion 6, except that after the addition of all Solution F1 after nucleolus formation, 4 ml of Compound (ETTU) was not added.

The resulting emulsion was comprised of monodipsersed cubic iodobromide grains of an average grain size of 0.035 μm, a variation coefficient of the particle size of 13 percent, and a ratio of the [100] plane of 94 percent.

(Preparation of Photosensitive Silver Halide Emulsion 11)

Photosensitive Silver Halide Emulsion 11 was prepared in the same manner as aforesaid Photosensitive Silver Halide Emulsion 8, except that after the addition of all Solution F1 after nucleolus formation, 4 ml of Compound (ETTU) was not added.

The resulting emulsion was comprised of monodipsersed cubic iodobromide grains of an average grain size of 0.082 μm, a variation coefficient of the particle size of 14 percent, and a ratio of the [100] plane of 91 percent.

Subsequently, by employing the method according to the preparation method of Powdered Aliphatic Carboxylic Acid Salt A in Example 1, aliphatic carboxylic acids were prepared in the presence of any of aforesaid Silver Halide Emulsions 6-11 and 4 while employing alkali metal salts of aliphatic carboxylic acids having compositions shown in Table 4, and various types of samples listed in Table 4 were prepared in the same manner as Example 1. However, in all the samples, the developing agent and the leuco dye were the same as Example 1.

Samples were evaluated in the same manner as Example 1.

TABLE 4

| Sample No. | *1 | *2 | *3 | Fog | Relative Photographic Speed | Maximum Density (relative density) | Storage Stability Dmin Variation Rate (%) | Storage Stability Dmax Variation Rate (%) | Remarks |
|---|---|---|---|---|---|---|---|---|---|
| 201 | 6 | 0.035 | 54(Na100 + K0) | 0.202 | 100(10) | 100 | 120 | 95 | Inv. |
| 202 | 6 | 0.035 | 54(Na75 + K25) | 0.201 | 102(9) | 103 | 119 | 95 | Inv. |
| 203 | 6 | 0.035 | 54(Na50 + K50) | 0.201 | 110(8) | 120 | 117 | 96 | Inv. |
| 204 | 6 | 0.035 | 54(Na25 + K75) | 0.198 | 115(7) | 135 | 118 | 96 | Inv. |
| 205 | 6 | 0.035 | 54(Na0 + K100) | 0.198 | 132(7) | 140 | 115 | 98 | Inv. |
| 206 | 9 | 0.035 | 54(Na0 + K100) | 0.202 | 120(30) | 132 | 155 | 75 | Comp. |
| 207 | 4 | 0.042 | 54(Na100 + K0) | 0.204 | 100(8) | 100 | 125 | 92 | Inv. |
| 208 | 4 | 0.042 | 54(Na75 + K25) | 0.202 | 100(8) | 102 | 123 | 92 | Inv. |
| 209 | 4 | 0.042 | 54(Na50 + K50) | 0.201 | 105(7) | 117 | 119 | 94 | Inv. |
| 210 | 4 | 0.042 | 54(Na25 + K75) | 0.201 | 110(6) | 127 | 118 | 95 | Inv. |
| 211 | 4 | 0.042 | 54(Na0 + K100) | 0.200 | 120(5) | 133 | 112 | 97 | Inv. |
| 212 | 1 | 0.040 | 54(Na100 + K0) | 0.203 | 105(28) | 120 | 145 | 85 | Comp. |
| 213 | 7 | 0.060 | 54(Na100 + K0) | 0.205 | 100(7) | 100 | 126 | 92 | Inv. |
| 214 | 7 | 0.060 | 54(Na25 + K75) | 0.205 | 100(6) | 101 | 125 | 93 | Inv. |
| 215 | 7 | 0.060 | 54(Na50 + K50) | 0.204 | 103(6) | 105 | 120 | 94 | Inv. |
| 216 | 7 | 0.060 | 54(Na25 + K75) | 0.202 | 107(5) | 110 | 120 | 94 | Inv. |
| 217 | 7 | 0.060 | 54(Na0 + K100) | 0.201 | 110(3) | 115 | 110 | 95 | Inv. |
| 218 | 10 | 0.060 | 54(Na0 + K100) | 0.202 | 102(32) | 106 | 137 | 88 | Comp. |
| 219 | 8 | 0.080 | 54(Na100 + K0) | 0.208 | 100(6) | 100 | 128 | 91 | Inv. |
| 220 | 8 | 0.080 | 54(Na75 + K25) | 0.209 | 101(6) | 100 | 127 | 92 | Inv. |
| 221 | 8 | 0.080 | 54(Na50 + K50) | 0.209 | 105(5) | 105 | 125 | 94 | Inv. |
| 222 | 8 | 0.080 | 54(Na25 + K75) | 0.209 | 108(3) | 107 | 125 | 94 | Inv. |
| 223 | 8 | 0.080 | 54(Na0 + K100) | 0.208 | 112(2) | 110 | 120 | 95 | Inv. |
| 224 | 11 | 0.080 | 54(Na0 + K100) | 0.210 | 101(33) | 105 | 147 | 89 | Comp. |

Inv.: Present Invention
Comp.: Comparative Example
*1: Type of silver halide emulsion
*2: Average diameter of silver halide grains
*3: Behenic acid containing ratio, and type and ratio of aliphatic alkali metal salt employed in the preparation process of aliphatic acid silver (Preparation of Photosensitive Silver Halide Emulsion 10)

Photosensitive Silver Halide Emulsion 10 was prepared in the same manner as aforesaid Photosensitive Silver Halide Emulsion 7, except that after the addition of all Solution F1 after nucleolus formation, 4 ml of Compound (ETTU) was not added.

The resulting emulsion was comprised of monodipsersed cubic iodobromide grains of an average grain size of 0.060 μm, a variation coefficient of the particle size of 14 percent, and a ratio of the [100] plane of 93 percent.

In Table 4, Na100, Na75, Na50, Na25, and Na0 mean that in the preparation process of aliphatic carboxylic acid silver, each of the percentage occupied by sodium in alkali metals in the aforesaid fatty acid alkali metal salts is 100 percent, 75 percent, 50 percent, 25 percent, or 0 percent.

Note: Numerical values in parenthesis are determined as follows. A photosensitive material is subjected to a thermal treatment at a thermal development temperature prior to white light exposure to the aforesaid photosensitive material. Thereafter, the resulting photosensitive material is subjected to white light exposure (4874 K and 30 seconds) through an optical wedge and thermally developed, whereby photographic speed is determined. On the other hand, no thermal treatment is performed prior to exposure, white light exposure is performed under the same conditions as described above, and thermal development is then performed, whereby photographic speed is also determined. The numerical value is a relative photographic speed when the latter is 100. In this relative comparison, a decrease in relative photographic speed of samples, which had been thermally treated at the thermally developing temperature prior to white light exposure was confirmed mainly based on observation/determination of the variation of the relative relationship between the surface speed and the internal speed of silver halide grains due to disappearance or a decrease of spectral sensitization effects and chemical sensitization effects.

As can clearly be seen from Table 4, even though silver salt photothermographic dry imaging materials of the present invention resulted in fog (minimum density) equal to or less than the comparative examples, they resulted in photographic speed equal to or more than the comparative examples, and also maximum density equal to or higher than the comparative example. Specifically, they exhibited excellent storage stability of images after photographic processing. Further, it is to be noted that as the ratio of potassium salts in alkali metal salts employed in the preparation process of aliphatic carboxylic acid silver increased, and as the average diameter of coexisting silver halide grains decreased, the resulting maximum density and relative photographic speed increased.

Incidentally, in the color tone evaluation of the samples according to the present invention, the coefficient of determination value $R^2$ was 0.998-1.000; b* value of the intersection of the aforesaid linear regression line with the ordinate was −5-+5; and gradient (b*/a*) was 0.7-2.5, whereby the desired color tone was obtained.

Example 3

By employing Silver Halide Emulsions 1 and 4, each of the samples containing the compounds represented by General Formula (ST), the compounds represented by General Formula (CV), and polymers having a halogen radical releasing group, as shown in Table 5, was prepared in the same manner as Example 1, and each effect was investigated.

Incidentally, the added amount and addition method of the compound represented by General Formula (ST), the compound represented by General Formula (CV), and polymers having a halogen radical releasing group were as follows.

The compound represented by General Formula (ST) was added to a photosensitive liquid coating composition just prior to coating to result in a coated amount of 0.015 g/m$^2$. The compound represented by General Formula (CV) was added to a protective layer liquid coating composition just prior to coating to result in a coated amount of 0.135 g/m$^2$. The polymer having a halogen radical releasing group was added to a photosensitive liquid coating composition just prior to coating to result in a coated amount of 0.45 g/m$^2$.

In regard to preparation of samples of silver salt photothermographic dry imaging materials, the various types of samples listed in Table 5 were prepared. However, in all the samples, developing agents and leuco dyes were added in the same manner as Example 1. The resulting samples were also evaluated in the same manner as Example 1.

Incidentally, storage stability prior to development was evaluated according to the method below.

(Evaluation of Storage Stability Prior to Development)

After storing each of the samples under the conditions below for 10 days, the resulting sample was exposed and developed employing a method similar to sensitometry. Thereafter, the photographic speed and minimum density of the resulting image were determined. Subsequently, minimum density (Dmin) of each sample at Condition B with respect to Condition A, as well as the variation ratio of photographic speed was obtained based on the formula below, and these were employed as a measure of the storage stability prior to development.

Incidentally, the resulting sample was cut into a size "Hansetsu" and packaged in a package material (being a 50 μm thick polyethylene comprised of PET 10 μm/PE 12 μm/aluminum foil 9 μm/NY 15 μm/carbon 3 percent at an oxygen permeability of 0 ml/1×10$^5$ Pa·m$^2$·25° C.·day and a moisture permeability of 0 g/1×10$^5$ Pa·m$^2$·25° C.·day) and stored under the conditions below.

Condition A: 25° C. and relative humidity 55 percent

Condition B: 40° C. and relative humidify 80 percent

Variation ratio (in percent)=minimum density or photographic speed under Condition *B*/minimum density, or photographic speed under Condition *A*×100

TABLE 5

| Sample No. | *1 | *2 | *3 | *4 | Fog | Relative Photographic Speed | *5 | Storage Stability prior to Development: Dmin Variation (%) | Storage Stability prior to Development: Dmax Variation (%) | Storage Stability after Development: Dmin Variation (%) | Storage Stability after Development: Dmax Variation (%) | Evaluation of Image: Color Tone *6: $R^2$ | Color Tone *6: Intercept | Color Tone *6: Gradient | Visual Evaluation | Remarks |
|---|---|---|---|---|---|---|---|---|---|---|---|---|---|---|---|---|
| 301 | 1 | none | none | none | 0.225 | 100(25) | 100 | 125 | 75 | 145 | 86 | 0.852 | −6.2 | 0.58 | poor | Comp. |
| 302 | 1 | ST-21 | none | none | 0.200 | 98(24) | 95 | 118 | 73 | 137 | 85 | 0.860 | −6.8 | 0.62 | poor | Comp. |
| 303 | 1 | ST-35 | none | none | 0.198 | 95(20) | 92 | 115 | 70 | 135 | 83 | 0.865 | −7.0 | 0.65 | poor | Comp. |
| 304 | 1 | none | CV-61 | none | 0.203 | 97(21) | 95 | 118 | 75 | 138 | 85 | 0.861 | −7.2 | 0.61 | poor | Comp. |
| 305 | 1 | none | CV-133 | none | 0.197 | 98(22) | 95 | 113 | 78 | 135 | 88 | 0.859 | −7.1 | 0.59 | poor | Comp. |
| 306 | 1 | none | none | XP5 | 0.218 | 99(13) | 90 | 120 | 73 | 123 | 80 | 0.851 | −6.8 | 0.57 | poor | Comp. |
| 307 | 1 | ST-21 | CV-61 | XP5 | 0.180 | 94(11) | 88 | 110 | 70 | 120 | 81 | 0.850 | −6.9 | 0.59 | poor | Comp. |

TABLE 5-continued

| Sample No. | *1 | *2 | *3 | *4 | Fog | Relative Photographic Speed | *5 | Storage Stability prior to Development: Dmin Variation (%) | Storage Stability prior to Development: Dmax Variation (%) | Storage Stability after Development: Dmin Variation (%) | Storage Stability after Development: Dmax Variation (%) | Evaluation of Image: Color Tone *6: $R^2$ | Intercept | Gradient | Visual Evaluation | Remarks |
|---|---|---|---|---|---|---|---|---|---|---|---|---|---|---|---|---|
| 308 | 1 | ST-21 | CV-133 | XP5 | 0.182 | 95(12) | 89 | 111 | 72 | 119 | 82 | 0.849 | −6.9 | 0.60 | poor | Comp. |
| 309 | 4 | none | none | none | 0.193 | 145(5) | 148 | 109 | 88 | 112 | 97 | 0.999 | 0.3 | 1.1 | good | Inv. |
| 310 | 4 | ST-21 | none | none | 0.172 | 140(4) | 145 | 105 | 86 | 108 | 96 | 0.999 | 0.2 | 1.0 | good | Inv. |
| 311 | 4 | ST-35 | none | none | 0.171 | 138(4) | 143 | 105 | 87 | 107 | 96 | 0.999 | 0.2 | 1.0 | good | Inv. |
| 312 | 4 | none | CV-61 | none | 0.171 | 139(4) | 144 | 106 | 89 | 107 | 96 | 0.999 | 0.3 | 1.1 | good | Inv. |
| 313 | 4 | none | CV-133 | none | 0.172 | 141(4) | 143 | 105 | 87 | 108 | 96 | 0.999 | 0.3 | 1.0 | good | Inv. |
| 314 | 4 | none | none | XP5 | 0.190 | 144(5) | 140 | 107 | 88 | 107 | 95 | 0.999 | 0.2 | 1.0 | good | Inv. |
| 315 | 4 | ST-21 | CV-61 | XP5 | 0.150 | 137(3) | 139 | 103 | 87 | 105 | 97 | 1.00 | 0.1 | 1.2 | good | Inv. |
| 316 | 4 | ST-21 | CV-133 | XP5 | 0.152 | 138(3) | 139 | 102 | 88 | 104 | 97 | 1.00 | 0.1 | 1.2 | good | Inv. |

Comp.: Comparative Example
Inv.: Present Invention
*1: Type of Silver Halide Emulsion
*2: Compound Represented by General Formula (ST)
*3: Compound Represented by General Formula (CV)
*4: Polymer Having a Halogen Radical Releasing Group
*5: Maximum Density (relative density)
*6: Evaluation Based on Linear Regression Line Note: Numerical values in parenthesis are determined as follows. A photosensitive material is subjected to a thermal treatment at a thermal development temperature prior to white light exposure to the aforesaid photosensitive material. Thereafter, the resulting photosensitive material is subjected to white light exposure (4874 K and 30 seconds) through an optical wedge and thermally developed, whereby photographic speed is determined. On the other hand, no thermal treatment is performed prior to exposure; white light exposure is performed under the same conditions, as described above; and thermal development is then performed, whereby photographic speed is also determined. The numerical value is a relative photographic speed when the latter is 100. In this relative comparison, a decrease in relative photographic speed of samples which had been thermally treated at the thermally developing temperature prior to white light exposure was confirmed mainly based on observation/determination of the variation of the relative relationship between the surface speed and the internal speed of silver halide grains due to disappearance or a decrease of spectral sensitization effects and chemical sensitization effects.

As can clearly be seen from Table 5, even though silver salt photothermographic dry imaging materials of the present invention resulted in fog (minimum density) equal to or less than the comparative examples, they resulted in photographic speed equal to or more than the comparative examples and also maximum density equal to or higher than the comparative example. It is to be noted that they exhibited excellent storage stability (pre-exposure storage stability) prior to development and particularly excellent image storage stability after photographic processing. Further, in color tone evaluation of the samples according to the present invention, the coefficient of determination value R was 0.998-1.000; b* value of the intersection of the aforesaid linear regression line with the ordinate was −5-+5; and gradient (b*/a*) was 0.7-2.5, whereby it was possible to state that the desired color tone had been obtained.

Example 4

Each of Silver Halide Emulsions 1-5 in Example 1 underwent chemical sensitization employing the following method.

(Preparation of Photosensitive Layer Liquid Coating Compositing A4)

Under a flow of inert gas (97 percent nitrogen), while stirring 50 g of aforesaid Photosensitive Emulsion A and 15.11 g of MEK at 21° C., 390 μl of Antifogging Agent 1 (10 percent methanol solution) was added, and the resulting mixture was stirred for one hour. Subsequently, 240 ml of Sulfur Sensitizer S-5 (a 0.5 percent methanol solution) was added and the resulting mixture underwent chemical sensitization while stirring at 21° C. for one hour. Subsequently, 404 μl of calcium bromide (a 10 percent methanol solution) was added and the resulting mixture was stirred for 20 minutes. Subsequently, 167 ml of aforesaid stabilizer solution was added and the resulting mixture was stirred for 10 minutes. Thereafter, 1.32 g of aforesaid Infrared Sensitizer Solution A was added and the resulting mixture was stirred for one hour. After that, the temperature was lowered to 13° C. and stirring continued for an additional 30 minutes. While maintaining the temperature at 13° C., 13.31 g of Polyvinylacetal Resin P-1, as a binder resin, was added and the resulting mixture was stirred for 30 minutes. Then, 1.084 g of tetrachlorophthalic acid (a 9.4 percent by weight MEK solution) was added and the resulting mixture was stirred for 15 minutes. While further continuing stirring, 12.43 g of Addition Solution a, and 1.6 ml of Desmodur N3300/aliphatic isocyanate, manufactured by Mobay Co. (10 percent MEK solution), and 4.27 g of Addition Solution b were successively added while stirring, whereby Photosensitive Layer Liquid Coating Composition A4 was obtained.

Variation types of photosensitive layer liquid coating compositions were prepared employing the aforesaid methods and various types of samples, shown in Table 6, were prepared. The resulting samples were evaluated in the same manner as Example 1.

TABLE 6

| Sample No. | *1 | *2 | *3 | Fog | Relative Photographic Speed | *4 | Storage Stability after Development: Dmin Variation Ratio (%) | Storage Stability after Development: Dmax Variation Ratio (%) | Evaluation of Color Tone of Silver Image *5: $R^2$ | Intercept | Gradient | Visual Evaluation | Remarks |
|---|---|---|---|---|---|---|---|---|---|---|---|---|---|
| 401 | 1 | 54(K100) | presence | 0.260 | 100(13) | 100 | 132 | 88 | 0.533 | −8.9 | 0.3 | poor | Comp. |
| 402 | 2 | 54(K100) | presence | 0.202 | 100(0.5) | 107 | 110 | 95 | 0.999 | 0.5 | 1.2 | good | Inv. |
| 403 | 3 | 54(K100) | presence | 0.200 | 108(0.3) | 110 | 108 | 96 | 0.999 | 0.4 | 1.1 | good | Inv. |
| 404 | 4 | 54(K100) | presence | 0.199 | 115(0.1) | 115 | 106 | 98 | 1.00 | 0.3 | 1.0 | good | Inv. |
| 405 | 5 | 54(K100) | presence | 0.201 | 106(0.6) | 105 | 109 | 96 | 0.999 | 0.3 | 1.1 | good | Inv. |
| 406 | 4 | 98(K100) | presence | 0.202 | 98(0.7) | 95 | 102 | 99 | 1.00 | 0.3 | 1.0 | good | Inv. |

Comp.: Comparative Example
Inv.: Present Invention
*1: Type of Silver Halide Emulsion
*2: Content Ratio of Behenic Acid (in percent by weight)
*3: Presence of Chemical Sensitization
*4: Maximum Density (being relative density)
*5: Evaluation Based on Linear Regression Line Note: Numerical values in parenthesis are determined as follows. A photosensitive material is subjected to a thermal treatment at a thermal development temperature prior to white light exposure to the aforesaid photosensitive material. Thereafter, the resulting photosensitive material is subjected to white light exposure (4874 K and 30 seconds) through an optical wedge and thermally developed, whereby photographic speed is determined. On the other hand, no thermal treatment is performed prior to exposure; white light exposure is performed under the same conditions, as described above; and thermal development is then performed, whereby photographic speed is also determined. The numerical value is a relative photographic speed when the latter is 100. In this relative comparison, a decrease in relative photographic speed of samples which had been thermally treated at the thermally developing temperature prior to white light exposure was confirmed mainly based on observation/determination of the variation of the relative relationship between the surface speed and the internal speed of silver halide grains due to disappearance or decrease of spectral sensitization effects and chemical sensitization effects.

As can clearly be seen from Table 6, even though silver salt photothermographic dry imaging materials of the present invention resulted in fog (minimum density) equal to or less than the comparative examples, they resulted in photographic speed equal to or more than the comparative examples and also maximum density equal to or higher than the comparative example. It is to be noted that they specifically exhibited excellent storage stability of images after photographic processing. Further, in the color tone evaluation of the samples according to the present invention, coefficient of determination value $R^2$ was 0.998-1.000; value b* of the intersection of the aforesaid linear regression line with the ordinate was −5-+5; and gradient (b*/a*) was 0.7-2.5, whereby it was possible to state that the desired color tone had been obtained.

After the final step (water addition) of the preparation process of each of Silver Halide Emulsions 1-5, 240 ml of Sulfur Sensitizer S-5 (a 0.5 percent methanol solution) was added and the resulting emulsion underwent chemical sensitization at 55° C. for 120 minutes. Subsequently, this sensitized emulsion was added to a separately prepared liquid coating composition containing aliphatic carboxylic acid silver salts. The resulting coating sample qualitatively exhibited results similar to the above samples.

Example 5

<<Preparation of PET Support>>

By employing terephthalic acid and ethylene glycol, PET of intrinsic viscosity IV of 0.66 (determined in phenol/tetrachloroethane=6/4 (in weight ratio) at 25° C.) was prepared. After pelletizing the resulting PET, the resulting pellets were dried at 130° C. for 4 hours. The dried pellets were melted at 300° C., then extruded employing a T type die, subsequently rapidly cooled, and thermally fixed, whereby an 175 μm thick film, which had not been yet oriented, was prepared.

The resulting film was vertically stretched at a factor of 3.3 employing rollers at different peripheral rates and then laterally stretched at a factor of 4.5 employing a tenter. During stretching, temperatures were 110° C. and 130° C., respectively. Thereafter, thermal fixation was performed at 240° C. for 20 seconds and then 4 percent vertical relaxation was performed. After slitting off the chucked tenter portion, both ends were subjected to knurling. The resulting film was wound at 4 kg/cm$^2$, whereby a roll of the 175 μm thick film was prepared.

(Surface Corona Treatment)

By employing Solid State Corona Processor Model 6 KVA, manufactured by Piller Inc., both surfaces of a support were treated at a rate of 20 m/minute at room temperature. During this operation, it was noted that the support was subjected to a treatment of 0.375 kV·A·minute/m$^2$ based on the read value of voltage, treatment frequency was 9.6 kHz, and gap clearance between the electrode and the dielectric roller was 1.6 mm.

(Preparation of Subbed Support)

(1) Preparation Formulation of Subbing Layer Coating Composition

| | |
|---|---|
| (Photosensitive Layer Side Subbing Layer) | |
| Pesresin A-520, manufactured by Takamatsu Oil & Fat Co., Ltd. (at 30 weight percent solution) | 59 g |
| 10 weight percent polyethylene glycol monononyl phenyl ether (at an average ethylene oxide number of 8.5) | 5.4 g |
| MP-1000 (minute polymer particles at an average particle diameter of 0.4 μm), manufactured by Soken Chemical & Engineering Co., Ltd. | 0.91 g |
| Distilled water | 935 ml |
| (Reverse Side First Layer) | |
| Styrene-butadiene copolymer latex (at 40 weight percent solids, and a styrene/butadiene weight ratio of 68/32) | 158 g |
| 8 weight percent aqueous solution of 2,4-dichloro-6-hydroxy-s-triazine sodium salt | 20 g |
| 1 percent by weight aqueous sodium laurylbenznesulfonate solution | 10 ml |
| Distilled water | 854 ml |
| (Reverse Surface Side Second Layer) | |
| $SnO_2$/Sb (17 weight percent dispersion at a weight ratio of 9/1, an average particle diameter of 0.038 μm) | 84 g |
| Gelatin (a 10 percent aqueous solution) | 89.2 g |
| Metorose TC-5 (2 weight percent aqueous solution), manufactured by Shin-Etsu Chemical Co., Ltd. | 8.6 g |
| MP-1000, manufactured by Soken Chemical & Engineering Co., Ltd. | 0.01 g |
| 1 weight percent aqueous dodecylbenzenesulfonate solution | 10 ml |
| NaOH (1 weight percent) | 6 ml |
| Proxel (manufactured by ICI Co.) | 1 ml |
| Distilled water | 805 ml |

After applying the aforesaid corona treatment to both sides of the aforesaid 175 μm thick biaxially oriented polyethylene terephthalate support, the aforesaid subbing liquid coating composition formulation was applied onto one side (a photosensitive layer surface) employing a wire bar to result in a wet coated amount of 6.6 ml/$m^2$ (per side), and the resulting coating was dried at 180° C. for 5 minutes. Subsequently, the aforesaid subbing liquid coating composition formulation was applied onto the reverse side (the back surface) employing a wire bar to result in a wet coated amount of 5.7 ml/$m^2$, and the resulting coating was dried at 180° C. for 5 minutes. Further, the aforesaid subbing liquid coating composition formulation was applied onto the reverse surface (the back surface) to result in a wet coated amount of 7.7 ml/$m^2$, and the resulting coating was dried at 180° C. for 6 minutes, whereby a subbed support was prepared.

<<Preparation of Reverse Surface Liquid Coating Composition>>

(Preparation of Minute Solid Particle Dispersion (a) of Base Precursor)

Added to distilled water were 1.5 kg of Base Precursor Compond-1, 225 g of a surface active agent (registered trade name: Demol N, manufactured by Kao Corp.), 937.5 g diphenylsulfone, and 15 g of parahydroxybenzoic acid butyl ester (registered trade name: Mekkins, manufactured by Ueno Fine Chemicals Industry, Ltd.). While mixing, the total weight was made to 5.0 kg by the addition of distilled water. The resulting mixed liquid composition was subjected to bead dispersion employing a horizontal sand mill (UVM-2, manufactured by IMEX Co., Ltd.). The dispersion method was such that the mixed liquid composition was transferred to UVM-2 filled with 5 mm zirconia beads, employing a diaphragm pump, and dispersion was performed under an interior pressure of at least 50 hPa until the desired average particle diameter was obtained.

The spectral absorption of the resulting dispersion was monitored and dispersion was performed until the absorbance ratio (D450/D650) of absorbance at 450 nm of the dispersion to absorbance at 650 nm of the same reached at least 2.2. The resulting dispersion was diluted by the addition of distilled water to reach 20 percent by weight of the concentration of the Base Precursor. In order to remove dust, the resulting dispersion was filtered employing a filter (polypropylene filter of an average pore diameter of 3 μm) and then employed in practice.

(Preparation of Minute Solid Dye Particle Dispersion)

Mixed with distilled water were 6.0 kg of Cyanine Dye Compound-1, 3.0 kg of sodium p-dodecylbenznesulfonate, 0.6 kg of surface active agent Demol SNB, manufactured by Kao Corp., and 0.15 kg of a defoamer (registered trade name Surfinol 104E, manufactured by Nissin Chemical Industry Co., Ltd.), and the total weight was brought to 60 kg.

The resulting mixed liquid composition was dispersed using zirconia beads in a horizontal sand mill (UVM-2, manufactured by IMEX Co., Ltd.). The spectral absorption of the resulting dispersion was monitored and dispersion was performed until the absorbance ratio (D650/D750) of absorbance at 650 nm of the dispersion to absorbance at 750 nm of the same reached at least 5.0. The resulting dispersion was diluted by the addition of distilled water to reach 6 percent by weight of the concentration of the cyanine dye. In order to remove dust, the resulting dispersion was filtered employing a filter (an average pore diameter of 1 μm) and then employed in practice.

(Preparation of Antihalation Layer Liquid Coating Composition)

Mixed were 30 g of gelatin, 24.5 g of polyacrylamide, 2.2 g of mol/liter caustic, 2.4 g of minute monodipsersed polymethyl methacrylate particle (of an average particle size of 8 μm and a standard deviation of the particle diameter of 0.4), 0.08 g of benzoisothiazolinone, 35.9 g of the aforesaid minute solid dye particle dispersion, 74.2 g of the aforesaid minute solid Base Precursor particle dispersion (a), 0.6 g of sodium polystyrenesulfonate, 0.21 g of Blue Dye Compound-1, 0.15 g of Yellow Dye Compound-1, and 8.3 g of acrylic acid/ethyl acrylate copolymer latex (at a copolymerization ratio of 5/95), and the total volume was brought to 8,183 ml by the addition of water, whereby an antihalation layer liquid coating composition was prepared.

(Preparation of Reverse Surface Protective Layer Liquid Coating Composition)

Mixed in a vessel maintained at 40° C. were 40 g of gelatin, 1.5 g of liquid paraffin emulsion as liquid paraffin, 35 mg of benzoisothiazolinone, 6.8 g of 1 mol/liter caustic, 0.5 g of sodium t-octylphenoxyethoxyethanesulfonate, 0.27 g of sodium polystyrenesulfonate, 37 mg of a fluorine based surface active agent (F-1: N-perfluorooctylsulfonyl-N-propylalanine potassium salt), 150 mg of fluorine based surface active agent (F-2: polyethyleneglycolmono(N-perfluorooctylsulfonyl-N-propyl-2-aminoethyl)ether of an average degree of polymerization of ethylene oxide of 15, 64 mg of a fluorine based surface active agent (F-3), 32 mg of a fluorine based surface active agent (F-4), 6.0 g of acrylic acid/ethyl acrylate copolymer, and 2.0 g of N,N-ethylenebis (vinylsulfoneacetamide), and the volume of the resulting mixture was made to 10 liters by the addition of water, whereby a back surface protective layer coating composition was prepared.

<<Preparation of Silver Halide Emulsion>>

(Preparation of Silver Halide Emulsion 5-1)

Mixed with 1,421 ml of distilled water in a stainless steel reaction vessel, was a solution prepared by adding 3.1 ml of 1 weight percent potassium bromide solution, 3.5 ml of a concentration of 0.5 mol/L of sulfuric acid, and 31.7 g of phthalated gelatin. While stirring, the resulting mixture was maintained at 30° C. Subsequently, all Solution A prepared by dissolving 22.22 g of silver nitrate in distilled water to make the total volume to 95.4 ml, and all Solution B prepared by dissolving 15.3 g of potassium bromide and 0.8 g of potassium iodide in 97.4 ml of distilled water, were added to the resulting mixture over a period of 45 seconds. Thereafter, 10 ml of 3.5 weight percent aqueous hydrogen peroxide solution was added and further 4 ml of 0.1 percent aforesaid compound (ETTU) ethanol solution was added. Solution C was prepared by dissolving 51.86 g of silver nitrate in distilled water to make to the total volume of 317.5 ml, and Solution D was also prepared by dissolving 44.2 g of potassium bromide and 2.2 g of potassium iodide in distilled water to make a total volume 400 ml. Solution C and Solution D were added employing a controlled double-jet method in such a manner that all aforesaid Solution C was added at a constant flow rate over a period of 20 minutes and Solution D was added to maintain the pAg at 8.1. Potassium hexachloroirridate (III) was added 10 minutes after the addition of Solutions C and D to result in a concentration of $1\times10^{-4}$ mol per mol of silver. Further, an aqueous potassium iron (II) hexacyanate was added 5 seconds after the completion of the addition of solution C to result in a concentration of $3\times10^{-4}$ mol per mol of silver. The pH was adjusted to 3.8 by the addition of sulfuric acid at a concentation of 0.5 mol/L, and stirring was terminated. Thereafter, coagulation/desalting/washing was performed. The pH was adjusted to 5.9 by the addition of sodium hydroxide at a concentration of 1 mol/L, whereby a silver halide dispersion at a pAg of 8.0 was prepared.

While stirring at 38° C., added to the aforesaid silver halide dispersion was 5 ml of a 0.34 weight percent 1,2-benzoisothiazoline-3-one methanol solution. After 40 minutes, a methanol solution of Spectral Sensitizing Dyes A and B at a mol ratio of 1:1 was added in a total amount of $7.6\times10^{-3}$ mol per mol of silver, and after 5 minutes, a Tellurium Sensitizer C methanol solution was added in an amount of $2.9\times10^{-4}$ mol per mol of silver. The resulting mixture underwent ripening for 91 minutes. Subsequently, 1.3 ml of a 0.8 weight percent N,N'-dihyroxy-N"-diethylmelamine methanol solution was added, and after 4 minutes, a 5-methyl-2-mercaptobenzimidazole methanol solution was added to result in an amount of $4.8\times10^{-3}$ mol per mol of silver, and then a 1-phenyl-2-heputyl-5-mercapto-1,3,4-triazole methanol solution was added to result in an amount of $5.4\times10^{-3}$ mol per mol of silver, whereby Silver Halide Emulsion 1 was prepared.

The prepared silver halide emulsion was comprised of silver iodobromide grains, uniformly containing 3.5 mol percent of iodine, of an average equivalent spherical diameter of 0.042 μm and a variation coefficient of the equivalent spherical diameter of 20 percent. The grain size and the like were determined based on the average of 1,000 grains, employing an electron microscope. The [100] plane ratio of these grains was determined to be 80 percent, employing the Kubelka-Munk method.

(Preparation of Silver Halide Emulsion 5-2)

Silver Halide Emulsion 2 was prepared in the same manner as Silver Halide Emulsion 5-1, except that the temperature of the liquid composition during grain formation was changed from 30° C. to 47° C.; the preparation of Solution B was changed in such a manner that 15.9 g of potassium bromide was dissolved in distilled water to result in the total volume of 97.4; the preparation of Solution D was changed in such a manner that 45.8 g of potassium bromide was dissolved in distilled water to result in the total volume of 400 ml; the addition time of Solution C was varied to 30 minutes; and potassium hexacyanoiron (II) was omitted. The resulting emulsion was subjected to coagulation/desalting/washing/dispersion in the same manner as Silver Halide Emulsion 5-1. Subsequently, Silver Halide Emulsion 5-2 was obtained while being subjected to spectral sensitization and chemical ripening in the same manner as Emulsion 1 and subjected to addition of 5-methyl-2-mercaptobenzimidazole and 1-phenyl-2-heptyl-5-mercapto-1,3,4-triazole, except that the total added amount of methanol solution of Spectral Sensitizing Dyes A and B at a mol ratio of 1:1 was changed to $7.5\times10^{-4}$ mol per mol of silver; the added amount of Tellurium Sensitizer C was changed to $1.1\times10^{-4}$ mol per mol of silver; and the added amount of 1-phenyl$^{-2}$-heptyl-5-mercapto-1,3,4-triazole was changed to $3.3\times10^{-3}$ mol per mol of silver. Silver Halide Emulsion 5-2 was comprised of pure cubic silver bromide grains of an average equivalent spherical diameter of 0.080 μm and an equivalent spherical variation coefficient of 20 percent.

(Preparation of Silver Halide Emulsion 5-3)

Silver Halide Emulsion 5-3 was prepared in the same manner as Silver Halide Emulsion 5-1, except that the temperature of the liquid composition during grain formation was changed from 30° C. to 27° C. The resulting emulsion was subjected to coagulation/desalting/washing/dispersion in the same manner as Silver Halide Emulsion 1. Silver Halide Emulsion 5-3 was prepared in the same manner as Emulsion 1, except that the total added amount in the form of a solid dispersion (an aqueous gelatin solution) of Spectral Sensitizing Dyes A and B at a mol ratio of 1:1 was changed to $6\times10^{-3}$ mol per mol of silver; the added amount of Tellurium Sensitizer C was changed to $5.2\times10^{-4}$ mol per mol of silver; bromoauric acid was added in an amount of $5\times10^{-4}$ mol per mol of silver; and potassium thiocyanate was added in an amount of $2\times10^{-3}$ mol per mol of silver three minutes after the addition of the Tellurium Sensitizer C. Silver Halide Emulsion 5-3 was comprised of uniformly 3.5 mol percent iodine containing silver iodobromide grains of an average equivalent spherical diameter of 0.034 μm and a variation coefficient of an equivalent spherical diameter of 20 percent.

(Preparation of Silver Halide Emulsion 5-4)

Silver Halide Emulsion 5-4 was prepared in the same manner as Silver Halide Emulsion 5-1, except that compound (ETTU) was omitted during grain formation. Incidentally, the silver halide emulsion prepared as above was comprised of uniformly 3.5 mol percent iodine containing silver iodobromide grains of an average equivalent spherical diameter of 0.044 μm, and a variation coefficient of equivalent spherical diameter of 19 percent. The [100] plane ratio of these grains was determined to be 82 percent.

(Preparation of Silver Halide Emulsion 5-5)

Silver Halide Emulsion 5-5 was prepared in the same manner as Silver Halide Emulsion 5-1, except that during grain formation, the compound (ETTU) was not added. Incidentally, Silver Halide Emulsion 5-5 was comprised of pure silver bromide cubic grains of an average equivalent spherical diameter of 0.081 μm and a variation coefficient of equivalent spherical diameter of 17 percent.

(Preparation of Silver Halide Emulsion 5-6)

Silver Halide Emulsion 5-6 was prepared in the same manner as Silver Halide Emulsion 5-1, except that during grain formation, compound (ETTU) was not added. Incidentally, Silver Halide Emulsion 5-6 was comprised of uniformly 3.5 mol percent iodine containing silver iodobromide grains of an average equivalent spherical diameter of 0.032 μm and a variation coefficient of the equivalent spherical diameter of 18 percent.

(Preparation of Mixed Emulsion A for Liquid Coating Composition)

A mixture consisting of 70 percent by weight of Silver Halide Emulsion 5-1, 15 percent by weight of Silver Halide Emulsion 5-2, and 15 percent by weight of Silver Halide Emulsion 5-3 was melted, and 1 weight percent aqueous benzothiazolium iodide solution was added in an amount of $7\times10^{-3}$ mol per mol of silver. Further, water was added so that the content of silver halide per kg of the mixed emulsion for a liquid coating composition reached 38.2 g in terms of silver.

<<Preparation of Mixed Emulsion B for Liquid Coating Composition>>

A mixture consisting of 70 percent by weight of Silver Halide Emulsion 5-4, 15 percent by weight of Silver Halide Emulsion 5-5, and 15 percent by weight of Silver Halide Emulsion 5-6 was melted, and 1 weight percent aqueous benzothiazolium iodide solution was added in an amount of $7\times10^{-3}$ mol per mol of silver. Further, water was added so that the content of silver halide per kg of the mixed emulsion for a liquid coating composition reached 38.2 g in terms of silver.

<<Preparation of Fatty Acid Silver Dispersion>>

(Preparation of Recrystallized Behenic Acid)

Mixed with 120 kg of isopropyl alcohol was 100 kg of behenic acid (trade name Edenor C22-85R), manufacture by Henkel Co., dissolved at 50° C. and filtered employing a 10 μm filter. Thereafter, the temperature was lowered to 30° C., and recrystallization was performed. The cooling rate during recrystallization was controlled to be 3° C./hour. The resulting crystals were subjected to centrifugal filtration, were washed with 100 kg of isopropyl alcohol, and subsequently dried. The resulting crystals then underwent esterification. Subsequently, GC-FID was performed, resulting in a silver behenate proportion of 99 percent and a lignoceric acid proportion of 0.5 percent, and an arachidic acid proportion of 0.5 percent as other products.

(Preparation of Fatty Acid Silver Dispersion)

First, 88 kg of recrystallized behenic acid, 422 L of distilled water, 49.2 L of a 5 mol/L aqueous NaOH solution, and 120 L of t-butyl alcohol were mixed and the resulting mixture underwent reaction while stirring at 75° C. for one hour, whereby a sodium behenate solution was obtained. Separately, 206.2 L of an aqueous solution of 40.4 kg of silver nitrate was prepared and maintained at 10° C. A reaction vessel in which 635 L of distilled water and 30 L of t-butyl alcohol were placed was maintained at 30° C., and while vigorously stirring, all the aforesaid sodium behenate solution and all the aforesaid aqueous silver nitrate solution were added at a specified rate over a period of 93 minutes 15 seconds and 90 minutes, respectively. During this operation, addition was arranged so that an aqueous silver nitrate solution was only added for 11 minutes after the addition of the aforesaid aqueous silver nitrate solution. Thereafter, the addition of Sodium Behenate Solution B was initiated, and addition was arranged so that Sodium Behenate Solution B was added for only 14 minutes 15 seconds after the completion of the addition of the aforesaid aqueous silver nitrate solution. At the same time, the temperature of the interior of the reaction vessel was maintained at 30° C., and the exterior temperature was controlled so that the temperature of the liquid composition remained constant. Further, duplex pipes were employed as a pipe for the addition system of the sodium behenate solution, which was warmed by circulating warmed water in the exterior side of the duplex pipes, and the temperature of the liquid composition at the outlet of the tip of the addition nozzle was controlled to be at 75° C. Further, duplex pipes were employed as a pipe for the addition system of an aqueous silver nitrate solution which was cooled by circulating cooled water in the exterior of the duplex pipes. The addition position of the aqueous silver nitrate solution and the addition location of the sodium behenate solution were symmetrically arranged with respect to the stirring shaft as a center and the height was controlled to not come into contact with the reaction liquid composition.

After completion of the addition of the sodium behenate solution, the resulting mixture was allowed to stand for 20 minutes while stirring without temperature control. Thereafter, the resulting mixture was heated to 35° C. over a period of 30 minutes and subsequently underwent ripening for 210 minutes. Immediately after the ripening, solids were collected by centrifugal filtration, and the resulting solids were washed with water until the electrical conductivity of the wash water reached 30 μS/cm. Thus, a fatty acid silver salt was obtained. The resulting solids were not dried and stored in the form of a wet cake.

The shape of the resulting silver behenate particles was imaged employing an electron microscope and evaluated, noting that the crystals of an average aspect ratio of 2.1, an average equivalent spherical diameter of 0.51 μm, and a variation coefficient of equivalent spherical diameter of 11 percent.

Added to the wet cake in an amount corresponding to 260 kg of dried solids were 19.3 kg of polyvinyl alcohol (trade name PVA-217) and water so that the total weight reached 1,000 kg. Thereafter, the resulting mixture was modified to slurry employing Dissolver blades and was subjected to preliminary dispersion employing Pipe Line Mixer (Type PM-10, manufactured by Mizuho Kogyo Co., Ltd.).

The stock liquid composition, which had been subjected to preliminary dispersion, was treated three times employing a homogenizer (trade name Microfluidizer M-610, manufactured by International Corporation, employing a Type Z interaction chamber) while controlling the pressure to be $1.13\times10^{5}$ kPa or 1,150 kg/cm$^2$), whereby a silver behenate dispersion was obtained. A cooling operation was performed as follows. Coiled tube type heat exchangers were installed before and after the interaction chamber, and dispersion temperature was set at 18° C. by controlling the temperature of the coolant.

<<Preparation of Reducing Agent Dispersion>>

(Preparation of Reducing Agent-1 Dispersion)

Added to 10 kg of Reducing Agent-1 (a 1:1 complex of (6,6'-di-t-butyl-4,4'-dimethyl-2,2'-butylidenediphenol) and triphenylphosphine oxide, 0.12 kg of triphenylphosphine oxide, and 16 kg of a 10 weight percent aqueous modified polyvinyl alcohol (Poval MP203, manufactured by Kuraray Co., Ltd.) solution was 10 kg of water. The resulting mixture was vigorously stirred to form a slurry. The resulting slurry was conveyed employing a diaphragm pump and dispersed employing a horizontal type sand mill (UVM-2, manufactured by IMEX Co., Ltd.) filled with zirconia beads of an average diameter of 0.5 mm for 4 hours 30 minutes. Thereafter, 0.2 g of benzoisothiazolinone and water were added so that the concentration of the reducing agent complex reached 22 percent by weight, whereby Reducing Agent-1 dispersion was obtained. The median diameter and the maximum particle diameter of reducing agent complex particles contained in the reducing agent dispersion prepared as above were 0.45 μm and at most 1.4 μm, respectively. The prepared reducing agent dispersion was filtered employing a polypropylene filter of a pore diameter of 3.0 μm to remove foreign matter such as dust and then stored.

(Preparation of Reducing Agent-2 Dispersion)

Added to 10 kg of Reducing Agent-2 (6,6'-di-t-butyl-4,4'-dimethyl-2,2'-butylidenediphenol) and 16 kg of a 10 weight percent aqueous modified polyvinyl alcohol (Poval MP203, manufactured by Kuraray Co., Ltd.) solution was 10 kg of water. The resulting mixture was vigorously stirred to form a slurry. The resulting slurry was conveyed employing a diaphragm pump and dispersed employing a horizontal type sand mill (UVM-2, manufactured by IMEX Co., Ltd.) filled with zirconia beads of an average diameter of 0.5 mm for 3 hours 30 minutes. Thereafter, 0.2 g of a benzoisothiazolinone sodium salt and water were added so that the concentration of the reducing agent reached 25 percent by weight, whereby Reducing Agent-2 dispersion was obtained. The median diameter and the maximum particle diameter of reducing agent complex particles contained in the reducing agent dispersion prepared as above were 0.40 μm and at most 1.5 μm, respectively. The prepared reducing agent dispersion was filtered employing a polypropylene filter of a pore diameter of 3.0 μm to remove foreign matter, such as dust and then stored.

(Preparation of Hydrogen Bond Forming Compound-1 Dispersion)

Added to 10 kg of Hydrogen Bond Forming Compound-1 (tri(4-t-butylphenyl)phosphine oxide) and 16 kg a 10 weight percent aqueous modified polyvinyl alcohol (Poval MP203, manufactured by Kuraray Co., Ltd.) was 10 kg of water. The resulting mixture was vigorously stirred to form a slurry. The resulting slurry was conveyed employing a diaphragm pump and dispersed for 3 hours 30 minutes employing a horizontal type sand mill (UVM-2, manufactured by IMEX Co., Ltd.) filled with zirconia beads of an average diameter of 0.5 mm. Thereafter, 0.2 of benzoisothiazolinone sodium salt and water were added so that the concentration of the hydrogen bond forming compound reached 25 percent by weight, whereby Hydrogen Bond Forming Compound-1 Dispersion was obtained. The median diameter and the maximum particle diameter of hydrogen bond forming compound particles contained in the hydrogen bond forming compound dispersion prepared as above were 0.35 μm and at most 1.4 μm, respectively. The prepared hydrogen bond forming compound dispersion was filtered employing a polypropylene filter of a pore diameter of 3.0 μm to remove foreign matter, such as dust, and then stored.

(Preparation of Development Accelerator-1 Dispersion)

Added to 10 kg of Development Accelarator-1 and 20 kg of a 10 weight percent aqueous modified polyvinyl alcohol (Poval MP203, manufactured by Kuraray Co., Ltd.) was 10 kg of water. The resulting mixture was vigorously stirred to form a slurry. The resulting slurry was conveyed employing a diaphragm pump and dispersed employing a horizontal type sand mill (UVM-2, manufactured by IMEX Co., Ltd.) filled with zirconia beads of an average diameter of 0.5 mm for 3 hours 30 minutes. Thereafter, 0.2 of benzoisothiazolinone sodium salt and water were added so that the concentration of the development accelerator reached 20 percent by weight, whereby Development Accelerator-1 Dispersion was obtained. The median diameter and the maximum particle diameter of development accelerator particles contained in the development accelerator dispersion prepared as above were 0.48 μm and at most 1.4 μm, respectively. The prepared development accelerator dispersion was filtered employing a polypropylene filter of a pore diameter of 3.0 μm to remove foreign matter such as dust and stored. Solid dispersion of each of Development Accelerator-2, Development Accelerator-3, and Color Tone Controlling Agent-1 was performed in the same manner as Development Accelerator-1 and each of the 20 weight percent dispersion was obtained.

<<Preparation of Polyhalide Compound>>

(Preparation of Organic Polyhalide Compound-1 Dispersion)

Added to 10 kg of Organic Polyhalide Compound-1 (tribromomethanesulfonylbenzene), 10 kg of a 20 weight percent aqueous modified polyvinyl alcohol (Poval MP203, manufactured by Kuraray Co., Ltd.) solution, and 0.4 kg of an aqueous sodium triisopropylnaphthalenesufonate solution was 14 kg of water. The resulting mixture was vigorously stirred to form a slurry. The resulting slurry was conveyed employing a diaphragm pump and dispersed for 5 hours employing a horizontal type sand mill (UVM-2, manufactured by IMEX Co., Ltd.) filled with zirconia beads of an average diameter of 0.5 mm. Thereafter, 0.2 of benzoisothiazolinone sodium salt and water were added so that the concentration of the organic polyhalide compound reached 26 percent by weight, whereby Organic Polyhalide Compound-1 Dispersion was obtained. The median diameter and the maximum particle diameter of organic polyhalide compound particles contained in the organic polyhalide compound dispersion prepared as above were 0.41 μm and at most 2.0 μm, respectively. The prepared organic polyhalide compound dispersion was filtered employing a polypropylene filter of a pore diameter of 10.0 μm to remove foreign matter, such as dust, and then stored.

(Preparation of Organic Polyhalide Compound-2 Dispersion)

Placed are 10 kg of Organic Polyhalide Compound-2 (N-butyl-3-tribromomethanesulfonylbenzamide), 10 kg of a 10 weight percent aqueous modified polyvinyl alcohol (Poval MP203, manufactured by Kuraray Co., Ltd.) solution, and 0.4 kg of an aqueous sodium triisopropylnaphthalenesufonate solution. The resulting mixture was vigorously stirred to form a slurry. The resulting slurry was dispersed for 5 hours, employing a horizontal type sand mill (UVM-2, manufactured by IMEX Co., Ltd.) filled with zirconia beads of an average diameter of 0.5 mm. Thereafter, 0.2 of benzoisothiazolinone sodium salt and water were added so that the concentration of the organic polyhalide compound reached 30 percent by weight. The resulting dispersion was heated at 40° C. for 5 hours, whereby Organic Polyhalide Compound-2 Dispersion was obtained. The median diameter and the maximum particle diameter of organic polyhalide compound particles contained in the organic polyhalide compound dispersion prepared as above were 0.40 μm and at most 1.3 μm, respectively. The prepared organic polyhalide compound dispersion was filtered employing a polypropylene filter of a pore diameter of 3.0 μm to remove foreign matter, such as dust, and then stored.

(Preparation of Phthalazine Compound-1 Solution)

Dissolved in 174.57 kg of water was 8 kg of modified polyvinyl alcohol MP203, manufactured by Kuraray Co., Ltd. Subsequently, 3.15 kg of a 20 weight percent aqueous sodium triisopropylnaphthalenesulfonate solution and 14.28 kg of a 70 weight percent aqueous Phthalazine Compound-1 (6-isopropylphthalazine) solution were added, whereby a 5 weight percent Phthalazine Compound-1 solution was prepared.

<<Preparation of Mercapto Compound>>

(Preparation of Aqueous Mercapto Compound-1 Solution)

Dissolved in 993 g of water was 7 g of Mercapto Compound-1 (a 1-(3-sulfophenyl)-5-mercaptotetrazole sodium salt), whereby a 0.7 weight percent aqueous solution was prepared.

(Preparation of Aqueous Mercapto Compound-2 Solution)

Dissolved in 980 g of water was 20 g of Mercapto Compound-2 (a 1-(3-methylureido)-5-mercaptotetrazole sodium salt), whereby a 2.0 weight percent aqueous solution was prepared.

<<Preparation of Pigment-1 Dispersion>>

Added to 250 g of water were 64 g of C.I. Pigment Blue 60 and 6.4 g of Demol N, manufactured by Kao Corp. The resulting mixture was vigorously mixed to form a slurry. Subsequently, 800 g of zirconia beads of an average diameter of 0.5 mm was prepared, placed in a vessel together with the aforesaid slurry, and dispersed for 25 hours, employing a homogenizer (1/4G Sand Grinder Mill, manufactured by IMEX Co., Ltd.), whereby Pigment-1 was obtained. The average diameter of pigment particles contained in the pigment dispersion, prepared as above, was 0.21 μm.

<<Preparation of SBR Latex Liquid Composition>>

SBR latex at a Tg of 22° C. was prepared as follows. Ammonium persulfate was used as a polymerization initiator, while anionic surface active agents were used as an emulsifier. After 70.0 weight parts of styrene, 27.0 weight parts of butadiene, and 3.0 weight parts of acrylic acid were subjected to emulsion polymerization, the resulting product was subjected to aging at 80° C. for 8 hours. Thereafter, the temperature was lowered to 40° C., and the pH was adjusted to 7.0 by the addition of ammonia water. Further, Sandet BL, manufactured by Sanyo Chemical Industries, Ltd. was added to reach 0.22 percent. Subsequently, the pH was adjusted to 8.3 by the addition of a 5 percent aqueous sodium hydroxide solution, and further, the pH was adjusted to 8.4 by the addition ammonia water. The mol ratio of $Na^+$ ions to $NH_4^+$ ions employed for the adjustment of the pH was 1:2.3. Further, 0.15 ml of a 7 percent aqueous benzoisothiazolinone sodium salt solution was added with respect to 1 kg of the resulting liquid composition, whereby a SBR latex liquid composition was prepared.

(SBR latex: latex of -St(70.0)-Bu(27.0)-AA(3.0)-, Tg of 22° C., average particle diameter of 0.1 μm, a concentration of 43 percent by weight, an equilibrium moisture content of 0.6 percent by weight at 25° C. and 60 percent relative humidity, an ionic conductance of 4.2 mS/cm (the ionic conductance of the latex stock liquid composition (43 percent by weight) was determined at 25° C. employing a conductometer CM-30s, manufactured by DKK-TOA Corp.), and a pH of 8.4.

It is possible to prepare SBR latexes which differ in Tg, employing the same method, while suitably changing the ratio of butadiene.

<<Preparation of Emulsion Layer (Photosensitive Layer) Liquid Coating Composition-1>>

Successively placed into a vessel were 1,000 g of the fatty acid silver dispersion prepared as above, 276 ml of water, 33.2 g of Pigment-1 Dispersion, 21 g of Organic Polyhalide Compound-1 Dispersion, 58 g of Organic Polyhalide Compound-2 Dispersion, 173 g of Phthalazine Compound-1 Solution, 1,082 g of SBR Latex (at a Tg of 22° C.) Liquid Composition, 299 g of Reducing Agent Complex-1 Dispersion, 6 g of Development Accelerator Dispersion, 9 ml of Aqueous Mercapto Compound-1 Solution, and 27 ml of Aqueous Mercapto Compound Solution. Further, 117 g of Silver Halide Emulsion Mixture A was added just prior to coating and the resulting mixture was vigorously stirred. The resulting emulsion layer liquid coating composition was conveyed to a coating die without any modification and subsequently coated.

The viscosity of the aforesaid emulsion layer liquid coating composition was determined employing Type B Viscometer available from Tokyo Keiki, resulting in 25 mPa·s at 40° C. (at 60 rpm of No. 1 Rotor). Viscosities at a shearing rate of 0.1, 1, 10, 100, and 1,000 (1/second) were determined at 25° C., employing RFS Fluid Spectrometer, manufactured by Reometrics Far East Co., Ltd., resulting in 230, 60, 46, 24, and 18 mPa·s, respectively.

The amount of zirconium in the liquid coating composition was 0.38 mg per g of silver.

<<Preparation of Emulsion Layer (Photosensitive Layer) Liquid Coating Composition-2>>

Successively placed in a vessel were 1,000 g of the fatty acid silver dispersion prepared as above, 276 ml of water, 32.8 g of Pigment-1 Dispersion, 21 g of Organic Polyhalide Compound-1 Dispersion, 58 g of Organic Polyhalide Compound-2 Dispersion, 173 g of Phthalazine Compound-1 Solution, 1,082 g of SBR Latex (at a Tg of 22° C.) Liquid Composition, 155 g of Reducing Agent-2 Dispersion, 55 g of Hydrogen Bond Forming Compound-1 Dispersion, 6 g of Development Accelerator-1 Dispersion, 2 g of Development Accelerator-2 Dispersion, 3 g of Development Accelerator-3 Dispersion, 2 g of Color Tone Controlling Agent-1 Dispersion, and 6 ml of Aqueous Mercapto Compound-2 Solution. Further, 117 g of Silver Halide Emulsion Mixture A was added just prior to coating and the resulting mixture was vigorously stirred. The resulting emulsion layer liquid coating composition was conveyed to a coating die without any modification and subsequently coated. The viscosity of the aforesaid emulsion layer liquid coating composition was determined employing Type B Viscometer available from Tokyo Keiki, resulting in 40 mPa·s at 40° C. (at 60 rpm of No. 1 Rotor). Viscosities at a shearing rate of 0.1, 1, 10, 100, and 1,000 (1/second) were determined at 25° C., employing RFS Fluid Spectrometer, manufactured by Rheometrics Far East Co., Ltd., resulting in 530, 144, 96, 51, and 28 mPa·s, respectively.

The amount of zirconium in the liquid coating composition was 0.25 mg per g of silver.

<<Preparation of Emulsion Surface Interlayer Liquid Coating Composition>>

Water was added to a mixture consisting of 1,000 g of polyvinyl alcohol PVA-205 (manufactured by Kuraray Co., Ltd.), 272 g of 5 weight percent pigment dispersion, 4,200 ml of a 19 weight percent methyl methacrylate/styrene/butyl acrylate/hydroxyethyl methacrylate/acrylic acid copolymer (at a copolymerization ratio of 64/9/20/5/2) latex, 27 ml of a 5 weight percent aqueous Aerosol OT (manufactured by American Cyanamid Co.) solution, and 135 ml of a 20 weight percent aqueous phthalic acid diammonium salt solution so that the total weight reached 10,000 g. Subsequently the pH was adjusted to 7.5 by the addition of NaOH, whereby an interlayer liquid coating composition was prepared. Subsequently, the resulting liquid coating composition was conveyed to a coating die to result in a coated amount of 9.1 ml/m$^2$. The viscosity of the liquid coating composition was determined at 40° C., employing Type B Viscosimeter (No. 1 Rotor at 60 rpm), resulting in 58 mPa·s.

<<Preparation of Emulsion Surface Protective Layer First Layer Liquid Coating Composition>>

Dissolved in water was 64 g of inert gelatin, and added to the resulting gelatin solution were 80 g of a 27.5 weight percent methyl methacrylate/styrene/butyl acrylate/hydroxyethyl methacrylate/acrylic acid copolymer (at a copolymerization weight ratio of 64/9/20/5/2) latex, 23 ml of a 10 weight percent phthalic acid methanol solution, 23 ml of 10 weight percent aqueous 4-methylphthalic acid solution, 28 ml of sulfuric acid at a concentration of 5 mol/L, 5 ml of a 5 weight percent aqueous Aerosol OT (manufactured by American Cyanamid Co.) solution, 0.5 g of phenoxyethanol, and 0.1 g of benzoisothiazolinone. Subsequently, the total weight was adjusted to 750 g by the addition of water, whereby a liquid coating composition was prepared. Subsequently, 26 ml of a 4 weight percent chromium alum solution was mixed just prior to coating, employing a static mixer, and the resulting mixture was conveyed to a coating die to result in a coated amount of 18.6 ml/m$^2$. The viscosity of the liquid coating composition was determined at 40° C., employing Type B Viscosimeter (No. 1 Rotor at 60 rpm), resulting in 20 mPa·s.

<<Preparation of Emulsion Surface Protective Layer Second Layer Liquid Coating Composition>>

Dissolved in water was 80 g of inert gelatin, and added to the resulting gelatin solution were 102 g of a 27.5 weight percent methyl methacrylate/styrene/butyl acrylate/hydroxyethyl methacrylate/acrylic acid copolymer (at a copolymerization weight ratio of 64/9/20/5/2) latex, 3.2 ml of a 5 weight percent fluorine based surface active agent (F-1: N-perfluorooctylsulfonyl-N-propylalanine potassium salt solution, 32 ml of a 2 weight percent aqueous fluorine based surface active agent (F-2: polyethylene glycol mono(N-perfluorooctylsulfonyl-N-propyl-2-aminoethyl)ether (at an average degree of polymerization of ethylene oxide of 15)) solution, 23 ml of a 5 weight percent Aerosol OT (manufactured by American Cyanamid Co.) solution, 4 g of minute polymethyl methacrylate particles (at an average diameter of 0.7 μm), 21 g of minute polymethyl methacrylate particles (at an average diameter of 4.5 μm), 1.6 g of 4-methylphthalic acid, 4.8 g of phthalic acid, 44 ml of sulfuric acid at a concentration of 0.5 mol/L, 10 mg of benzoisothiazolinone. Subsequently, the total weight was adjusted to 650 g by the addition of water, whereby a liquid coating composition was prepared. Subsequently, 445 ml of an aqueous solution containing 4 weight percent chromium alum and 0.67 weight percent phthalic acid was mixed just prior to coating, whereby a surface protective layer coating composition was prepared, which was conveyed to a coating die to result in a coated amount of 8.3 ml/m$^2$. The viscosity of the liquid coating composition was determined at 40° C., employing Type B Viscosimeter (No. 1 Rotor at 60 rpm), resulting in 19 mPa·s.

<<Preparation of Photothermographic Dry Imaging Material-1>>

An antihalation layer liquid coating composition and a reverse surface protective layer liquid coating composition were simultaneously applied to the reverse surface side of the aforesaid support to result in a coated amount of solids of minute solid dye of 0.04 g/m$^2$ and a coated amount of gelatin of 1.7 g/m$^2$, respectively, and subsequently dried, whereby a back layer was prepared.

The emulsion layer, interlayer, protective layer first layer, and protective layer second layer were subjected to simultaneous multilayer coating onto the side opposite the reverse surface in the stated order from the subbing surface. During the above coating, the temperature of the emulsion layer and the interlayer was adjusted to 31° C., the temperature of the protective layer first layer was adjusted to 36° C., and the temperature of the protective layer first layer was adjusted to 37° C. The coated amount (in g/cm$^2$) of each compound in the emulsion layer was as follows.

Silver behenate: 5.55, pigment (C.I. Pigment Blue 60): 0.036, Organic Polyhalide Compound-1: 0.12, Organic Polyhalide Compound-2: 0.37, Phthalazine Compound-1: 0.19, SBR latex: 9.67, Reducing Agent Complex-1: 1.41, Development Accelerator-1: 0.024, Mercapto Comppound-1: 0.002, Mercapto Compound-2: 0.012, and silver halide (in terms of Ag): 0.091.

Drying conditions were as follows. Coating was performed at a rate of 160 m/minute; the gap between the edge of the coating die and the support was set between 0.10 and 0.30 mm; and the pressure in the pressure reduced chamber was set 196-882 Pa lower than atmospheric pressure. The supports were subjected to charge elimination employing an ion flow prior to coating. In the subsequent chilling zone, after chilling the liquid coating composition employing an air flow at a dry bulb temperatures of 10-20° C., drying was performed employing an air flow at a dry bulb temperature of 23-45° C. and a wet bulb temperature of 15-21° C. employing a non-contact helically floating dryer under non-contact conveyance. After drying, rehumidification was performed at 25° C. and relative humidity of 40-60 percent. Thereafter, the layer surface was heated to 70-90° C. After heating, the layer surface was cooled to 25° C.

The matting degree of the surface on the photosensitive layer side of the prepared photothermographic imaging material was 550 seconds in terms of Bekk smoothness, while the matting degree of the surface on the reverse side was 130 seconds. Further, the pH of the surface on the photosensitive layer side was determined, resulting in 6.0.

<<Preparation of Photothermographic Dry Imaging Material-2>>

Photothermographic Dry Imaging Material-2 was prepared in the same manner as Photothermographic Dry Imaging Material-1, except that Mixed Silver Halide Emulsion A of Emulsion Layer Liquid Coating Composition-1 was replaced with Mixed Silver Halide Emulsion B.

<<Preparation of Photothermographic Dry Imaging Material-3>>

Thermally Developable Photosensitive Material-2 was prepared in the same manner as Thermally Developable Photosensitive Material-1, except that in Photothermographic Dry Imaging Material-1, Emulsion Layer Liquid Coating Composition-1 was replaced with Emulsion Layer Liquid Coating Composition-2, Yellow Dye Compound-1 was omitted from the antihalation layer, and fluorine based surface active agents F-1, F-2, F-3, and F-4 in the reverse surface protective layer and the emulsion surface protective layer were replaced with F-5, F-6, F-7, and F-8. The coated amount (in g/m$^2$) of each of the compounds of the aforesaid emulsion layer was as follows.

Silver behenate: 5.55, pigment (C.I. Pigment Blue 60): 0.036, Organic Polyhalide Compound-1: 0.12, Organic Polyhalide Compound-2: 0.37, Phthalazine Compound-1: 0.19, SBR latex: 9.67, Reducing Agent-2: 0.81, Hydrogen Bond Forming Compound-1: 0.30, Development Accelerator-1: 0.024, Development Accelerator-2: 0.010, Development Accelerator-3: 0.015, Color Tone Controlling Agent-1: 0.010, Mercapto Compound-2: 0.002, and silver halide (in terms of Ag): 0.091.

<<Preparation of Photothermographic Dry Imaging Material-4>>

Photothermographic Dry Imaging Material-4 was prepared in the same manner as Photothermographic Dry Imaging Material-3, except that Mixed Silver Halide Emulsion A of Emulsion Layer Liquid Coating Composition-1 was replaced with Mixed Silver Halide Emulsion B.

Chemical structures of compounds employed in Example 5 are described below.

Spectral Sensitizing Dye A

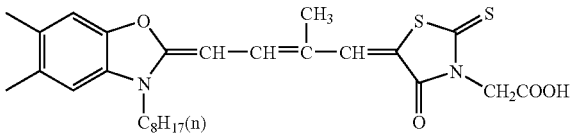

Spectral Sensitizing Dye B

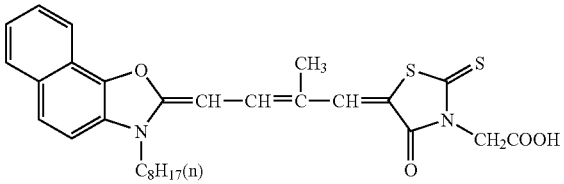

Tellurium Sensitizer C

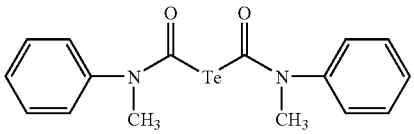

-continued

Base Precursor Compound-1

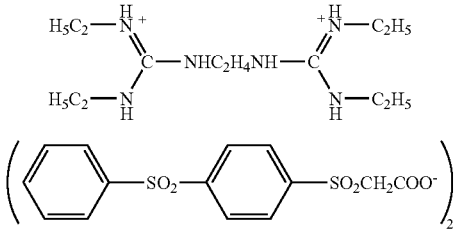

(Phthalazine Compound -1)

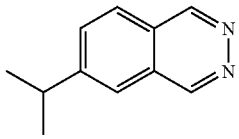

(Development Accelerator-1)

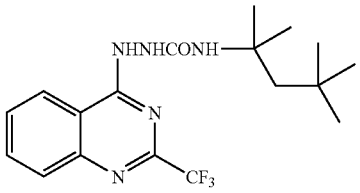

(Development Accelerator-2)

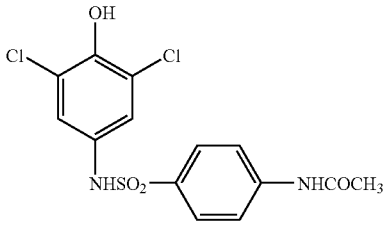

(Development Accelerator-3)

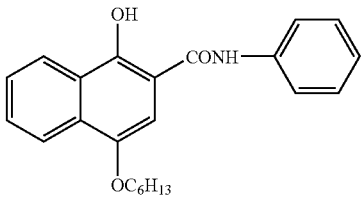

(Color Tone Controlling Agent-1)

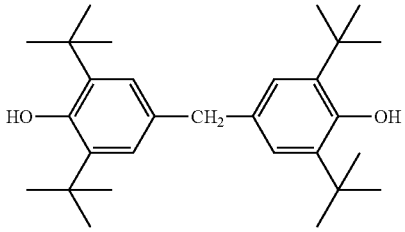

(F-1)

$C_8F_{17}SO_2NCH_2COOK$
|
$C_3H_7(n)$ (F-2)

$C_8F_{17}SO_2NCH_2CH_2O(CH_2CH_2O)_nH$
|
$C_3H_7(n)$ n = 15 (average)

-continued (F-3)

$C_8F_{17}SO_2N(CH_2CH_2O)_4CH_2CH_2CH_2SO_3Na$
|
$C_3H_7(n)$ (F-4)

$C_8F_{17}SO_3K$ (F-5)

$CF_3(CF_2)_nCH_2CH_2SCH_2CH_2COOLi$ mixture of n = 5-11

(F-6)

$CF_3(CF_2)_nCH_2CH_2O(CH_2CH_2O)_mH$ mixture of n = 5-11 and m = 5-15

(F-7)

$CH_2COOC_8H_{17}$
|
$NaO_3S—CHCOOCH_2CH_2C_4F_9$ (F-8)

$CH_2COOCH_2CH_2C_4F_9$
|
$NaO_3S—CHCOOCH_2CH_2C_4F_9$

Samples were exposed employing a medical dry laser imager (fitted with a 660 nm semiconductor laser at a maximum output of 60 mW (IIIB)) and subsequently thermally developed (Photothermographic Dry Imaging Material-1 and -2 were developed for the total of 24 seconds, employing four panel heaters set at 112° C.-119° C.-121° C.-121° C., while Photothermographic Dry Imaging Material-3 and -4 were developed for the total of 14 seconds under the same conditions as above). The resulting samples were evaluated in the same manner as Example 1, and the results shown in Table 7 were obtained.

TABLE 7

| Photo-thermographic Dry Imaging Material | Fog | Relative Photographic Speed | Maximum Density (relative value) | Storage Stability after Development: Dmin Variation Ratio (%) | Storage Stability after Development: Dmax Variation Ratio (%) | Evaluation of Color Tone of Silver Image: Evaluation Based on Linear Regression Line: $R^2$ | Intercept | Gradient | Visual Evaluation | Remarks |
|---|---|---|---|---|---|---|---|---|---|---|
| 1 | 0.201 | 115(0.4) | 108 | 105 | 96 | 0.999 | 0.5 | 1.2 | good | Inv. |
| 2 | 0.202 | 100(7) | 100 | 133 | 87 | 0.543 | −8.9 | 0.3 | poor | Comp. |
| 3 | 0.200 | 118(0.3) | 110 | 108 | 96 | 0.999 | 0.4 | 1.1 | good | Inv. |
| 4 | 0.199 | 100(0.1) | 100 | 129 | 88 | 1.00 | −8.7 | 0.2 | poor | Comp. |

Inv.: Present Invention
Comp.: Comparative Example

As can clearly be seen from Table 7, even though the silver salt photothermographic dry imaging materials of the present invention resulted in fog (minimum density) equal to or less than the comparative examples, the photographic speed and the maximum density were equal to or more than the comparative examples, and specifically exhibited excellent storage stability of image after development. Further, in the color tone evaluation of the samples according to the present invention, the coefficient of determination value $R^2$ was 0.998-1.000; b* value of the intersection of the aforesaid linear regression line with the ordinate was −5-+5; gradient (b*/a*) was 0.7-2.5, whereby it was possible to state that the desired color tone ha been obtained.

What is claimed is:

1. A photothermographic imaging material comprising a support having thereon light-insensitive organic silver salt grains, photosensitive silver halide grains, a reducing agent for silver ions and a binder, wherein the imaging material further contains a yellow leuco dye or a cyan leuco dye;

the silver halide grains are capable of producing a larger number of inner latent images than surface latent images after the imaging material is subjected to heating development; and a surface photographic speed of the imaging material decreases after the imaging material is subjected to heating development.

2. The photographic imaging material of claim 1, wherein the reducing agent is represented by General Formula (RED):

General Formula (RED)

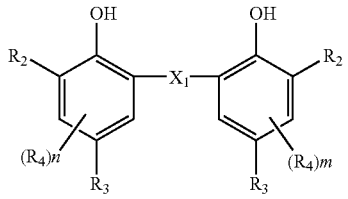

wherein $X_1$ represents a chalcogen atom or $CHR_1$, $R_1$ being a hydrogen atom, a halogen atom, an alkyl group, an alkenyl group, an alkynyl group, an aryl group or a heterocyclic group; $R_2$ represents an alkyl group; $R_3$ represents a hydrogen atom or a substituent capable of substituting a hydrogen atom on a benzene ring; $R_4$ represents a substituent; and, m and n each represents an integer of 0 to 2.

3. The photothermographic imaging material of claim 1, further comprising a development accelerator, or comprising at least two reducing agents each having a different chemical structure.

4. The photothermographic imaging material of claim 1, wherein the light-insensitive organic silver salt grains contains silver behenate in an amount of not less than 50 weight % based on the total weight of the light-insensitive organic silver salt grains.

5. The photographic imaging material of claim 1, wherein the light-insensitive organic silver salt grains are produced by an alkaline metal salt containing a potassium salt in an amount of not less than 50 mol % based on the total mol of the alkaline metal; and the silver halide grains are capable of producing a larger number of inner latent images than surface latent images after the imaging material is subjected to heating development; and a surface photographic speed of the imaging material decreases when the imaging material is subjected to heating developments.

6. The photothermographic imaging material of claim 1, wherein the light-insensitive organic silver salt grains are produced by:

(i) an alkaline metal salt containing a potassium salt in an amount of not less than 50 mol % based on the total mol of the alkaline metal; and (ii) silver halide grains having an average particle diameter of 0.02 to 0.07 μm, and the silver halide grains are capable of producing a larger number of inner latent images than surface latent images after the imaging material is subjected to heating development; and a surface photographic speed of the imaging material decreases when the imaging material is subjected to heating development.

7. The photothermographic imaging material of claim 1, further comprising a compound represented by General Formula (ST):

$$Z\text{-}SO_2.S\text{-}M \qquad \text{General Formula (ST)}$$

wherein Z represents an unsubstituted or substituted alkyl group, an aryl group or a heterocyclic group; and M represents a metal atom or an organic cation.

8. The photothermographic imaging material of claim 1, further comprising a compound represented by General Formula (CV):

General Formula (CV)

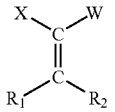

wherein, X represents an electron withdrawing group; W represents a hydrogen atom, an alkyl group, an alkenyl group, an alkynyl group, an aryl group, a heterocyclic group, a halogen atom, a cyano group, an acyl group, a thioacyl group, an oxalyl group, an oxyoxalyl group, a —S-oxalyl group, an oxamoyl group, an oxycarbonyl group, a —S-carbonyl group, a carbamoyl group, a thiocarbamoyl group, a sulfonyl group, a sulfinyl group, an oxysulfonyl group, a —S-sulfonyl group, a sulfamoyl group, an oxysulfinyl group, a —S-sulfinyl group, a sulfinamoyl group, a phosphoryl group, a nitro group, an imino group, a N-carbonylimino group, a N-sulfonylimino group, an ammonium group, a sulfonium group, a phosphonium group, a pyrylium group or an immonium group; $R_1$ represents a hydroxyl group or a salt thereof; and $R_2$ represents an alkyl group, an alkenyl group, an alkynyl group, an aryl group or a heterocyclic group, provided that X and W may form a ring structure by bonding to each other, X and $R_1$ may be a cis-form or a trans-form.

9. The photothermographic imaging material of claim 1, further comprising a polymer containing a recurring monomer capable of releasing a halogen radical in the molecule.

10. The photothermographic imaging material of claim 1, wherein the silver halide grains comprises a dopant capable of trapping an electron inside of the grains after heating development.

11. The photothermographic imaging material of claim 1, wherein the silver halide grains are covered with a spectral sensitizing dye on surfaces of the grains so as to exhibit a spectral sensitivity and the spectral sensitivity substantially disappears after thermal development of the imaging material.

12. The photothermographic imaging material of claim 1, wherein the silver halide grains are chemically sensitized on surfaces of the grains so as to exhibit an effect of chemical sensitization and the effect of chemical sensitization substantially disappears after thermal development of the imaging material.

* * * * *